US009636940B2

(12) United States Patent
Kamitani et al.

(10) Patent No.: US 9,636,940 B2
(45) Date of Patent: May 2, 2017

(54) WRITING INSTRUMENT

(71) Applicant: MITSUBISHI PENCIL COMPANY, LIMITED, Shinagawa-ku, Tokyo (JP)

(72) Inventors: Toshimi Kamitani, Yokohama (JP); Satoru Banzai, Fujioka (JP); Yoshiharu Namiki, Yokohama (JP); Yosuke Setagawa, Fujioka (JP); Hitoshi Kino, Fujioka (JP); Tooru Nakajima, Yokohama (JP); Takanori Suzuki, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 43 days.

(21) Appl. No.: 14/647,925

(22) PCT Filed: Dec. 3, 2013

(86) PCT No.: PCT/JP2013/082442

§ 371 (c)(1),
(2) Date: May 28, 2015

(87) PCT Pub. No.: WO2014/087988

PCT Pub. Date: Jun. 12, 2014

(65) Prior Publication Data

US 2015/0298489 A1 Oct. 22, 2015

(30) Foreign Application Priority Data

Dec. 4, 2012 (JP) ..... 2012-265158
Dec. 4, 2012 (JP) ..... 2012-265159
(Continued)

(51) Int. Cl.
*B43K 7/08* (2006.01)
*B43K 23/12* (2006.01)
(Continued)

(52) U.S. Cl.
CPC ..... *B43K 23/12* (2013.01); *B43K 5/18* (2013.01); *B43K 7/01* (2013.01); *B43K 7/02* (2013.01);
(Continued)

(58) Field of Classification Search
CPC ..... B43K 23/123; B43K 8/026; B43K 8/03; B43K 8/06
(Continued)

(56) References Cited

U.S. PATENT DOCUMENTS 6,474,895 B2 * 11/2002 Hori ..... B43K 5/18 401/205

FOREIGN PATENT DOCUMENTS

GB 722448 A 1/1955
JP 6-71172 U 10/1994
(Continued)

OTHER PUBLICATIONS

International Preliminary Report and Written Opinion issued on Jun. 18, 2015, by the International Bureau in corresponding International Application No. PCT/JP2013/082442 (9 pages).
(Continued)

*Primary Examiner* — Jennifer C Chiang
(74) *Attorney, Agent, or Firm* — Buchanan, Ingersoll & Rooney PC

(57) ABSTRACT

Provided is a writing instrument suited to ballpoint pens, marking pens and the like in which a flow pressure of an ink applied to a pen tip is controlled to a fixed level to prevent an ink direct flow phenomenon reverse flow phenomenon. The above writing instrument comprises a pen tip disposed at a front part of an ink tank, an ink received in the ink tank, a follower filled at a rear part of the ink, and a capillary porous member provided with a capillary force, which is arranged at a space part between a rear part of the follower
(Continued)

and a rear end part of the ink tank in a state in which the follower is filled, wherein the pen tip is sealed when a cap is put on the writing instrument.

2 Claims, 44 Drawing Sheets

(30) Foreign Application Priority Data

| | | |
|---|---|---|
| Dec. 4, 2012 | (JP) | 2012-265160 |
| Dec. 4, 2012 | (JP) | 2012-265161 |
| Nov. 22, 2013 | (JP) | 2013-241801 |

(51) Int. Cl.

| | |
|---|---|
| ***B43K 7/02*** | (2006.01) |
| ***B43K 8/03*** | (2006.01) |
| ***B43K 8/02*** | (2006.01) |
| ***B43K 8/06*** | (2006.01) |
| ***B43K 7/01*** | (2006.01) |
| ***B43K 8/04*** | (2006.01) |
| ***B43K 5/18*** | (2006.01) |
| ***B43K 7/03*** | (2006.01) |
| ***B43K 7/10*** | (2006.01) |
| ***B43K 8/14*** | (2006.01) |

(52) U.S. Cl.
CPC ..... *B43K 7/03* (2013.01); *B43K 7/08* (2013.01); *B43K 7/10* (2013.01); *B43K 8/026* (2013.01); *B43K 8/03* (2013.01); *B43K 8/04* (2013.01); *B43K 8/06* (2013.01); *B43K 8/143* (2013.01)

(58) Field of Classification Search
USPC ..... 401/141, 142, 198, 199
See application file for complete search history.

(56) References Cited

FOREIGN PATENT DOCUMENTS

| | | | |
|---|---|---|---|
| JP | 7-195891 | A | 8/1995 |
| JP | 11-099790 | A | 4/1999 |
| JP | 2001-010280 | A | 1/2001 |
| JP | 2001-039079 | A | 2/2001 |
| JP | 2001-096969 | A | 4/2001 |
| JP | 2001-096970 | A | 4/2001 |
| JP | 2008-265203 | A | 11/2008 |

OTHER PUBLICATIONS

International Search Report (PCT/ISA/210) mailed on Mar. 4, 2014, by the Japanese Patent Office as the International Searching Authority for International Application No. PCT/JP2013/082442.

* cited by examiner (a)

(b)

(a)

(b)

(c)

WRITING INSTRUMENT

TECHNICAL FIELD

The present invention relates to a writing instrument suited to ballpoint pens, marking pens and the like in which a flow pressure of an ink applied to a pen tip is controlled to a fixed level to prevent an ink direct flow phenomenon•reverse flow phenomenon.

BACKGROUND ART

In general, writing instruments having a structure in which they are provided with a ballpoint tip or a finely movable valve system in order to prevent a direct flow of an ink are employed in many cases for writing instruments having such a form that they comprise a writing instrument main body such as an ink vessel which is excellent in a display property and liable to observe an ink remaining amount, an ink and a follower (following member) filled at a rear end part of the ink.

In writing instruments in which the ballpoint pen tip is used to prevent a direct flow of an ink as is the case with the former structure, the ink is designed in many cases so that the ink is prevented from flowing directly from the tip when the tip is continuously brought into contact with a non-writing surface with the tip turned downward in storing, and it narrows a width of designing the ink.

Also, in the writing instrument of the valve system employed in the latter structure, a writing feeling is deteriorated due to backlash caused in writing, and a flow amount of an ink is varied depending on time for which the valve is opened. Accordingly, the problem that a difference in a density of lines in writing characters and straight lines is liable to be brought about has been involved therein.

Known as writing instruments which intend to try to solve such the problem as described above are, for example, 1) a writing instrument of a valve system provided with a valve mechanism in which the valve is opened to cause an ink in an ink reservoir to flow to a pen feed in a case where a pen feed moves back at a fixed stroke or more and where a pressing force of a specific resistance load or more is applied in order to provide a writing instrument which makes it possible to smoothly open the valve without causing an uncomfortable feeling such as a pumping feeling and which has a sufficiently high spring force for closing the valve to make it possible to surely prevent the ink from leaking and dripping, wherein it is provided with a mechanism in which a dummy pumping part comprising an elastic member increasing a resistance load against a pressing force of the pen feed according to backward moving operation of the pen feed during a stroke applied until the valve is opened is provided at a tip part of a holder (refer to, for example, a patent document 1), 2) a liquid storing vessel in a liquid discharge instrument, which receives a liquid in an inside and is connected with a discharge means for discharging the above liquid and which is provided with an air flow means for introducing thereinto air corresponding to a volume of the content liquid consumed as the content liquid is consumed through the discharge means, wherein an air exchange wall comprising organopolysiloxane which is a solid at ordinary temperature is arranged as the air flow means described above, and a minimum distance required for connecting an inside and an outside of the vessel described above is 1.0 μm or more and 0.2 mm or less (refer to, for example, a patent document 2), 3) a writing instrument comprising an air flow passage which connects with an inside of an ink tank receiving an ink in a free state and which is formed for introducing air from the outside in order to maintain an internal pressure of the ink tank according to a change in a volume of the ink in the ink tank as the ink is consumed, wherein a viscous fluid layer comprising a viscous fluid in which a contact angle $\theta$ of the fluid formed with a wall member brought into contact with the fluid is $0<\theta\leq 90°$ and in which a surface tension $\alpha$ is 10 dyn/cm$\leq\alpha\leq$73 dyn/cm (20° C.) is arranged in the air flow passage described above, and an air flow hole is formed temporarily in the viscous fluid layer as an internal pressure of the ink tank is reduced according to a change in a volume of the ink (refer to, for example, a patent document 3), 4) a writing instrument comprising an inner tube which receives directly an ink in a fluid manner and in which a rear end is opened, an outer tube in which the above inner tube is disposed in a coaxially and freely fitting manner so that a space of a prescribed cross-sectional area communicating with the outside via an air exchange means is secured between the inner tube and the outer tube and in which a rear end is closed, and a pen tip disposed at a front end aperture of the outer tube and the inner tube, wherein a balance liquid for controlling a flow pressure of the ink applied to the pen tip to a fixed pressure is received in a fluid manner at a latter part side of the space described above in an inside of the outer tube connecting via a rear end aperture of the space in an inside of the inner tube in a state connecting from an interface of the ink in the space of the inner tube (refer to, for example, a patent document 4), and 5) a writing instrument in which an ink received in an ink reservoir in a fresh ink state is supplied to a pen tip and in which a movable wall part is provided at a wall part forming the ink reservoir so that the ink reservoir is decreased in a volume as the ink is consumed, wherein the movable wall part described above is provided at a wall part partitioning the ink reservoir, and an air chamber having an elastic wall part and a wall part forming a liquid film by a capillary force at a wall part partitioning the outside is provided (refer to, for example, a patent document 5).

The respective writing instruments described in the above patent documents 1 to 5 are improved more than writing instruments having conventional structures and enhanced in performances thereof, but an ink direct flow phenomenon is still observed, and therefore they are not satisfactory.

Also, in the patent document 5 described above in which the technology close to that of the present invention is disclosed, an elastic film member for meeting a change in an internal pressure is provided. However, when the above elastic film member is not provided with a repellent force (restoring force), an increased portion of a pressure applied by permeation can not be suppressed. Also, when an outside pressure is lower than an atmospheric pressure, an internal pressure falls into a pressurization state, and even if the outside pressure is lowered within the atmospheric pressure, the internal pressure falls into a pressurization state when heated subsequently. Further, if the elastic film member is provided with a repellent force, the internal pressure falls into a pressurization state due to the repellent force when a volume thereof is increased by a change in the temperature, and since the above elastic film member does not yet sufficiently meet a change in an internal pressure, problems such as causing leakage of an ink in use in a certain case are involved therein.

PRIOR ART DOCUMENTS

Patent Documents

Patent document 1: JP-A 2008-265203 (claims, drawings and the like)

Patent document 2: JP-A 2001-96969 (claims, drawings and the like)

Patent document 3: JP-A 2001-10280 (claims, drawings and the like)

Patent document 4: JP-A H11-99790 (claims, drawings and the like)

Patent document 5: JP-A H07-195891 (claims, drawings and the like)

DISCLOSURE OF THE INVENTION

In light of the problems on the conventional techniques described above, the present invention intends to solve them, and an object thereof is to provide a writing instrument suited to ballpoint pens, marking pens and the like in which a flow pressure of an ink applied to a pen tip is controlled to a fixed level to prevent an ink direct flow phenomenon•reverse flow phenomenon.

Intensive investigations repeated by the present inventors in order to solve the conventional problems described above have resulted in finding that the writing instruments which meet the objects described above are provided by a writing instrument comprising a pen tip disposed at a front part of an ink tank, an ink received in the ink tank, a follower filled at a rear part of the ink, and a porous member having a specific structure, which is arranged at a space part between a rear part of the follower and a rear end part of the ink tank in a state in which the follower is filled, wherein a cap is provided with a constitution in which the pen tip is sealed when the cap is put on the writing instrument, and thus, the present inventors have come to complete the present invention.

That is, the present invention resides in the following items (1) to (3).

(1) A writing instrument comprising a pen tip disposed at a front part of an ink tank, an ink received in the ink tank, a follower filled at a rear part of the ink, and a capillary porous member provided with a capillary force by impregnating the porous member with a liquid, which is arranged at a space part between a rear part of the follower and a rear end part of the ink tank in a state in which the follower is filled, wherein the pen tip is sealed when a cap is put on the writing instrument.

(2) The writing instrument as described in the above item (1), wherein a capillary force provided at a pen tip side is larger than a total of an own weight of the ink and the capillary force at a rear part of the writing instrument.

(3) The writing instrument as described in the above item (1) or (2), wherein the capillary porous member is brought into contact with a member having a slit part.

According to the present invention, provided is a writing instrument in which a flow pressure of an ink applied to a pen tip is controlled to a fixed level to prevent an ink direct flow phenomenon•reverse flow phenomenon.

DESCRIPTION OF THE PREFERRED EMBODIMENTS

The performing form in the first embodiment of the present invention shall be explained below in detail with reference to the drawings (FIG. 1 to FIG. 7).

Figure 1:
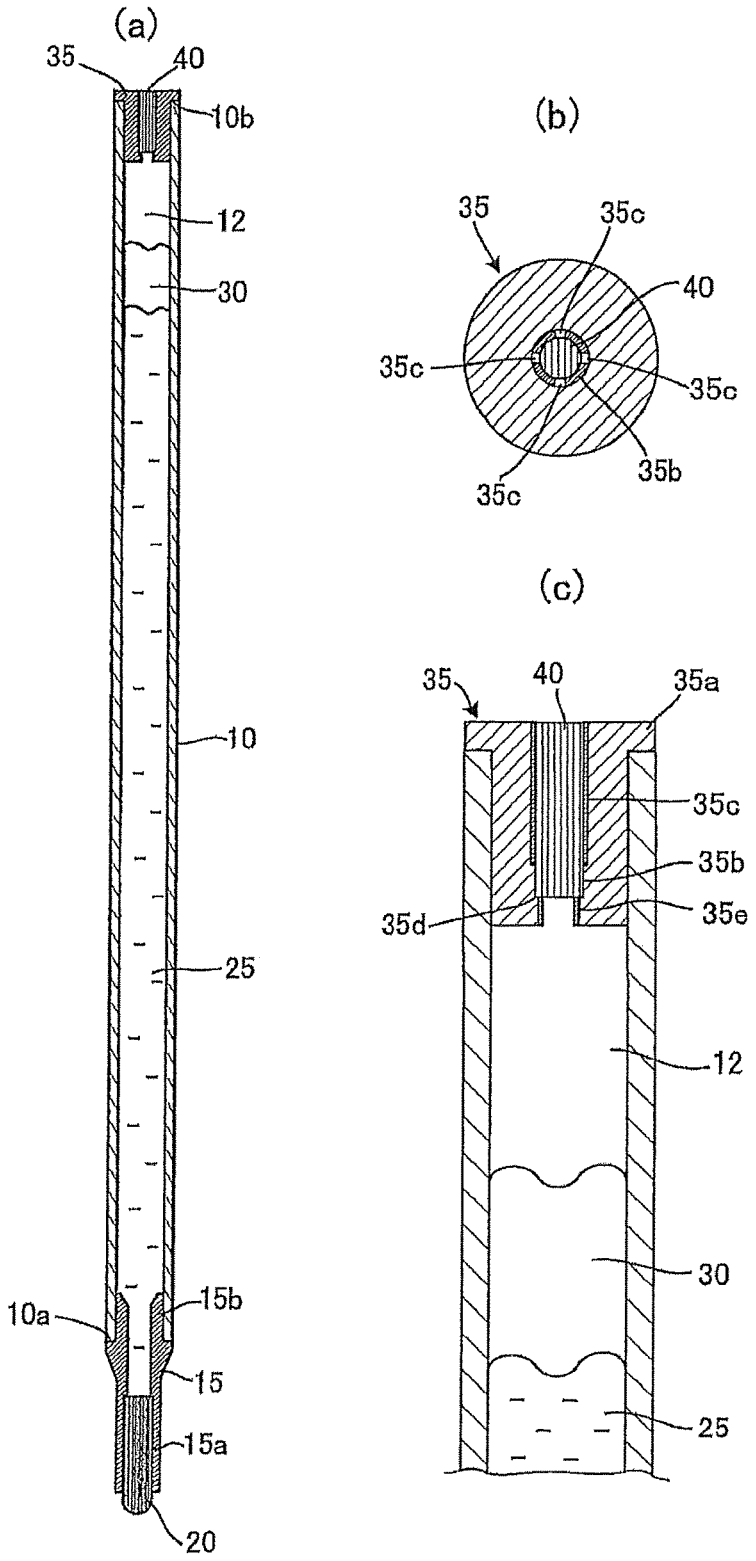
FIG. 1 is a drawing showing one example of a performing form in the first embodiment of the present invention, wherein (a) is a vertical cross section; (b) is a plan; and (c) is a partially enlarged vertical cross section showing an essential part.
Figure 2:
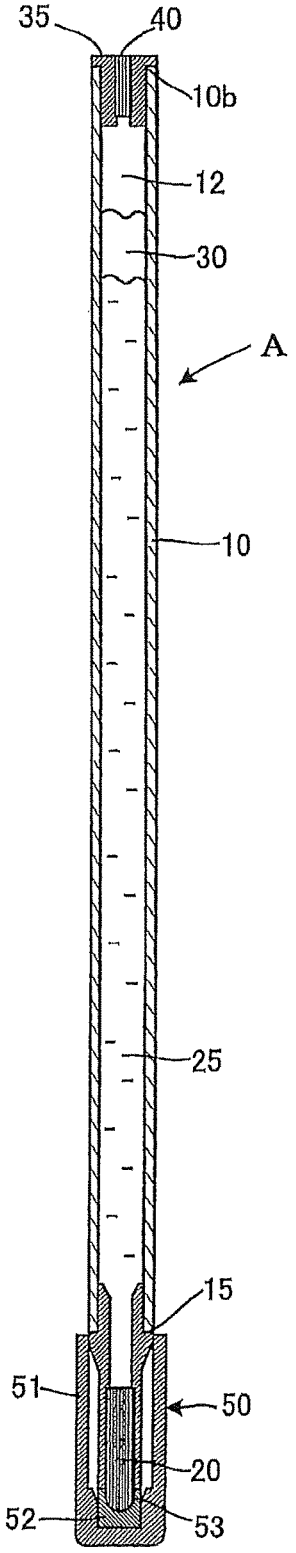
FIG. 2 is a vertical cross section showing a state in which a cap member is mounted to seal a pen tip.

FIG. 1 and FIG. 2 are the respective drawings of the writing instrument showing one example (first performing form) of the performing forms in the first embodiment of the present invention.

The writing instrument A of the present performing form is a writing instrument of a marking type, and it comprises, as shown in FIG. 1 and FIG. 2, an ink tank 10 which is a writing instrument main body (holder part), a pen tip 20 disposed at a front part of an ink tank, an ink 25 received in the ink tank 10, a follower (following member) 30 filled at a rear part of the above ink 25, a capillary porous member 40 provided with a capillary force, which is arranged at a space part 12 between a rear part of the follower (following member) 30 and a rear end part of the ink tank 10 in a state in which the follower (following member) 30 is filled, and a cap member 50 sealing the whole pen tip 20.

The above ink tank 10 is preferably one which is not adversely affected with the passage of time by raw materials contained in the ink received therein. It can be formed by using materials including, for example, resins such as polypropylene (PP), polyethylene naphthalate (PEN), polyethylene terephthalate (PET), polyethylene (PE) and the like, and metals such as aluminum and the like. In the present performing form, the ink tank 10 is molded in a cylindrical form by using polypropylene (PP) and functions as a writing instrument main body.

A wall thickness (thickness) of the resulting ink tank is varied according to the kind of the ink received therein, the material kind of the resin used, the kind of the writing instrument, and the like, and it is preferably 0.05 to 2.0 mm, more preferably 0.3 to 1.5 mm in terms of a strength, a solvent permeation resistance, an inhibition in a hygroscopicity, a moldability, a visibility, a design property, and the like.

The pen tip 20 is a pen feed which is a writing part composed of a fiber feed obtained by processing fiber bundles or subjecting the fiber bundles to resin processing, a sintered feed (porous member) obtained by sintering various plastic powders, or the like, and it has a structure in which it is fixed in a through hole 15*a* of a front holder 15 mounted at a tip part of the ink tank 10. A rear end side of the front holder 15 is a fixing part 15*b* which is fixed to a front aperture part 10*a* of the ink tank 10 by interlocking.

In the present performing form, the pen feed 20 which is the pen tip is composed of a fiber bundle feed comprising polyethylene terephthalate (PET) fibers.

The ink 25 received in the ink tank 10 shall not specifically be restricted and includes a water based ink, an oil based ink, a gel ink and the like. A pigment (including a resin pigment), a colorant such as a dye and the like, a main solvent, a resin, a thickener, and optional components added to inks for writing instruments can be used as the components of the ink according to the uses thereof (a water based ink, an oil based ink, a gel ink and the like) and the kind of the writing instrument (a marking pen, a ballpoint pen and the like).

Capable of being contained as the optional components are, for example, a rust preventive, an anti-mold agent, a surfactant, a lubricant, a wetting agent and the like which can be compatible with the ink without exerting adverse effects to the ink. In an ink for a ballpoint pen, fatty acids can suitably be used as the lubricant. Also, non-volatile solvents and the like which are compatible with the main solvent can also be added as an additive for inhibiting drying as long as adverse effects are not exerted in terms of the characteristics of the products.

In the present performing form, the ink is composed of an ink for water based felt tip pens.

The follower (following member) 30 follows the ink as it is consumed in writing. It has preferably a low permeability and a low dispersibility against the solvent used, and non-volatile and hardly volatile fluids, to be specific, polybutene, liquid paraffin and the like can be used as a base material thereof.

When the above substances have a low viscosity, a thickener and a gelling agent are preferably used. They include, to be specific, metal soaps, bentonites, fatty acid amides, hydrogenated castor oils, metal fine particles containing titanium oxide, silica, alumina and the like, celluloses, elastomers, and the like. In the present performing form, the follower (following member) 30 is composed of a mineral oil and a thickener.

The writing instrument A of the present performing form is constituted so that a space part 12 is formed between a rear part of the follower 30 and a rear end part of the ink tank 10 in a state in which the follower (following member) 30 is filled and that the capillary porous member 40 provided with a capillary force is arranged in the above space part 12. To be specific, a member 35 which is a tail plug for sealing an aperture part 10*b* of the ink tank 10 is mounted at the above aperture part 10*b*. The above member 35 is composed of a lid part 35*a*, a through hole 35*b* formed in the center, slit parts 35*c*, 35*c* - - - which are formed on a peripheral surface of the above through hole 35*b*, and a step part 35*d* and a rib part 35*e* for holding a front end part of the capillary porous member 40 which are arranged at a tip side of the through hole 35*b*, and the capillary porous member 40 provided with a capillary force is mounted in the through hole 35*b* having the slit parts 35*c*, 35*c* - - - in a contact state, whereby the capillary porous member 40 provided with a capillary force is constituted so that it is arranged in the space part 12.

The above capillary porous member 40 shall not specifically be restricted as long as it is composed of a porous member provided with a capillary force, and it includes, for example, those prepared by impregnating porous members selected from fiber feeds obtained by processing fiber bundles, sintered members, felts and the like or subjecting the above fiber bundles to resin processing, and foamed materials such as sponges and the like with liquids such as mineral oils, process oils, silicone oils, ionic oils, and the like.

It is preferably composed of the process oils having a low vapor pressure from the viewpoint of preventing volatilization.

When the ink is discharged from the pen tip 20, air is introduced by the above capillary porous member 40 to thereby make writing possible. When writing is stopped, it becomes possible to maintain a pressure reducing state in an inside of the space 12, and the ink is prevented from directly flowing. Also, if the oil in the porous member moves when introducing air, it is temporarily held in the slit parts 35*c*, 35*c* - - - which are formed on a peripheral surface of the through hole 35*b* in the member 35 described above, and therefore the liquid can be prevented from dripping.

In the present performing form, the porous member is composed of the combination of a fiber bundle feed and a process oil.

The cap member 50 has a main body part 51 detachably mounted at a front end side of the ink tank 10 which is a writing instrument main body (holder part), and an inner cylinder part 53 in which a sealing member 52 composed of rubber such as nitrile rubber (NBR), butyl rubber (IIR) and the like, a thermoplastic elastomer, a soft resin and the like for sealing a whole projection part of the pen tip 20 is fitted in an inside. The above cap member 50 is mounted at a front end side of the ink tank 10, whereby a whole part of the pen tip 20 projected from the front holder 15 is sealed by the sealing member 52, and the ink is prevented from causing a phenomenon of directly flowing from the pen tip when an internal pressure of the ink tank is changed. The sealing member of the present performing form is composed of the butyl rubber (IIR).

In the present performing form, in order to make it possible to write with the pen tip turned upward, a capillary force (M1) endowed to a pen tip 20 side is set so that it is larger than a total of an own weight (M2) of the ink and a capillary force (M3) at a rear part of the writing instrument [M1>(M2+M3)]. This setting of M1>(M2+M3) makes it possible to prevent air from coming in from the pen tip even when writing with the pen tip turned upward, and the ink can be prevented from flowing backward when writing with the pen tip turned upward.

The writing instrument A thus constituted in the first performing form of the first embodiment in the present invention is provided with the space part 12 at an upper part of the follower 30 and endowed with the capillary porous member 40 at an upper part of the space part 12. Accordingly, the space part 12 between the follower 30 and the capillary porous member 40 is turned to a pressure reducing state by discharging the ink in writing, and when pressure reduction is over a capillary force of the capillary porous member 40, air (air bubbles) comes into the capillary porous member 40 to make it possible to write in a usual manner. On the other hand, when writing is finished, the air bubbles generated above are broken, and the capillary porous member 40 is impregnated with the liquid to restore a capillary force and make it possible to support an own weight of the ink. Obtained is a writing instrument suited to ballpoint pens, marking pens and the like in which a flow pressure applied to the pen tip is controlled to a fixed level by the above cycle to prevent an ink direct flow phenomenon•reverse flow phenomenon. Also, in the writing instrument A of the present first performing form, a whole projection part of the pen tip 20 is sealed by the sealing member 52 in fitting the cap member 50, and therefore the ink is prevented from causing a phenomenon of directly flowing from the pen tip 20 in storing even when an internal pressure of the ink tank is varied by heating.

Figure 4:
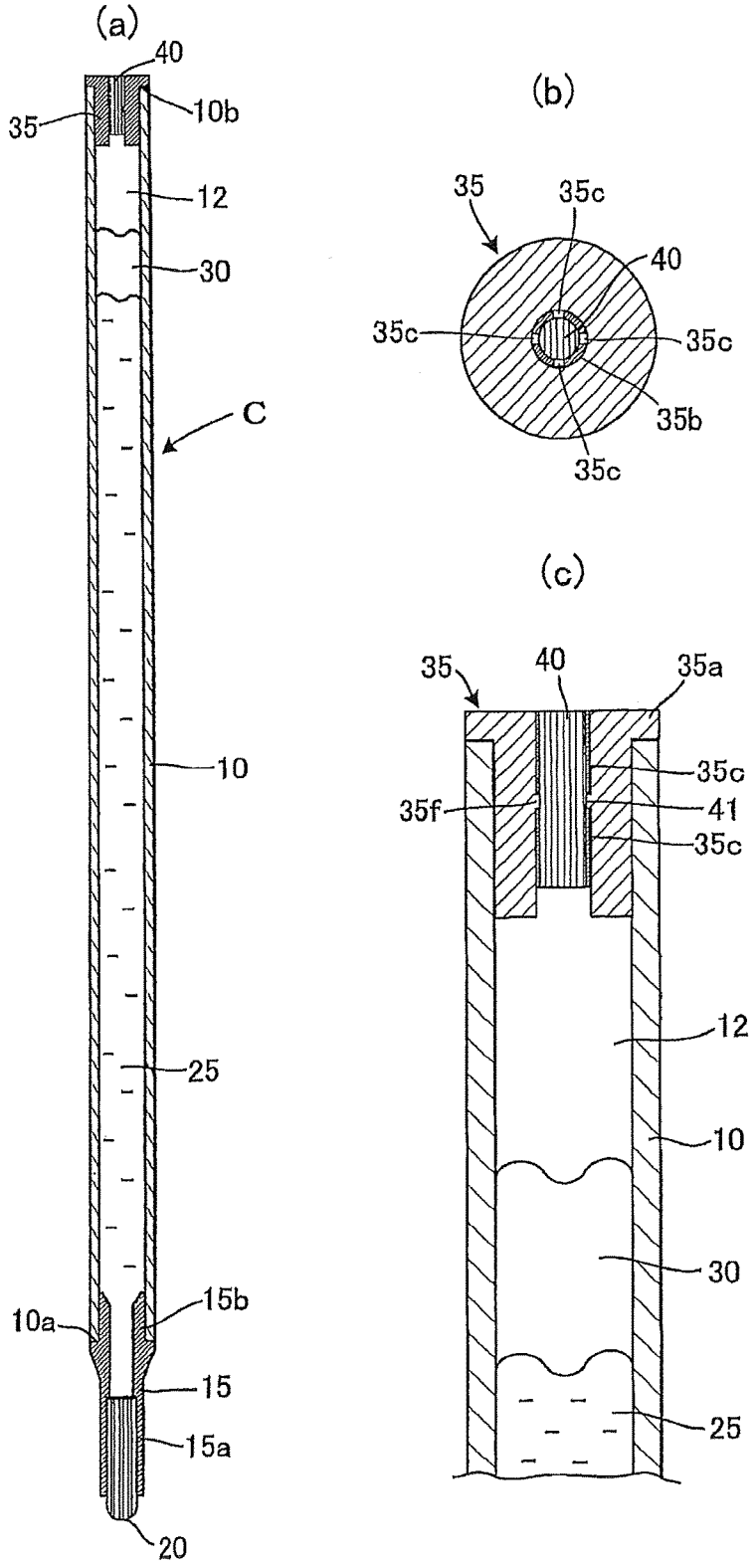
FIG. 4 is a drawing showing another example of a performing form in the first embodiment of the present invention, wherein (a) is a vertical cross section; (b) is a plan; and (c) is a partially enlarged vertical cross section showing an essential part.
Figure 5:
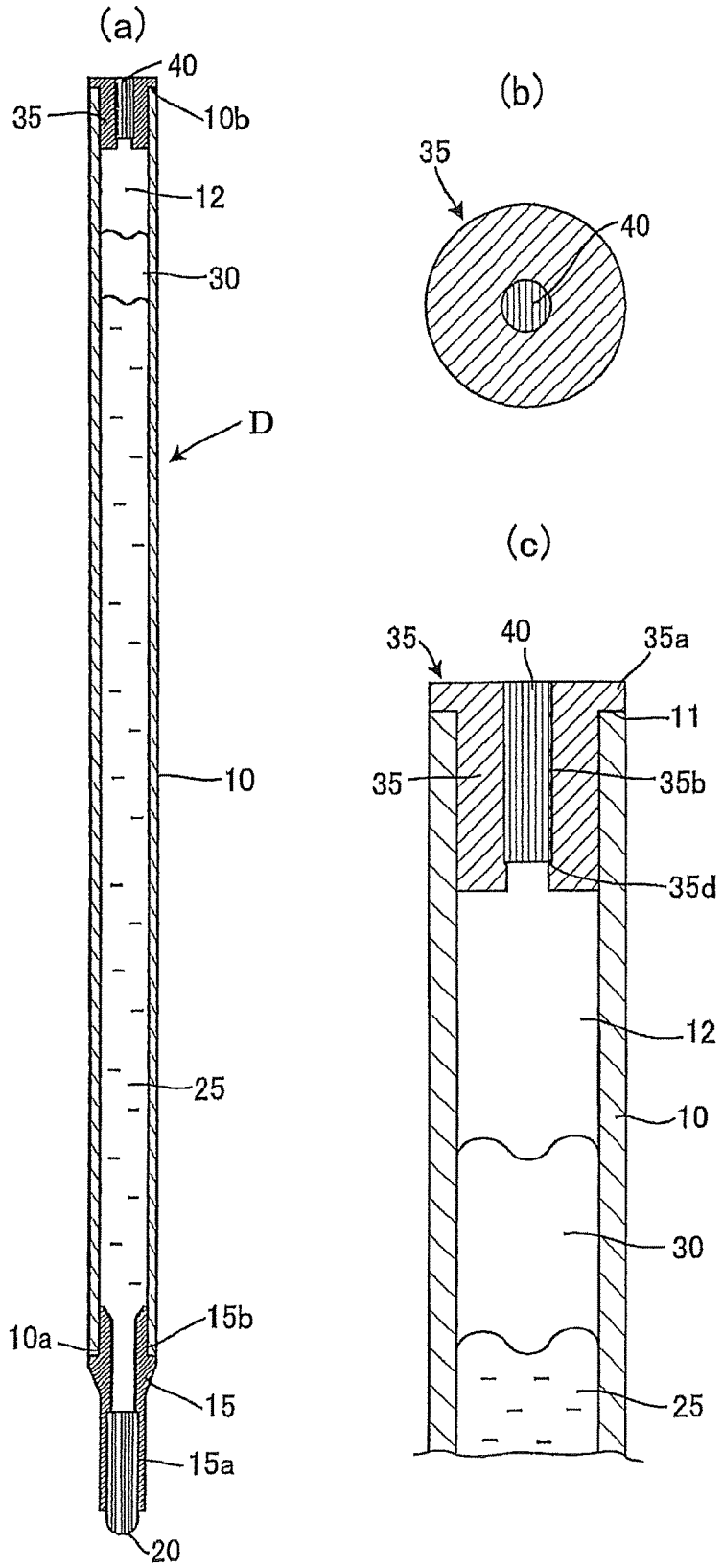
FIG. 5 is a drawing showing another example of a performing form in the first embodiment of the present invention, wherein (a) is a vertical cross section; (b) is a plan; and (c) is a partially enlarged vertical cross section showing an essential part.
Figure 6:
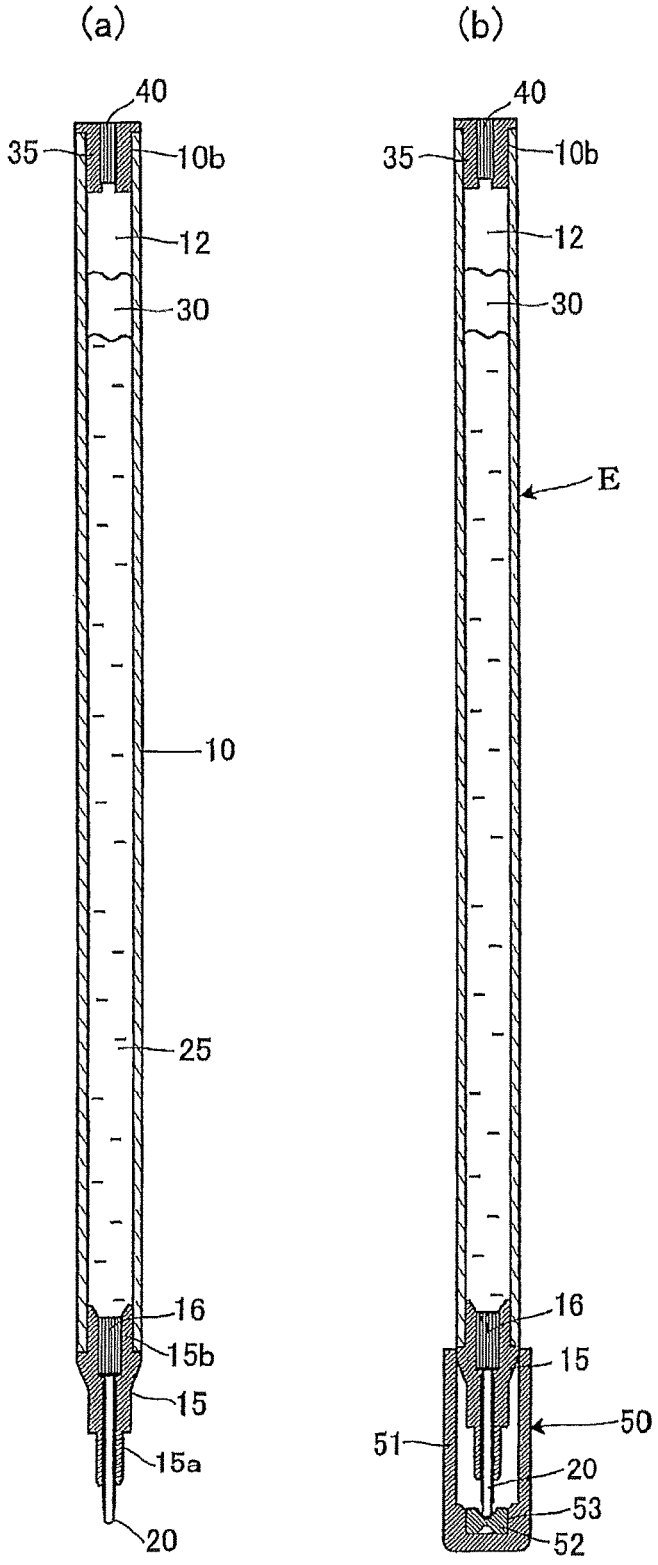
FIG. 6 is a drawing showing another example of a performing form in the first embodiment of the present invention, wherein (a) is a vertical cross section; and (b) is a vertical cross section showing a state in which a cap is mounted to seal a pen tip.
Figure 7:
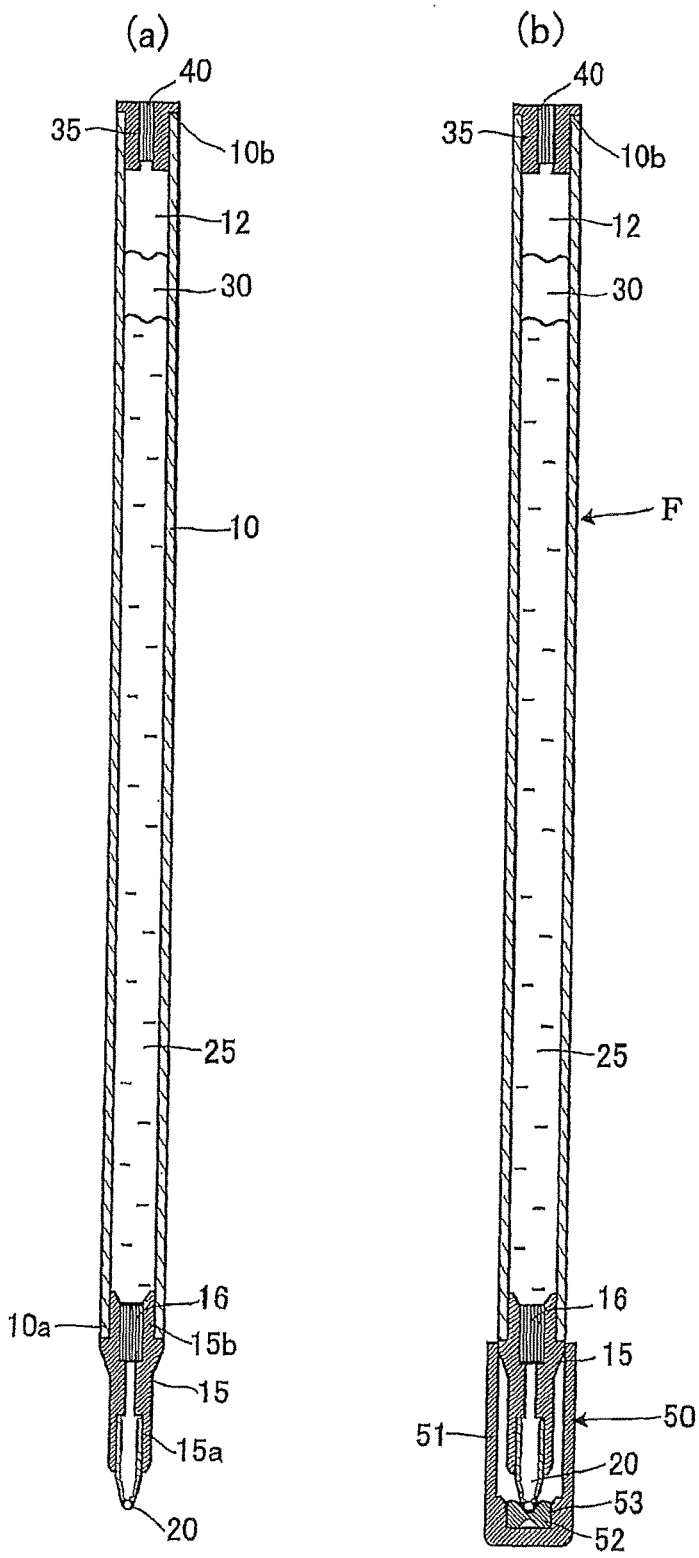
FIG. 7 is a drawing showing another example of a performing form in the first embodiment of the present invention, wherein (a) is a vertical cross section; and (b) is a vertical cross section showing a state in which a cap member is mounted to seal a pen tip.

Next, FIG. 3 to FIG. 7 show another examples (a second performing form to a sixth performing form) of the writing instruments of the first embodiment in the present invention. To compare them with the first embodiment shown in FIG. 1 and FIG. 2, FIG. 3 to FIG. 5 show the respective structures in which the capillary porous member 40 provided with a capillary force is changed in an arrange structure; FIG. 6 to FIG. 7 show the respective structures in which the pen tip is changed in a structure; structures other than the above respective structures are the same as those of the first embodiment (FIG. 1 and FIG. 2), and therefore the same marks are shown to omit the explanations thereof. In the respective writing instruments shown in FIG. 3 to FIG. 5, the cap member 50 which seals a whole projection part of the pen tip 20 is the same as in the first performing form described above, and therefore illustration thereof is omitted.

Figure 3:
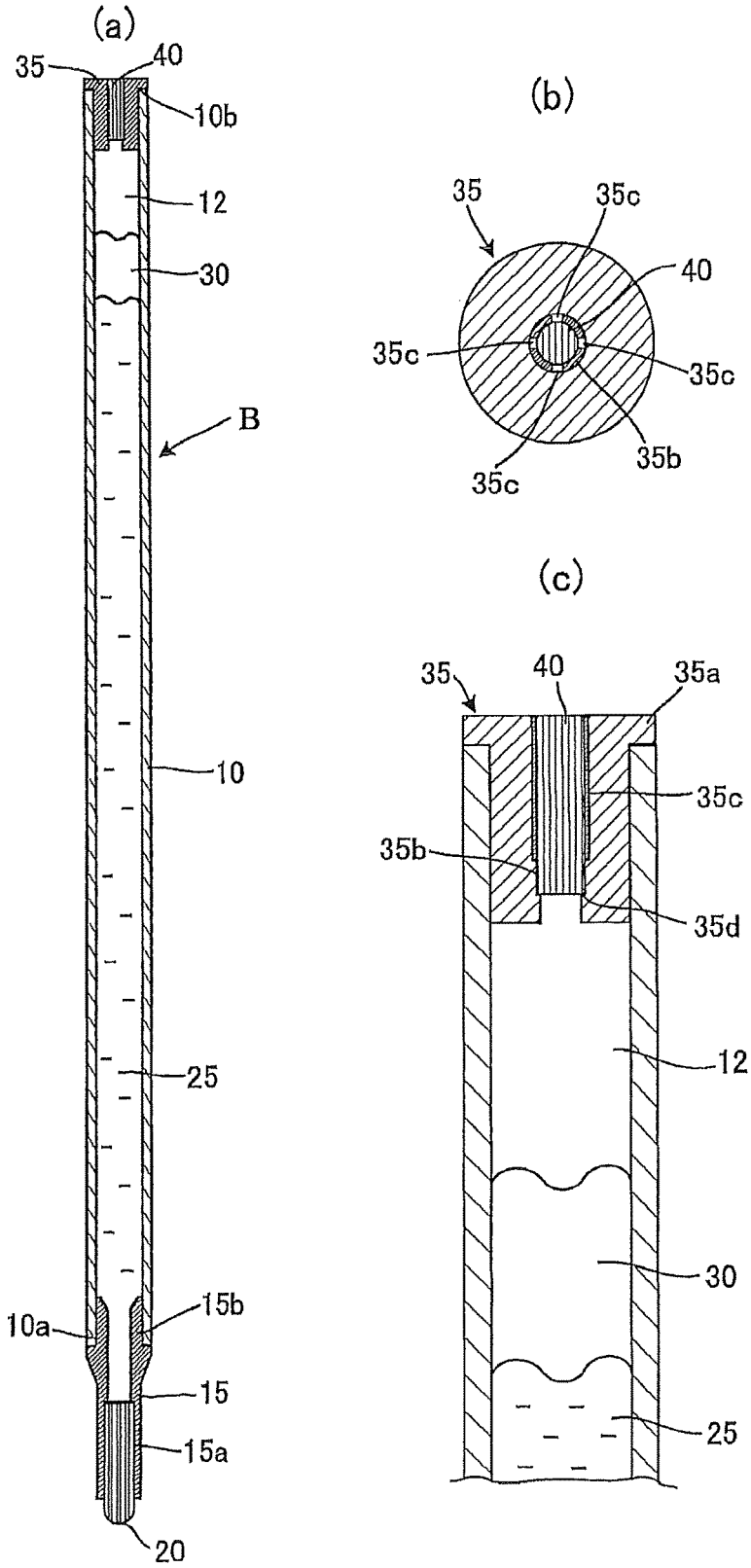
FIG. 3 is a drawing showing another example of a performing form in the first embodiment of the present invention, wherein (a) is a vertical cross section; (b) is a plan; and (c) is a partially enlarged vertical cross section showing an essential part.

A writing instrument B of the second performing form shown in FIG. 3 has a structure in which the capillary porous member 40 provided with a capillary force in the writing instrument A of the first performing form described above is arranged without mounting the rib part 35*e* provided at a tip side of the through hole 35*b*.

A writing instrument C of the third performing form shown in FIG. 4 has a structure in which the capillary porous member 40 provided with a capillary force in the writing instrument A of the first performing form described above is held by a convex holding part 35*f* formed on a peripheral surface in the middle of the through hole 35*b* without mounting the step part 35*d* and the rib part 35*e* which are formed at a tip side of the through hole 35*b*, wherein a concave holding part 41 is formed as well in the capillary porous member 40 provided with a capillary force so that the porous member is held by interlocking with the above convex holding part 35*f*, and the capillary porous member 40 is arranged in the through hole 35*b*.

A writing instrument D of the fourth performing form shown in FIG. 5 has a structure in which the capillary porous member 40 provided with a capillary force in the writing instrument A of the first performing form is held by the step part 35*d* without forming the slit parts 35*c*, 35*c* - - - formed on a peripheral surface of the through hole 35*b* and the rib part 35*e* formed at a front end thereof and in which the capillary porous member 40 is arranged in the through hole 35*b*.

Also in the respective writing instruments B to D of the second to fourth performing forms of the first embodiment shown in FIG. 3 to FIG. 5, the space part 12 between the follower 30 and the capillary porous member 40 is turned to a pressure reducing state by discharging the ink in writing as is the case with the writing instrument A of the first performing form described above, and when pressure reduction is over a capillary force of the capillary porous member 40, the capillary porous member 40 works to cause air to mix in, so that writing in a usual manner becomes possible; and when writing is finished, the capillary porous member 40 is impregnated again with the liquid to restore a capillary force and make it possible to cause the liquid to support an own weight, and therefore obtained is a writing instrument suited to marking pens in which a flow pressure applied to the pen tip is controlled to a fixed level to prevent an ink direct flow phenomenon•reverse flow phenomenon.

A writing instruments E of the fifth performing form shown in FIG. 6 is different only in that the pen tip (pen feed) 20 in the writing instrument A of the first performing form described above is composed of a plastic feed in which ink grooves are formed in a holder direction on various plastic materials via a feed 16 provided in an inside of a fixing part 15*b* of a front holder 15 instead of composing the pen tip (pen feed) 20 of a fiber feed, a sintered feed (porous member) or the like, and obtained is a writing instrument in which a flow pressure applied to a pen tip is controlled to a fixed level to prevent an ink direct flow phenomenon•reverse flow phenomenon as is the case with the writing instrument A of the first performing form described above and in which the pen tip is composed of a plastic feed.

A writing instruments F of the sixth performing form shown in FIG. 7 is different only in that the pen tip (pen feed) 20 in the writing instrument A of the first performing form described above is composed of a ballpoint pen tip in which a writing bal is stored via a feed 16 provided in an inside of a fixing part 15*b* of a front holder 15 instead of constituting the pen tip 20 by a fiber feed, a sintered feed (porous member) or the like, and obtained is a writing instrument in which a flow pressure applied to the pen tip is controlled to a fixed level to prevent an ink direct flow phenomenon•reverse flow phenomenon as is the case with the writing instrument A of the first performing form described above and in which the pen tip is composed of the ballpoint pen tip.

The present invention shall not be restricted to the performing forms described above and can be changed to various forms as long as the gist of the present invention is not changed.

The writing instruments showing the performing forms of the second embodiment in the present invention are shown in FIG. 8 to FIG. 15.

The writing instruments of the second embodiment relate to writing instruments suited to ballpoint pens, marking pens and the like in which a flow pressure applied to a pen tip is controlled to a fixed level to prevent an ink direct flow phenomenon•reverse flow phenomenon and in which an inside of an ink tank can be reduced in a pressure in detaching a cap to prevent the ink from leaking from the pen tip in use even if an inside of the ink tank receiving the ink is increased in a pressure in storing the writing instrument.

The constitution of the writing instrument of the above second embodiment includes the following constitutions of (1) to (3).

(1) A writing instrument in which an inhibiting mechanism for inhibiting a direct flow of an ink filled in an ink tank is provided at a rear part of a writing instrument main body, wherein a pen tip and a cap member sealing the above pen tip are mounted at a front part of the writing instrument main body, and a pressure reducing mechanism for reducing a pressure in an inside of the ink tank in detaching the cap member is provided at a rear part of the writing instrument main body.

(2) The writing instrument as described in the above item (1), wherein a refill which is the ink tank provided in an inside of the writing instrument main body moves forward in detaching the cap member.

(3) The writing instrument as described in the above item (1) or (2), wherein an elastic member is provided in the pressure reducing mechanism, and an elastic force of the elastic member is not higher than a drawing force of the cap member.

According to the writing instrument of the above second embodiment, provided is a writing instrument suited to ballpoint pens, marking pens and the like in which a flow pressure applied to a pen tip is controlled to a fixed level to prevent an ink direct flow phenomenon•reverse flow phenomenon and in which an inside of an ink tank can be reduced in a pressure in detaching a cap to prevent the ink from leaking from the pen tip in use even if an inside of the writing instrument main body is increased in a pressure in storing the writing instrument.

The performing forms of the second embodiment in the present invention shall be explained below in detail with reference to the drawings (FIG. 8 to FIG. 15).

FIG. 8 to FIG. 11 are the respective drawings of the writing instrument showing one example (first performing form) of the performing forms in the second embodiment in the present invention.

Figure 8:
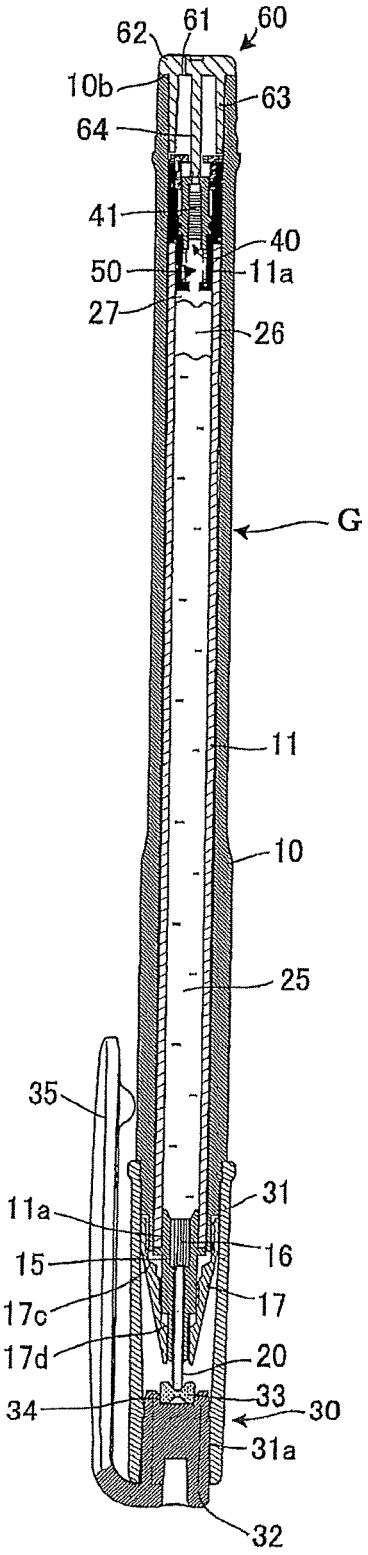
FIG. 8 is a writing instrument showing one example of a performing form in the second embodiment of the present invention, and it is a vertical cross section showing a state in which a cap member is mounted.
Figure 10:
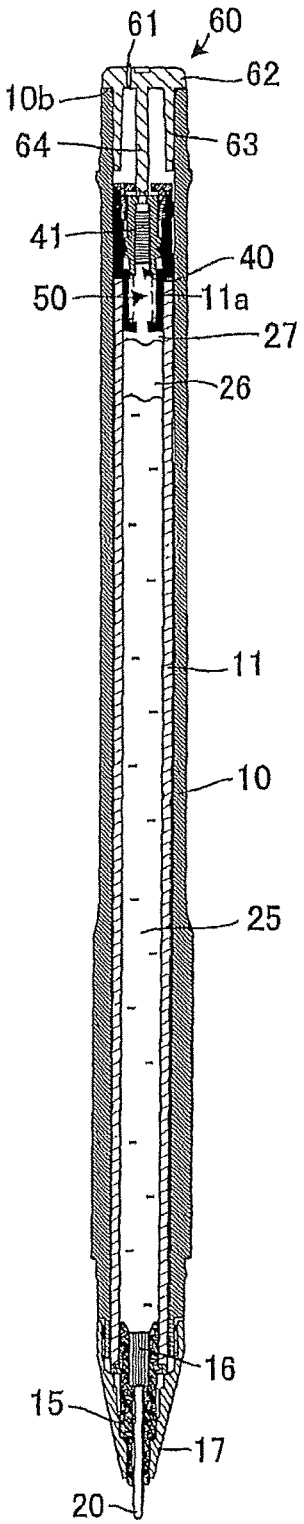
FIG. 10 is a vertical cross section showing a state in which the cap member is detached from the writing instrument shown in FIG. 1.

The writing instrument G of the present performing form is, as shown in FIG. 8 and FIG. 10, loaded with a pen tip 20 and a cap member 30 for sealing the above pen tip 20 at a front part of a writing instrument main body 10 which is a holder part and contains an ink 25 filled in a refill 11 which is an ink tank provided in an inside of the writing instrument main body 10, and an inhibiting mechanism 40 for inhibiting a direct flow of the ink and a pressure reducing mechanism 50 for reducing a pressure in an inside of the refill 11 in detaching the cap member 30 in a state in which the ink is filled are provided at a rear part of the writing instrument main body 10 described above.

The writing instrument main body 10 is a holder part and can be composed by using resins, metals and the like, and it is molded in a cylindrical form by using an acrylonitrile styrene (AS) resin in the present performing form.

The above writing instrument main body 10 is provided in an inside with the refill 11 receiving the ink 25, and it has, as described later, a structure in which the refill 11 moves forward in an inside of the writing instrument main body 10 in detaching the cap member 30.

The refill 11 is preferably one which is not adversely affected with the passage of time by raw materials contained in the ink received therein. It can be formed by using materials including, for example, resins such as polypropylene (PP), polyethylene naphthalate (PEN), polyethylene terephthalate (PET), polyethylene (PE) and the like, and metals such as aluminum and the like. In the present performing form, the refill 11 which is an ink tank is molded in a cylindrical form by using polypropylene (PP).

The pen tip 20 is composed of a pen feed which is a writing part composed of a plastic feed in which ink grooves are formed in a holder direction on various plastic materials.

The above pen feed 20 has a structure in which it is fixed by a cylindrical joint member 15 mounted in a tip aperture part 11*a* of the refill 11. The joint member 15 is composed of a cylindrical fixing part 15*a* fixed to the tip aperture part 11*a* of the refill 11 by interlocking and the like, a flange part 15*b* which is a cover part, and a holding part 15*d* holding the pen feed 20 and having a step part 15*c*. A feed 16 comprising a porous member is held in the cylindrical fixing part 15*a*, and it is constituted so that the ink 25 filled in the refill 11 which is an ink tank is supplied via the feed 16 comprising the porous member to the pen feed 20 which is a writing part composed of a plastic feed.

The refill 11 in which the pen feed 20 is fixed at a tip by the above joint member 15 is received in the writing instrument main body 10 so that it can slide. The joint member 15 of the above refill 11 is held by a cylindrical front holder 17 mounted to a tip aperture part of the writing instrument main body 10 by interlocking and the like.

In the front holder 17, a mounting part 17*a* mounted to a tip aperture part of the writing instrument main body 10 by interlocking and the like and a movable space part 17*b* in which the joint member 15 can move forward, as described later, in an inside when the refill 11 moves forward in an inside of the writing instrument main body 10 in detaching the cap member 30 are formed, and step parts 17*c*, 17*d* which are moving end points when the refill 11 moves forward are provided on an inner peripheral surface of the front holder 17 provided with the above movable space part 17*b*. The flange part 15*b* and a step part 15*c* of the joint member 15 are brought into contact with the step parts 17*c*, 17*d* provided in the front holder 17 to stop the refill 11 moving forward.

The ink 25 received in the refill 11 which is an ink tank shall not specifically be restricted and includes a water based ink, an oil based ink, a gel ink and the like. A pigment (including a resin pigment), a colorant such as a dye and the like, a main solvent, a resin, a thickener, and optional components added to inks for writing instruments can be used as the components of the ink according to the uses thereof (a water based ink, an oil based ink, a gel ink and the like) and the kind of the writing instrument (a marking pen, a ballpoint pen and the like).

Capable of being contained as the optional components are, for example, a rust preventive, an anti-mold agent, a surfactant, a lubricant, a wetting agent and the like which can be compatible with the ink without exerting adverse effects to the ink. In an ink for a ballpoint pen, fatty acids can suitably be used as the lubricant. Also, non-volatile solvents and the like which are compatible with the main solvent can also be added as an additive for inhibiting drying as long as adverse effects are not exerted in terms of the characteristics of the products.

In the present performing form, the ink 25 is composed of an ink for water based felt tip pens.

A follower (following member) 26 following the ink as it is consumed in writing is provided at a rear part of the ink 25 filled in the refill 11, and a space part 27 which is an air chamber is provided at a rear side of the follower.

The follower (following member) 26 has preferably a low permeability and a low dispersibility against the solvent used for the ink, and non-volatile and hardly volatile fluids, to be specific, polybutene, liquid paraffin, mineral oils, process oils and the like can be used as a base material thereof.

When the above substances have a low viscosity, a thickener and a gelling agent are preferably used. They include, to be specific, metal soaps, bentonites, fatty acid amides, hydrogenated castor oils, metal fine particles containing titanium oxide, silica, alumina and the like, cellulose, elastomers, and the like. In the present performing form, the follower (following member) 26 is composed of a mineral oil and a thickener.

The cap member 30 has a cylindrical main body part 31 which is an installing part detachably mounted at a front end side of the writing instrument main body (holder part) 10, a crown part 32 mounted at an aperture part 31*a* of the above main body part 31, a concave installing part 34 in which a sealing member 33 composed of rubber such as nitrile rubber (NBR), butyl rubber (IIR) and the like, a thermoplastic elastomer, a soft resin and the like for sealing a whole projection part of the pen tip 20 is fitted in an inside of the above crown part 32, and a clip part 35 integrated with the crown part 32 described above.

A whole tip of the pen tip 20 projected from the front holder 16 holding the joint member 15 is sealed by the sealing member 33 by mounting the above cap member 30 at a front end side of the writing instrument main body 10, whereby a direct flow phenomenon from the pen tip 20 is prevented when the ink tank is changed in an internal pressure. The sealing member of the present performing form is composed of butyl rubber (IIR).

In the writing instrument G of the above second embodiment, the inhibiting mechanism 40 for inhibiting a direct flow of the ink and the pressure reducing mechanism 50 for reducing a pressure in an inside of the ink tank 11 in releasing the cap member 30, that is, detaching the cap member 30 from the writing instrument main body 10 in a state in which the ink is filled are provided at a rear part of the writing instrument main body 10.

Also, a tail plug 60 is fixed to an aperture part 10*b* at a rear end side of the writing instrument main body 10. The tail plug 60 has a cover part 62 having a communication hole 61 communicating with the air outside the writing instrument main body, a cylindrical fixing part 63 fixed to the aperture part 10*b* of the writing instrument main body 10 by interlocking, and a rod-like member 64 extending to an ink tank side.

The inhibiting mechanism 40 for inhibiting a direct flow of the ink is provided with a capillary porous member 41 endowed with a capillary force for inhibiting a direct flow of the ink. In the present performing form, the above capillary porous member 41 is of a structure in which it is received in the pressure reducing mechanism 50.

The capillary porous member 41 shall not specifically be restricted as long as it is composed of a porous member endowed with a capillary force, and it includes, for example, those prepared by impregnating porous members selected from fiber feeds obtained by processing fiber bundles, sintered members, felts and the like or subjecting the above fiber bundles to resin processing, and foamed materials such as sponges and the like with liquids such as mineral oils, process oils, silicone oils, ionic oils, and the like.

It is preferably composed of the process oils and the like having a low vapor pressure from the viewpoint of preventing volatilization.

When the ink is discharged from the pen tip 20, air is introduced by the above capillary porous member 41 to thereby make writing possible. When writing is stopped, it becomes possible to maintain a pressure reducing state in an inside of the space 12, and the ink is prevented from directly flowing.

Figure 9:
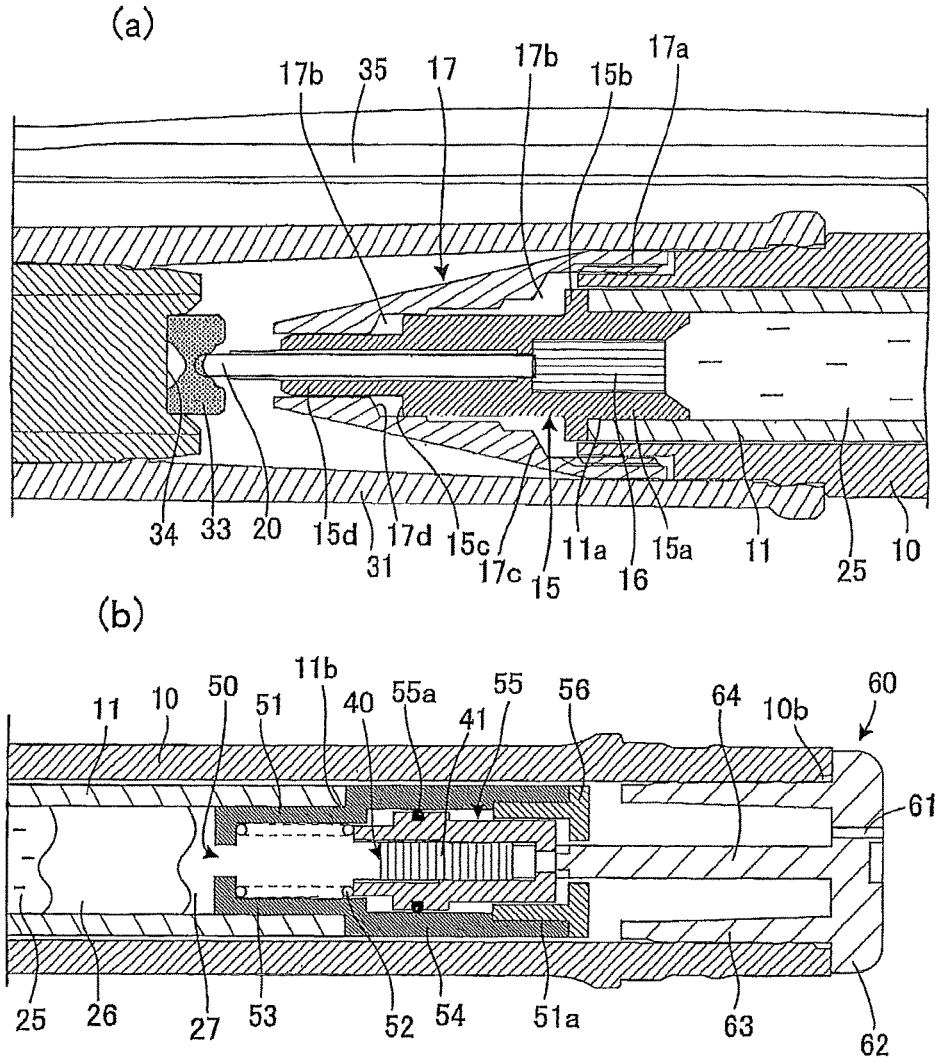
FIGS. 9(*a*) and (*b*) are partially enlarged perspective drawings showing the respective vertical cross-sectional states of the cap member part and a rear end side part of the writing instrument main body each shown in FIG. 1.

The pressure reducing mechanism 50 of the present performing form is provided, as shown in FIG. 9(*b*), with a cylindrical main body part 51 fixed to a rear end aperture part 11*b* of the ink tank 11 having a space part 27 at a rear end side of a follower (following member) 26, a cylindrical receiving member 55 receiving the capillary porous member 41, and a holding member 56 holding the above receiving member 55 and fixed to one aperture part 51*a* of the main body part 51 described above.

The main body part 51 of the pressure reducing mechanism 50 has a first cylindrical part 53 of a small diameter receiving an elastic member 52 comprising a coil form spring, and a second cylindrical part 54 of a large diameter receiving the receiving member 55 described above, and it has a structure in which an end part of the above receiving member 55 at an ink tank side is disposed behind an end side of the elastic member 52 described above and in which an end part of the receiving member 55 at a tail plug side is brought into contact with a tip part of the rod-like member 64 provided in the tail plug 60. Also, an O ring 55*a* is mounted on a periphery of the cylindrical receiving member 55 receiving the capillary porous member 41 to hold airtightly an inside of the second cylindrical part 54.

The O ring 55*a* has to be slid by an elastic force of the elastic member 52 received in the pressure reducing mechanism 50, and further, the refill 11 has to be prevented from going back by a writing load, so that the elastic force has to be higher than the writing load in writing. Further, the cap member has to be prevented from being detached in fitting the cap, and therefore it is set to not lower than a buckling load of the pen feed 20 and not higher than a drawing force of the cap member.

In the present performing form, the writing load is usually about 2N; a drawing force of the cap member is 25N; and a buckling load of the pen feed 20 is 7N.

Figure 11:
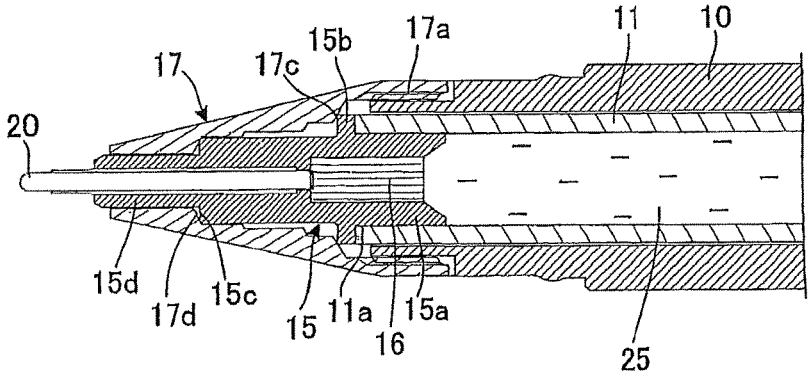
FIGS. 11(*a*) and (*b*) are partially enlarged perspective drawings showing the respective vertical cross-sectional states of the cap member part and a rear end side part of the writing instrument main body each shown in FIG. 3.
Figure 11:
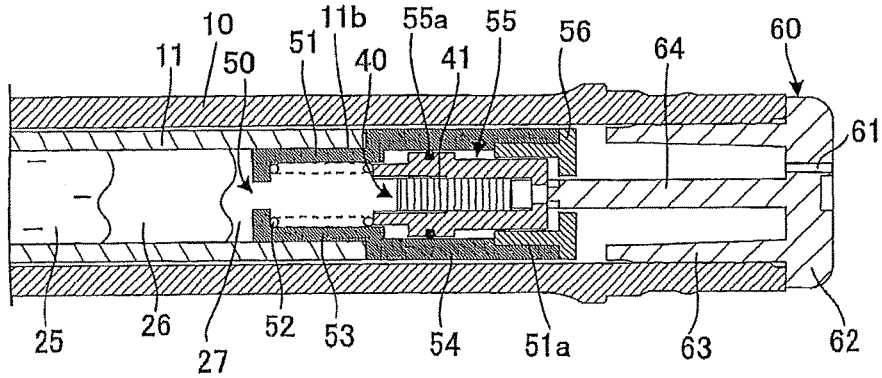

In the writing instrument G of the first performing form in the present second embodiment constituted in the manner described above, an inside of the refill 11 which is an ink tank can be reduced in a pressure in detaching the cap even when an inside of the writing instrument main body 10 is increased in a pressure in storing the writing instrument, and the ink 25 can be prevented from leaking from the pen tip 20 in use. That is, in detaching (releasing) the mounted cap member 30, the whole refill 11 goes forward while it is sealed in a state in which a rear end part of the refill 11 is fixed, whereby the space part 27 of the refill which is an ink tank is expanded in a volume (the space part is increased in a volume). On the other hand, the space part 27 of the refill 11 is decreased in a volume in fitting the cap member 30, but it is structured so that an increased portion of the pressure is discharged through the capillary porous member 41 provided at a rear end part of the refill 11. To describe in detail, when the cap member 30 is inserted as shown in FIG. 9 and FIG. 11, the pen feed 20 strikes to the sealing member 33 and is sealed. When the cap member 30 is further inserted, the refill 11 goes back to cause the pressure reducing mechanism main body 51 to slide without causing the receiving member 55 to move, whereby an inside of the ink tank falls into a pressurizing state. On the other hand, when the cap member 30 is removed, the refill 11 goes forward, and the pressure reducing mechanism main body 51 slides without causing the receiving member 55 to move, so that an inside of the ink tank falls into a pressure reducing state. In such a manner as described above, an inside of the refill 11 which is an ink tank in the writing instrument main body 10 can be forcibly reduced in a pressure even when an inside of the refill 11 is increased in a pressure in storing the writing instrument, and the ink 25 can be prevented from leaking from the pen tip in use.

Also, in usually writing and finishing writing, a flow pressure applied to the pen tip is controlled to a fixed level to prevent an ink direct flow phenomenon•reverse flow phenomenon by the foregoing cycle of the inhibiting mechanism for inhibiting a direct flow of the ink in the capillary porous member 41 provided at a rear end part of the refill 11. That is, since the capillary porous member 41 is provided at a rear end part of the refill 11, the space part 27 between the follower 30 and the capillary porous member 40 is turned to a pressure reducing state by discharging the ink in writing, and when pressure reduction is over a capillary force of the capillary porous member 41, a capillary force of the capillary porous member 41 is broken to cause air (air bubbles) to come in and make it possible to write in a usual manner. On the other hand, when writing is finished, the air bubbles generated above are broken, and the capillary porous member 41 is impregnated with the liquid to restore a capillary force and make it possible to cause the ink to support an own weight.

Further, in the writing instrument G of the first performing form of the present second embodiment, a whole projection part of the pen feed is sealed by the sealing member 33 in fitting the cap member 30, and therefore a direct flow phenomenon of the ink from the pen tip 20 is prevented even when an internal pressure of the ink tank is varied by heating and the like.

Next, FIG. 12 to FIG. 15 show another examples (a second performing form to a fifth performing form) of the writing instruments of the second embodiment in the present invention. It should be noted that in FIG. 12 to FIG. 15, the same structures as those of the first embodiment (FIG. 8 to FIG. 11) of the second embodiment described above shall be shown by the same marks to omit the explanations thereof.

Figure 12:
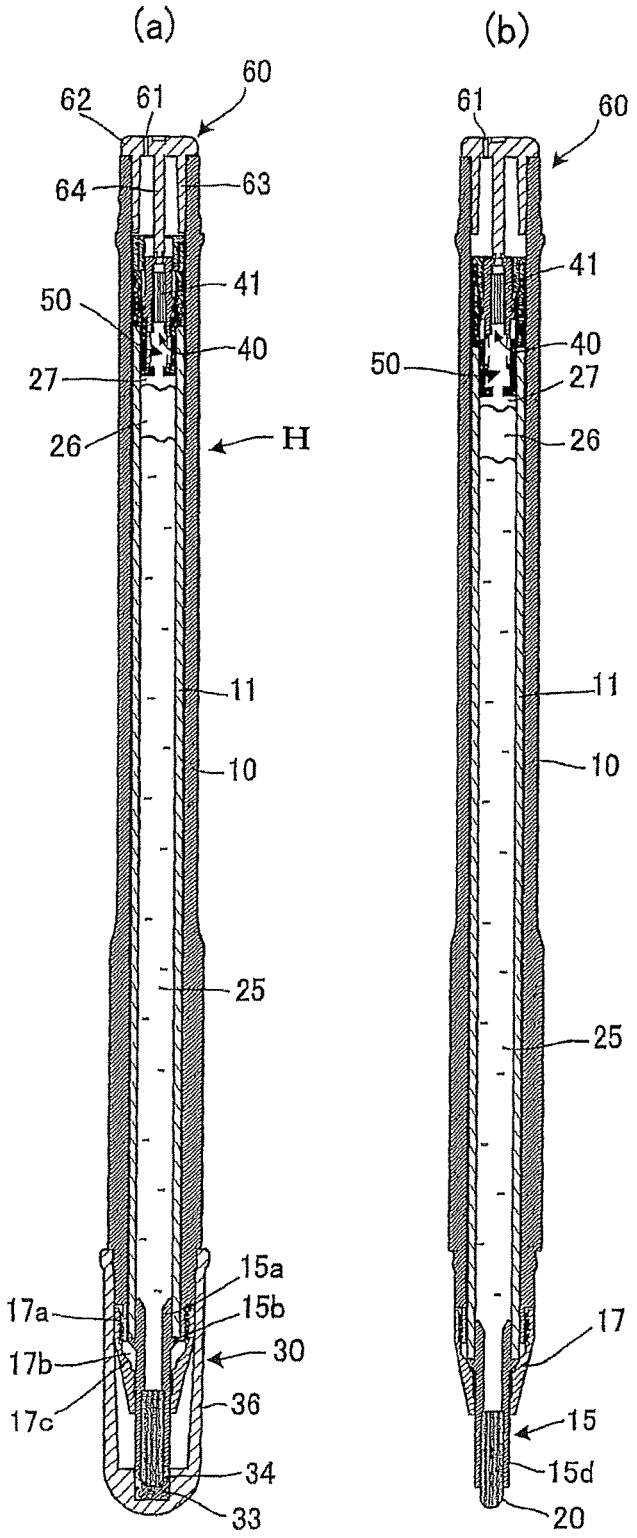
FIG. 12 is a writing instrument showing another example of a performing form in the second embodiment of the present invention, wherein (a) is a vertical cross section showing a state in which a cap member is mounted; and (b) is a vertical cross section showing a state in which the cap member is detached.

FIG. 12 is a writing instrument showing the second performing form of the second embodiment in the present invention, wherein (a) is a vertical cross section showing a state in which a cap member is mounted; and (b) is a vertical cross section showing a state in which the cap member is detached.

The writing instrument H according to the above second performing form is different from the writing instrument G of the performing form described above in terms of exchanging the plastic feed 20 in which ink grooves are formed in a holder direction on various plastic materials in the writing instrument G of the first performing form described above for a pen feed which is a writing part composed of a fiber feed obtained by processing fiber bundles or subjecting the fiber bundles to resin processing, or a sintered feed (porous member) obtained by sintering various plastic powders, in the present performing form, a pen feed composed of a fiber bundle feed comprising polyethylene terephthalate (PET) fibers, omitting the feed 16, exchanging the step part formed in the front holder 17 which is a moving end point when the refill 11 moves forward for an inclined step part 17*e*, and providing the cap member 30 with such a simple constitution that a bottomed cylindrical main body part 36 which is a fitting part detachably mounted to a front end side of the writing instrument main body (holder part) 10 is provided and that a concave mounting part 34 in which mounted is a sealing member 33 composed of rubber such as BR, SBR and the like, a thermoplastic elastomer, a soft resin or the like for sealing a whole projection part of the pen feed 20 is provided in an inside of the above main body part 36.

According to the writing instrument H of the present performing form, it acts in the same manner as the writing instrument G of the performing form described above. In detaching the cap member 30, the whole refill 11 goes forward while it is sealed in a state in which a rear end part of the refill 11 is fixed, whereby the space part of the refill 11 which is an ink tank is expanded in a volume, and the refill 11 is decreased in a volume in fitting the cap member 30, but it is structured so that an increased portion of the pressure is discharged through the capillary porous member 41 which is a head valve provided at a rear end part of the refill 11. Accordingly, an inside of the refill 11 can be reduced in a pressure in detaching the cap member 30, and the ink can be prevented from leaking from the pen tip 20 in use. In addition thereto, in usually writing, a flow pressure applied to the pen tip is controlled to a fixed level by the action of the capillary porous member 41 to prevent an ink direct flow phenomenon•reverse flow phenomenon.

Figure 13:
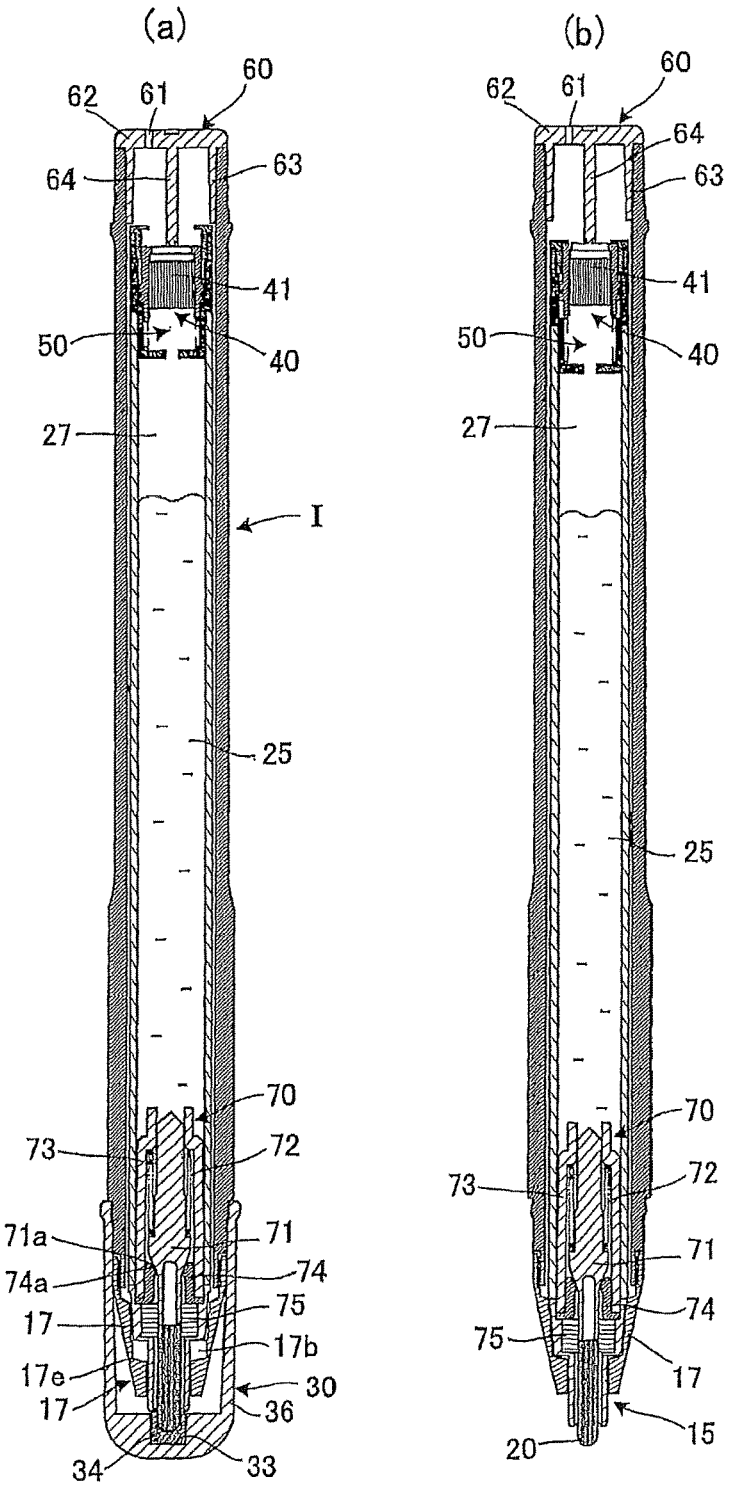
FIG. 13 is a writing instrument showing another example of a performing form in the second embodiment of the present invention, wherein (a) is a vertical cross section showing a state in which a cap member is mounted; and (b) is a vertical cross section showing a state in which the cap member is detached.

FIG. 13 is a writing instrument showing the third performing form in the second embodiment of the present invention.

In the writing instrument I according to the third performing form, a pen feed which is a writing part composed of a fiber feed obtained by processing fiber bundles or subjecting the fiber bundles to resin processing, or a sintered feed (porous member) obtained by sintering various plastic powders is used for the pen tip, as shown in FIGS. 13(*a*) and (*b*), in place of the plastic feed 20 in which ink grooves are formed in a holder direction on various plastic materials in the writing instrument G of the first performing form described above. A pen feed composed of a fiber bundle feed comprising polyethylene terephthalate (PET) fibers is used in the present performing form. The writing instrument I is different from the writing instrument G of the performing form described above in terms of omitting the feed 16 to supply the ink 25 by a valve member 70 in a mechanism of supplying the ink 25 from the refill to the pen feed 20, exchanging the step part formed in the front holder 17 which is a moving end point when the refill 11 moves forward for an inclined step part 17*e*, omitting the follower (following member) 26 which follows as the ink is consumed in writing, and exchanging the cap member 30 for the cap member of the second performing form described above.

The valve member 70 described above is provided with a valve rod 71 which is brought into contact with a rear end part of the pen feed 20 and which can go back in conjunction with going back of the above pen feed, a spring member 72 pressing the above valve rod 71 to a direction of the pen feed 20, a main body part 73 receiving these valve rod 71 and spring member 72, and a valve seat member 74 closing and opening a passage of an ink from the refill 11 to the pen feed 20. The valve rod 71 goes back by pressing the pen feed 20 to cause a valve member 71*a* formed in the valve rod 71 to separate from a valve seat 74*a* of the valve seat member 74, and the ink 25 in the refill 11 is supplied to the pen feed 20. Also, a mark 75 is a temporary storing part composed of a porous member such as a sponge and the like which is provided at a rear end side of the pen feed 20.

According to the writing instrument I of the present performing form, the effects of the present invention can be exerted as is the case with the writing instruments G and H of the performing forms described above.

Figure 14:
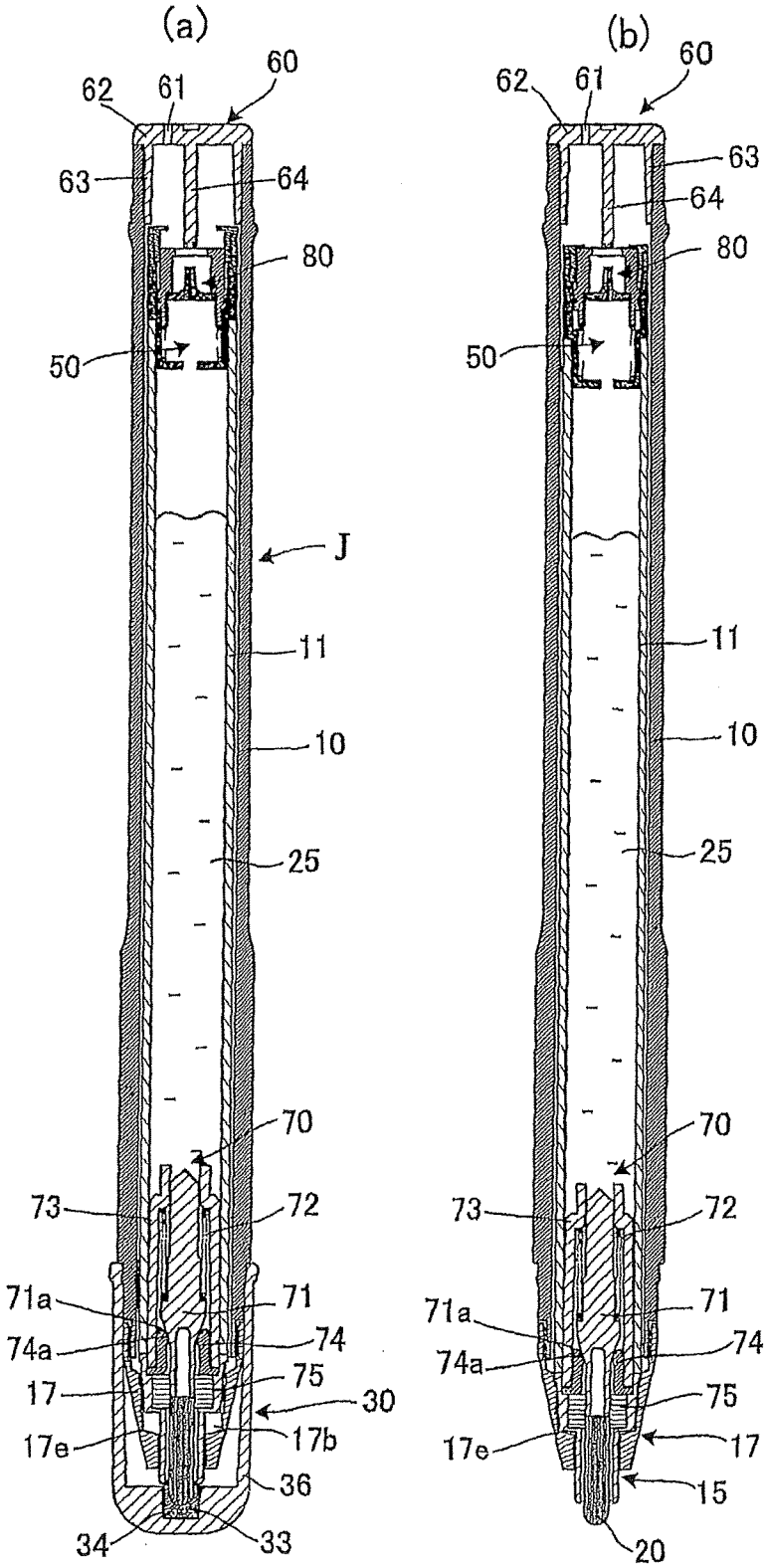
FIG. 14 is a writing instrument showing another example of a performing form in the second embodiment of the present invention, and (a) is a vertical cross section showing a state in which a cap member is mounted; and (b) is a vertical cross section showing a state in which the cap member is detached.

FIG. 14 is a writing instrument showing the fourth performing form in the second embodiment of the present invention.

The writing instrument J according to the fourth performing form is different, as shown in FIGS. 14(*a*) and (*b*), from the writing instrument G of the third performing form described above in terms of constituting a capillary porous member 41 provided with a capillary force which is an inhibiting mechanism for inhibiting a direct flow of an ink by a check valve 80 comprising a flexible member which acts in the same manner as the above capillary porous member 41 in the writing instrument G of the first performing form described above.

The above check valve 80 can release an internal pressure in a case where the cap is fitted and where the refill goes back, and it can reduce the internal pressure when the cap is detached.

According to the writing instrument J of the present performing form, the effects of the present invention can be exerted as is the case with the writing instruments G to I of the performing forms described above.

Figure 15:
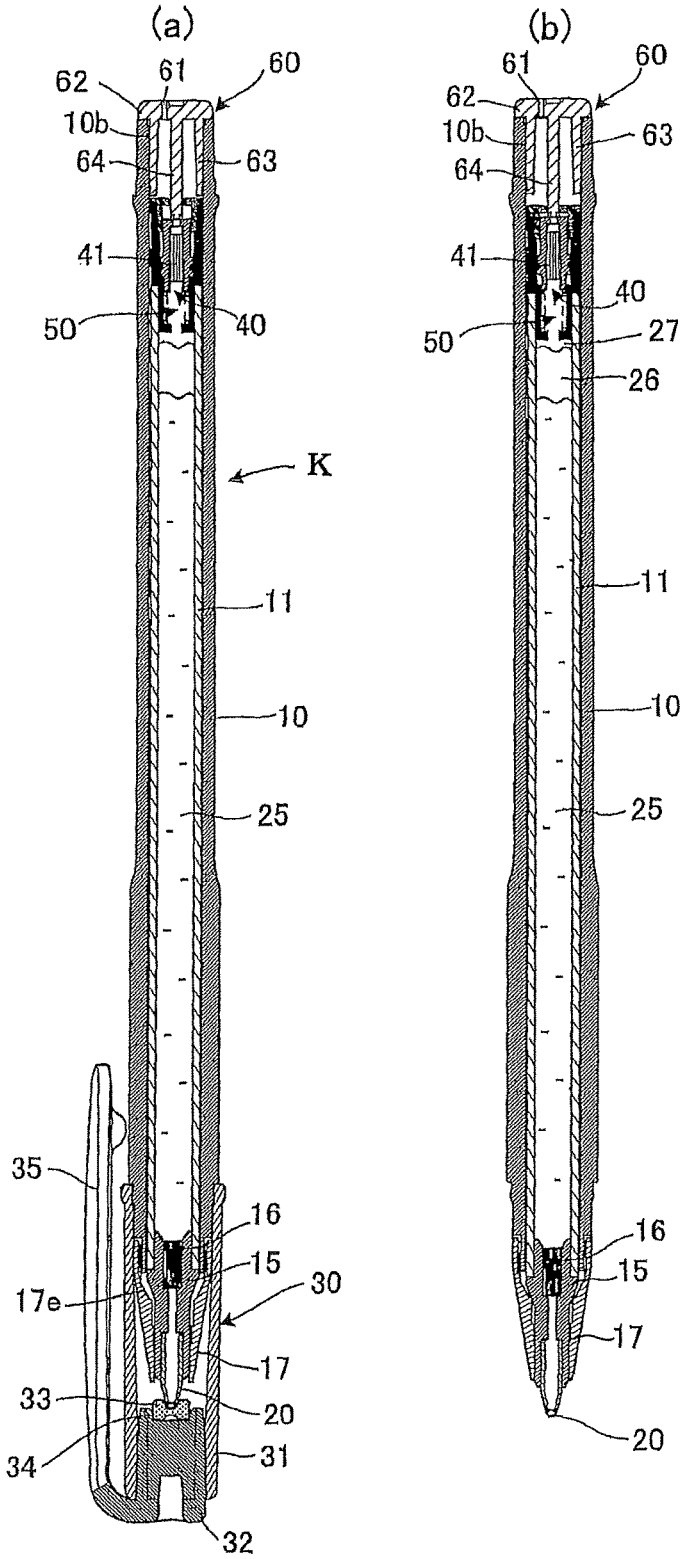
FIG. 15 is a writing instrument showing another example of a performing form in the second embodiment of the present invention, wherein (a) is a vertical cross section showing a state in which a cap member is mounted; and (b) is a vertical cross section showing a state in which the cap member is detached.

FIG. 15 is a writing instrument applied to a ballpoint pen showing the fifth performing form in the second embodiment of the present invention.

The writing instrument K according to the fifth performing form is different, as shown in FIGS. 15(*a*) and (*b*), from the writing instrument A of the performing form described above in terms of exchanging the plastic feed 20 in which ink grooves are formed in a holder direction on various plastic materials in the writing instrument G of the first performing form described above for a pen feed which is a writing part composed of a ballpoint pen tip having a writing ball, and exchanging the step part formed in the front holder 17 which is a moving end point when the refill 11 moves forward for an inclined step part 17*e*.

According to the writing instrument K applied to the ballpoint pen of the present performing form, the effects of the present invention can be exerted as is the case with the writing instruments G to J of the performing forms in the second embodiment described above.

The writing instruments showing the performing forms of the third embodiment in the present invention are shown in FIG. 16 to FIG. 32.

The writing instruments of the third embodiment relate to writing instruments suited to ballpoint pens, marking pens and the like in which a flow pressure applied to a pen tip is controlled to a fixed level to prevent an ink direct flow phenomenon•reverse flow phenomenon and in which an inside of an ink tank can be reduced in a pressure in releasing a cap to prevent the ink from leaking from the pen tip in use even if an inside of the ink tank receiving the ink is increased in a pressure in storing the writing instrument.

The constitution of the writing instrument of the above third embodiment includes the following constitutions of (1) to (3).

(1) A writing instrument in which an inhibiting mechanism for inhibiting a direct flow of an ink filled in an ink tank is provided at a rear part of a writing instrument main body, wherein a pen tip and a cap member sealing the above pen tip are mounted at a front part of the writing instrument main body, and a flexible pressure reducing mechanism for reducing a pressure in an inside of the ink tank in detaching the cap member is provided at a rear part of the writing instrument main body.

(2) The writing instrument as described in the above item (1), wherein a refill which is the ink tank provided in an inside of the writing instrument main body moves forward in releasing the cap member.

(3) A writing instrument of a knock system in which an inhibiting mechanism for inhibiting a direct flow of an ink filled in an ink tank is provided at a rear part of a writing instrument main body, wherein a pen tip is mounted at a front part of the writing instrument main body, and a flexible pressure reducing mechanism for reducing a pressure in an inside of the ink tank in carrying out knock operation is provided at a rear part of the writing instrument main body.

According to the writing instrument of the above third embodiment, provided is a writing instrument suited to ballpoint pens of a cap system, marking pens, ballpoint pens of a knock system, and the like in which a flow pressure applied to a pen tip is controlled to a fixed level to prevent an ink direct flow phenomenon•reverse flow phenomenon and in which an inside of an ink tank can be reduced in a pressure in detaching a cap or carrying out knock operation to prevent the ink from leaking from the pen tip in use even if an inside of the writing instrument main body is increased in a pressure in storing the writing instrument.

The performing forms of the third embodiment in the present invention shall be explained below in detail with reference to the drawings (FIG. 16 to FIG. 32).

FIG. 16 to FIG. 19 are the respective drawings of the writing instrument showing one example (first performing form) of the performing forms in the third embodiment of the present invention.

Figure 16:
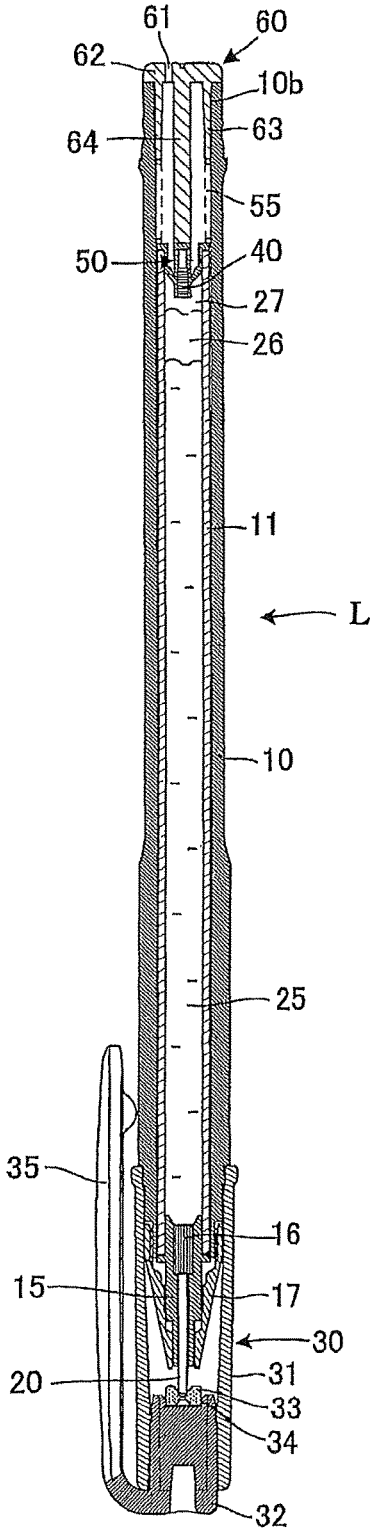
FIG. 16 is a writing instrument showing one example of a performing form in the third embodiment of the present invention, wherein it is a vertical cross section showing a state in which a cap member is mounted.
Figure 18:
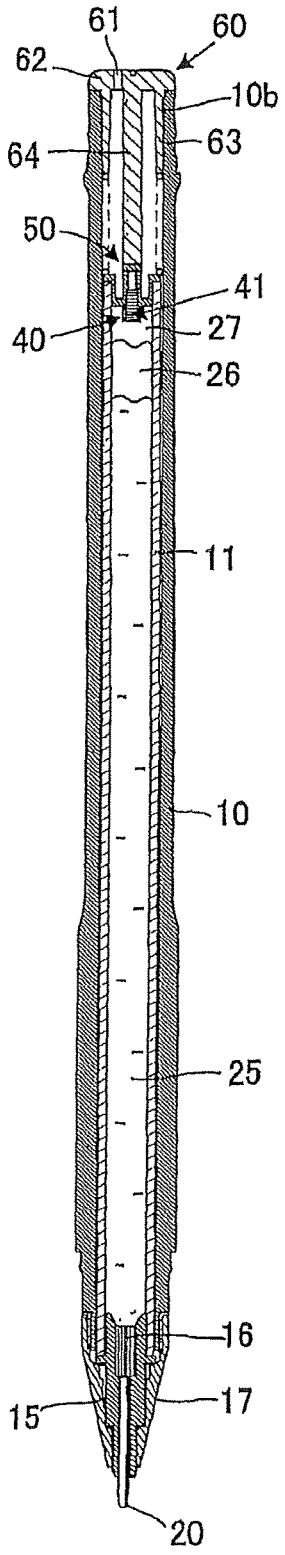
FIG. 18 is a vertical cross section showing a state in which the cap member is detached from the writing instrument shown in FIG. 16.

The writing instrument L of the present performing form is, as shown in FIG. 16 and FIG. 18, loaded with a pen tip 20 and a cap member 30 for sealing the above pen tip 20 at a front part of a writing instrument main body 10 which is a holder part and contains an ink 25 filled in a refill 11 which is an ink tank provided in an inside of the writing instrument main body 10, and an inhibiting mechanism 40 for inhibiting a direct flow of the ink and a flexible pressure reducing mechanism 50 for reducing a pressure in an inside of the refill 11 which is the ink tank in detaching the cap member 30 in a state in which the ink is filled are provided at a rear part of the writing instrument main body 10 described above.

The writing instrument main body 10 is a holder part and can be composed by using resins, metals and the like, and it is molded in a cylindrical form by using an acrylonitrile styrene (AS) resin in the present performing form.

The above writing instrument main body 10 is provided in an inside with the refill 11 receiving the ink 25, and it has, as described later, a structure in which the refill 11 moves forward in an inside of the writing instrument main body 10 in detaching the cap member 30.

The refill 11 is preferably one which is not adversely affected with the passage of time by raw materials contained in the ink received therein. It can be formed by using materials including, for example, resins such as polypropylene (PP), polyethylene naphthalate (PEN), polyethylene terephthalate (PET), polyethylene (PE) and the like, and metals such as aluminum and the like. In the present performing form, the refill 11 which is the ink tank is molded in a cylindrical form by using polypropylene (PP).

The pen tip 20 is composed of a pen feed as a writing part composed of a plastic feed in which ink grooves are formed in a holder direction on various plastic materials.

The above pen feed 20 has a structure in which it is fixed by a cylindrical joint member 15 mounted in a tip aperture part 11*a* of the refill 11. The joint member 15 is composed of a cylindrical fixing part 15*a* fixed to the tip aperture part 11*a* of the refill 11 by interlocking and the like, a flange part 15*b* which is a cover part, and a holding part 15*d* having a step part 15*c* holding the pen feed 20. A feed 16 comprising a porous member is held in the cylindrical fixing part 15*a*, and it is constituted so that the ink 25 filled in the refill which is the ink tank is supplied via the feed 16 comprising the porous member described above to the pen feed 20 which is a writing part composed of a plastic feed.

The refill 11 in which the pen feed 20 is fixed at a tip by the joint member 15 is received in the writing instrument main body 10 so that it can slide. The above joint member 15 of the refill 11 is held by a front holder 17 mounted to a tip aperture part of the writing instrument main body 10 by interlocking and the like.

In the front holder 17, a mounting part 17*a* mounted to a tip aperture part of the writing instrument main body 10 by interlocking and the like and a movable space part 17*b* in which the joint member 15 can move forward when the refill 11 moves forward in an inside of the writing instrument main body 10 in detaching the cap member 30 are formed, as described later, in an inside thereof, and step parts 17*c*, 17*d* which are moving end points when the refill 11 moves forward are provided on an inner peripheral surface of the front holder 17 provided with the above movable space part 17*b*. The flange part 15*b* and the step part 15*c* of the joint member 15 are brought into contact with the step parts 17*c*, 17*d* provided in the front holder 17 to stop the refill 11 moving forward.

The ink 25 received in the refill 11 which is the ink tank shall not specifically be restricted and includes a water based ink, an oil based ink, a gel ink and the like. A pigment (including a resin pigment), a colorant such as a dye and the like, a main solvent, a resin, a thickener, and optional components added to inks for writing instruments can be used as the components of the ink according to the uses thereof (a water based ink, an oil based ink, a gel ink and the like) and the kind of the writing instrument (a marking pen, a ballpoint pen and the like).

Capable of being contained as the optional components are, for example, a rust preventive, an anti-mold agent, a surfactant, a lubricant, a wetting agent and the like which can be compatible with the ink without exerting adverse effects to the ink. In an ink for a ballpoint pen, fatty acids and the like can suitably be used as the lubricant. Also, non-volatile solvents and the like which are compatible with the main solvent can also be added as an additive for inhibiting drying as long as adverse effects are not exerted in terms of the characteristics of the products.

In the present performing form, the ink 25 is composed of an ink for water based felt tip pens.

A follower (following member) 26 following the ink as it is consumed in writing is provided at a rear part of the ink 25 filled in the refill 11, and a space part 27 which is an air chamber is provided at a rear side of the follower.

The follower (following member) 26 has preferably a low permeability and a low dispersibility against the solvent used, and non-volatile and hardly volatile fluids, to be specific, polybutene, liquid paraffins, mineral oils, process oils and the like can be used as a base material thereof.

When the above substances have a low viscosity, a thickener and a gelling agent are preferably used. They include, to be specific, metal soaps, bentonites, fatty acid amides, hydrogenated castor oils, metal fine particles containing titanium oxide, alumina and the like, celluloses, elastomers, and the like. In the present performing form, the follower (following member) 26 is composed of a mineral oil and a thickener.

The cap member 30 has a cylindrical main body part 31 which is an installing part detachably mounted at a front end side of the writing instrument main body (holder part) 10, a crown part 32 mounted at an aperture part 31*a* of the above main body part 31, a concave installing part 34 in which a sealing member 33 composed of rubber such as nitrile rubber (NBR), butyl rubber (IIR) and the like, a thermoplastic elastomer, a soft resin and the like for sealing a whole projection part of the pen tip 20 is fitted in an inside of the above crown part 32, and a clip part 35 integrated with the crown part 32 described above.

A whole tip of the pen tip 20 projected from the front holder 16 holding the joint member 15 is sealed by the sealing member 33 by fitting the above cap member 30 at a front end side of the writing instrument main body 10, whereby a direct flow phenomenon from the pen tip 20 is prevented when the ink tank is changed in an internal pressure. The sealing member of the present performing form is composed of butyl rubber (IIR).

In the above writing instrument L, the inhibiting mechanism 40 for inhibiting a direct flow of the ink and the flexible pressure reducing mechanism 50 for reducing a pressure in an inside of the ink tank 11 in releasing the cap member 30, that is, detaching the cap member 30 from the writing instrument main body 10 in a state in which the ink is filled are provided at a rear part of the writing instrument main body 10.

Also, a tail plug 60 is fixed to an aperture part 10*b* at a rear end side of the writing instrument main body 10. The tail plug 60 has a cover part 62 having a communication hole 62 communicating with the air outside the writing instrument main body, a cylindrical fixing part 63 fixed to the aperture part 10*b* of the writing instrument main body 10 by interlocking, and a rod-like member 64 extending to an ink tank side.

The inhibiting mechanism 40 for inhibiting a direct flow of the ink is provided with a capillary porous member 41 endowed with a capillary force for inhibiting a direct flow of an ink. In the present performing form, the above capillary porous member 41 is of a structure in which it is received in the pressure reducing mechanism 50.

The capillary porous member 41 shall not specifically be restricted as long as it is composed of a porous member endowed with a capillary force, and it includes, for example, those prepared by impregnating porous members selected from fiber feeds obtained by processing fiber bundles, sintered members, felts and the like or subjecting the above fiber bundles to resin processing, and foamed materials such as sponges and the like with liquids such as mineral oils, process oils, silicone oils, ionic oils, and the like.

It is preferably composed of the process oils and the like having a low vapor pressure from the viewpoint of preventing volatilization.

When the ink is discharged, air is introduced by the above capillary porous member 41 to thereby make writing possible. When writing is stopped, it becomes possible to maintain a pressure reducing state of the space 27, and the ink is prevented from directly flowing.

The flexible pressure reducing mechanism 50 of the present performing form is provided with a main body part 51 fixed to a rear end aperture part 11*b* of the ink tank 11 having the space part 27 at a rear end side of the follower (following member) 26, a cylindrical receiving member 52 receiving the capillary porous member 41, a connecting part 53 connecting the above main body part 51 and the receiving member 52, and a communicating hole 54 formed at an upper part of the receiving member 52, and it can be formed by integral molding and the like using rubber, a thermoplastic elastomer, a soft resin and the like.

An elastic member 55 comprising a coil-like spring for pressing to a pen tip 20 side, the refill 11 to which the above flexible pressure reducing mechanism 50 is fixed is of a constitution in which it is interposed between a fixing part 63 of the tail plug 60 and the main body part 51 to reduce a pressure in an inside of the refill 11 which is the ink tank in detaching the cap member 60.

An elastic force of the elastic member 55 received in the pressure reducing mechanism 50 has to be a larger load than a writing pressure since the refill has to be prevented from going back by a writing pressure in writing. Further, the cap member 30 has to be prevented from being detached in fitting the cap, and therefore it is set to not lower than a buckling load of the pen feed 20 and not higher than a drawing force of the cap member.

In the present performing form, the writing load is usually about 2N; a drawing force of the cap member is 25N; and a buckling load of the pen feed 20 is 7N.

Figure 17:
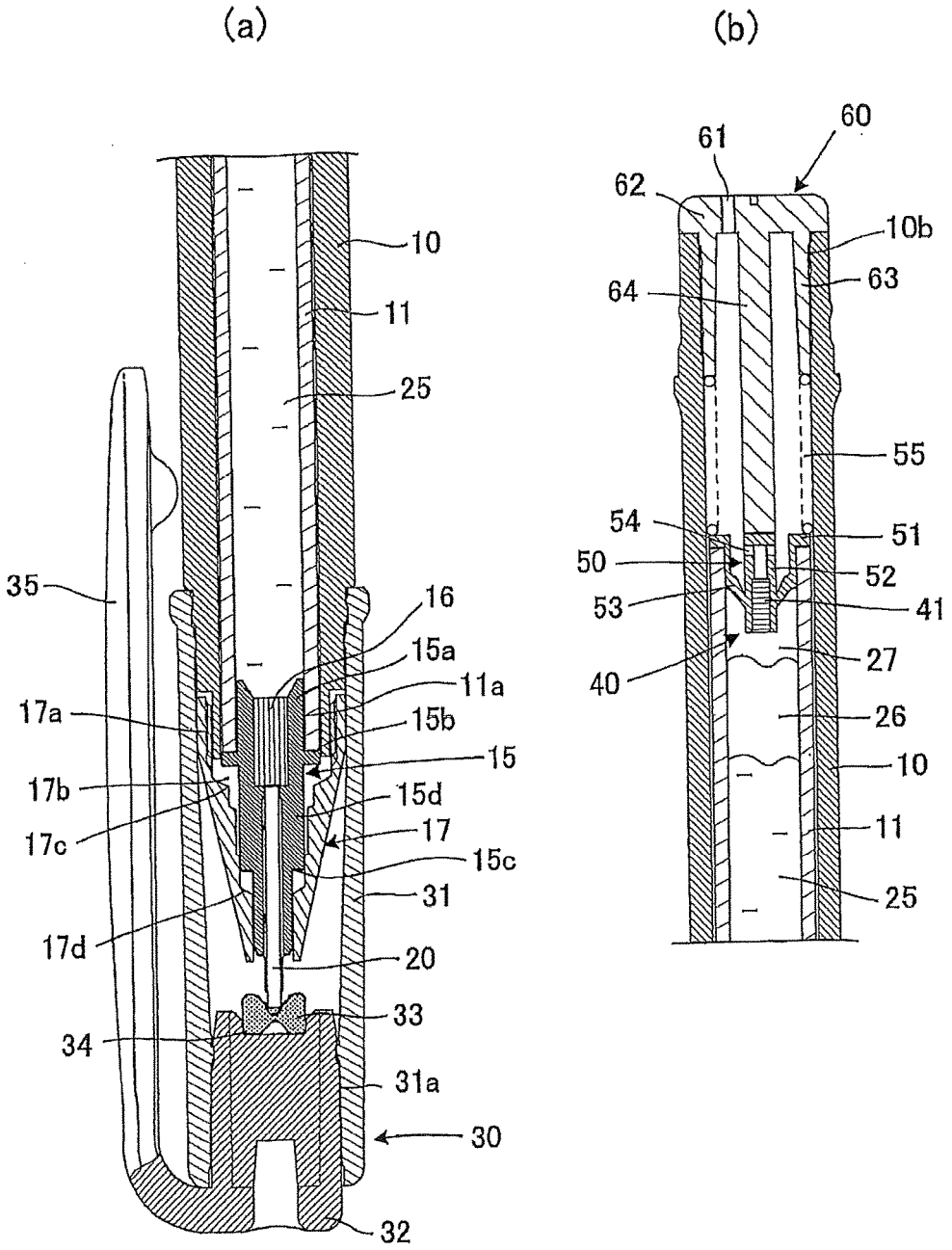
FIGS. 17(*a*) and (*b*) are partially enlarged perspective drawings showing the respective vertical cross-sectional states of the cap member part and a rear end side part of the writing instrument main body each shown in FIG. 16.
Figure 19:
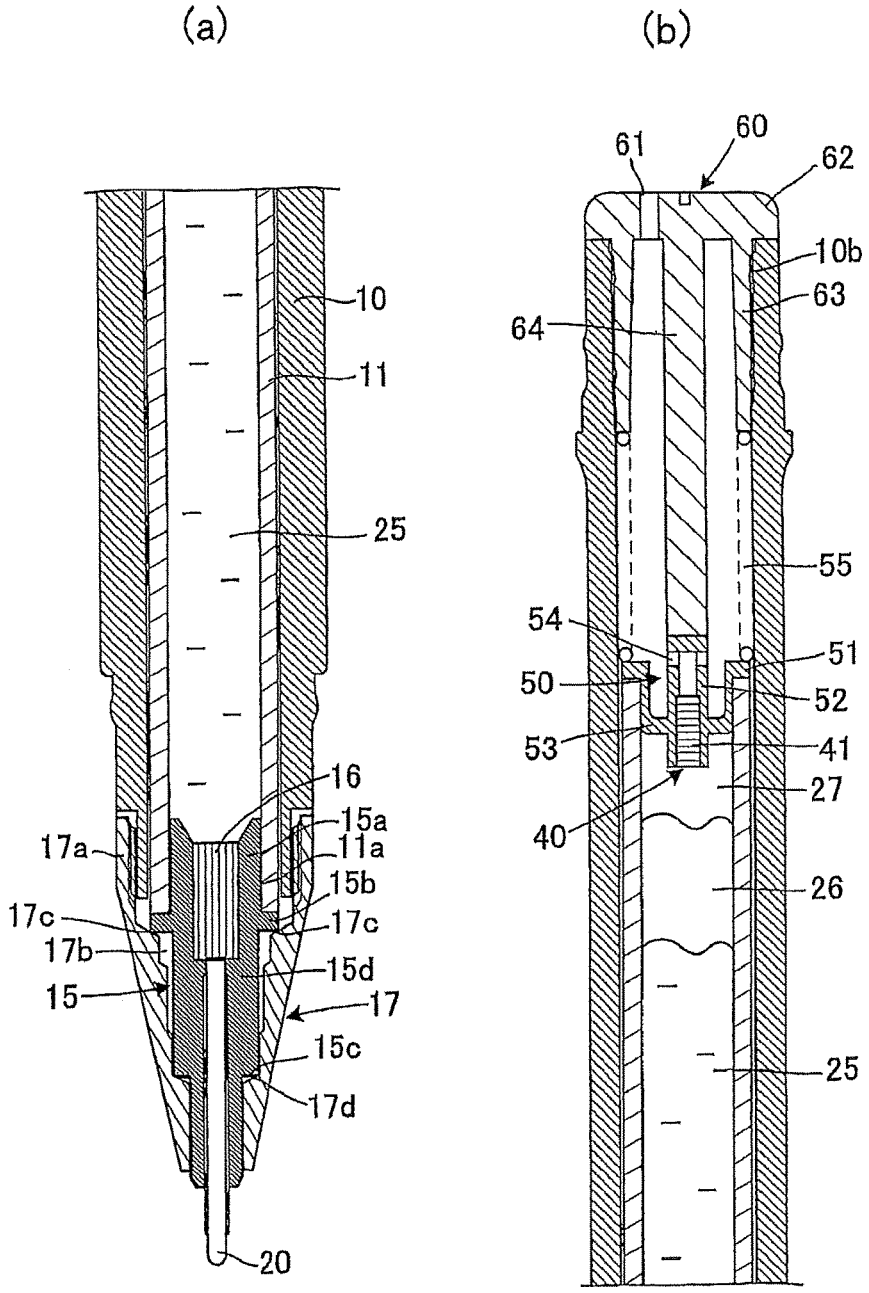
FIGS. 19(*a*) and (*b*) are partially enlarged perspective drawings showing the respective vertical cross-sectional states of the cap member part and a rear end side part of the writing instrument main body each shown in FIG. 18.

In the writing instrument L of the first performing form in the third embodiment constituted in the manner described above, an inside of the refill which is the ink tank can be reduced in a pressure in detaching the cap even when an inside of the writing instrument main body 10 is increased in a pressure in storing the writing instrument, and the ink can be prevented from leaking from the pen tip in use. That is, in detaching (releasing) the mounted cap member 30, the whole refill 11 goes forward while it is sealed in a state in which a rear end part of the refill 11 is fixed, whereby the space part 27 of the refill which is the ink tank is expanded in a volume (the space part is increased in a volume). On the other hand, while the space part 27 of the refill 11 is decreased in a volume in fitting the cap member, it is structured so that an increased portion of the pressure is discharged through the capillary porous member 41 provided at a rear end part of the refill 11. To describe in detail, when the cap member 30 is inserted as shown in FIG. 17 and FIG. 19, the pen feed 20 strikes to the sealing member 33 and is sealed. When the cap member 30 is further inserted, the refill 11 goes back, and the flexible pressure reducing mechanism 50 is pushed into the refill 11, whereby an inside of the refill 11 falls into a pressurizing state. However, a pressure amount which is not lower than a capillary force of the capillary member can not be held, and therefore the pressure is discharged. On the other hand, when the cap member 30 is removed, the refill 11 goes forward, and the flexible pressure reducing member 50 returns to the initial state, so that an inside of the refill 11 is expanded in a volume to thereby fall into a pressure reducing state. In such a manner as described above, an inside of the refill 11 which is the ink tank in the writing instrument main body 10 can be forcibly reduced in a pressure even when an inside of the refill 11 is increased in a pressure in storing the writing instrument, and the ink can be prevented from leaking from the pen tip in use.

Also, in usually writing and finishing writing, a flow pressure applied to the pen tip is controlled to a fixed level to prevent an ink direct flow phenomenon•reverse flow phenomenon by the cycle of the inhibiting mechanism for inhibiting a direct flow of the ink in the capillary porous member 41 provided at a rear end part of the refill 11. That is, since the capillary porous member 41 is provided at a rear end part of the refill 11, the space part 27 between the follower 30 and the capillary porous member 40 is turned to a pressure reducing state by discharging the ink in writing, and when pressure reduction is over a capillary force of the capillary porous member 41, a capillary force of the capillary porous member 41 is broken to cause air (air bubbles) to come in and make it possible to write in a usual manner. On the other hand, when writing is finished, the air bubbles generated above are broken, and the capillary porous member 41 is impregnated with the liquid to restore a capillary force and make it possible to cause the ink to support an own weight.

Further, in the writing instrument L of the first performing form of the present third embodiment, a whole projection part of the pen feed 20 is sealed by the sealing member 33 in fitting the cap member 30, and therefore a direct flow phenomenon of the ink from the pen tip 20 is prevented even when an internal pressure of the ink tank is varied by heating and the like.

Next, FIG. 20 to FIG. 32 show another examples (a second performing form to a seventh performing form) of the writing instruments of the third embodiment in the present invention. It should be noted that in FIG. 20 to FIG. 32, the same structures as those of the first embodiment (FIG. 16 to FIG. 19) of the third embodiment described above shall be shown by the same marks to omit the explanations thereof.

Figure 20:
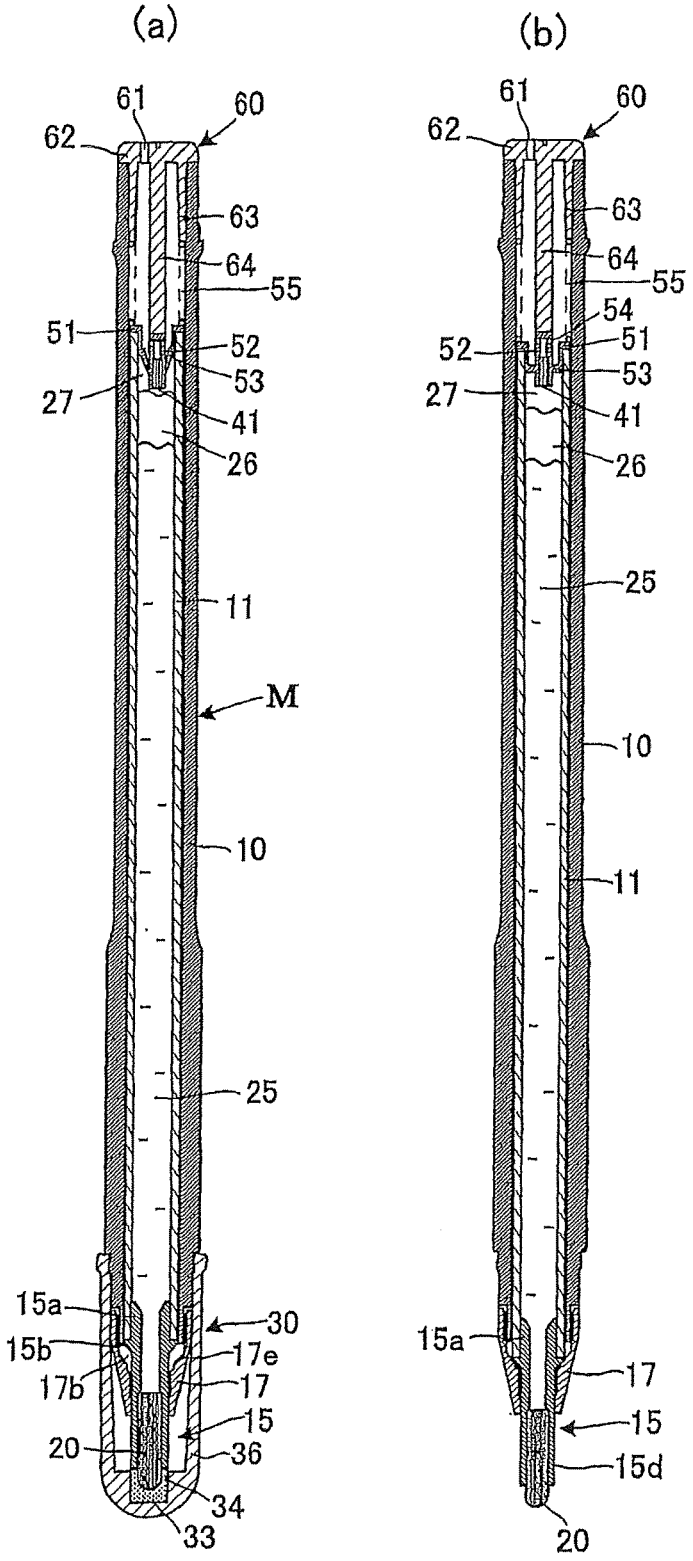
FIG. 20 is a writing instrument showing another example of a performing form in the third embodiment of the present invention, wherein (a) is a vertical cross section showing a state in which a cap member is mounted; and (b) is a vertical cross section showing a state in which the cap member is detached.

FIG. 20 is a writing instrument showing the second performing form in the third embodiment of the present invention, wherein (a) is a vertical cross section showing a state in which a cap member is mounted; and (b) is a vertical cross section showing a state in which the cap member is detached.

The writing instrument M according to the second performing form is different from the writing instrument L of the performing form described above in terms of exchanging the plastic feed 20 in which ink grooves are formed in a holder direction on various plastic materials in the writing instrument L of the first performing form described above for a pen feed which is a writing part composed of a fiber feed obtained by processing fiber bundles or subjecting the fiber bundles to resin processing, or a sintered feed (porous member) obtained by sintering various plastic powders, in the present performing form, a pen feed composed of a fiber bundle feed comprising polyethylene terephthalate (PET) fibers, omitting the feed 16, exchanging the step part formed in the front holder 17 which is a moving end point when the refill 11 moves forward for an inclined step part 17*e*, and providing the cap member 30 with such a simple constitution that a bottomed cylindrical main body part 36 which is a fitting part detachably mounted to a front end side of the writing instrument main body (holder part) 10 is provided and that a concave mounting part 34 in which mounted is a sealing member 33 composed of rubber such as BR, SBR and the like, a thermoplastic elastomer, a soft resin and the like for sealing a whole projection part of the pen feed is provided in an inside of the above main body part 36.

According to the writing instrument M of the present performing form, it acts in the same manner as the writing instrument L of the performing form described above. In detaching the cap member 30, the whole refill 11 goes forward while it is sealed in a state in which a rear end part of the refill 11 is fixed, whereby the space part 27 of the refill 11 which is an ink tank is expanded in a volume, and the refill 11 is decreased in a volume in fitting the cap member 30, but it is structured so that an increased portion of the pressure is discharged through the capillary porous member 41 which is a head valve provided at a rear end part of the refill 11. Accordingly, an inside of the refill 11 can be reduced in a pressure in detaching the cap member 30, and the ink can be prevented from leaking from the pen tip 20 in use. In addition thereto, in usually writing, a flow pressure applied to the pen tip is controlled to a fixed level by the action of the capillary porous member 41 to prevent an ink direct flow phenomenon•reverse flow phenomenon.

Figure 21:
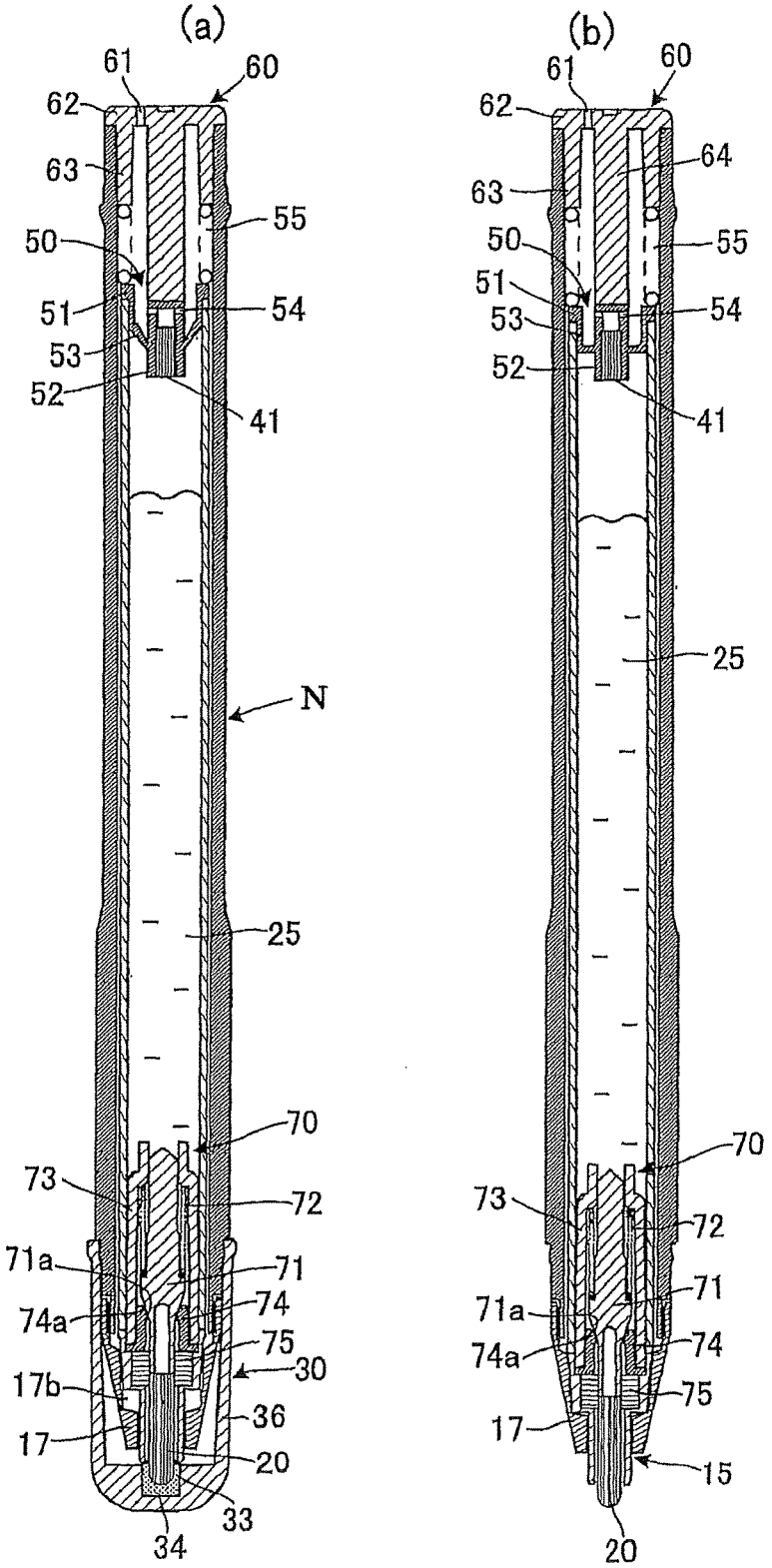
FIG. 21 is a writing instrument showing another example of a performing form in the third embodiment of the present invention, wherein (a) is a vertical cross section showing a state in which a cap member is mounted; and (b) is a vertical cross section showing a state in which the cap member is detached.

FIG. 21 is a writing instrument showing the third performing form in the third embodiment of the present invention.

In the writing instrument N according to the third performing form, a pen feed which is a writing part composed of a fiber feed obtained by processing fiber bundles or subjecting the fiber bundles to resin processing, or a sintered feed (porous member) obtained by sintering various plastic powders is used for the pen tip, as shown in FIGS. 21 (*a*) and (*b*), in place of the plastic feed 20 in which ink grooves are formed in a holder direction on various plastic materials in the writing instrument L of the first performing form described above. A pen feed composed of a fiber bundle feed comprising polyethylene terephthalate (PET) fibers is used in the present performing form. The writing instrument N is different from the writing instrument L of the performing form described above in terms of omitting the feed 16 to supply the ink 25 by a valve member 70 in a mechanism of supplying the ink from the refill 11 to the pen feed 20, exchanging the step part formed in the front holder 17 which is a moving end point when the refill 11 moves forward for an inclined step part 17*e*, omitting the follower (following member) 26 which follows as the ink is consumed in writing, and exchanging the cap member 30 for the cap member of the second performing form described above.

The valve member 70 described above is provided with a valve rod 71 which is brought into contact with a rear end part of the pen feed 20 and which can go back in conjunction with going back of the above pen feed, a spring member 72 pressing the valve rod 71 to a direction of the pen feed 20, a main part 73 receiving these valve rod 71 and spring member 72, and a valve seat member 74 closing and opening a passage of an ink from the refill 11 to the pen feed 20. The valve rod 71 goes back by pressing the pen feed 20 to cause a valve member 71*a* formed in the valve rod 71 to separate from a valve seat 74*a* of the valve seat member 74, and the ink 25 in the refill 11 is supplied to the pen feed 20. Also, A mark 75 is a temporary storing part composed of a porous member such as a sponge and the like which is provided at a rear end side of the pen feed 20.

According to the writing instrument N of the present performing form, the effects of the present invention can be exerted as is the case with the writing instruments L and M of the performing forms of the third embodiment described above.

Figure 22:
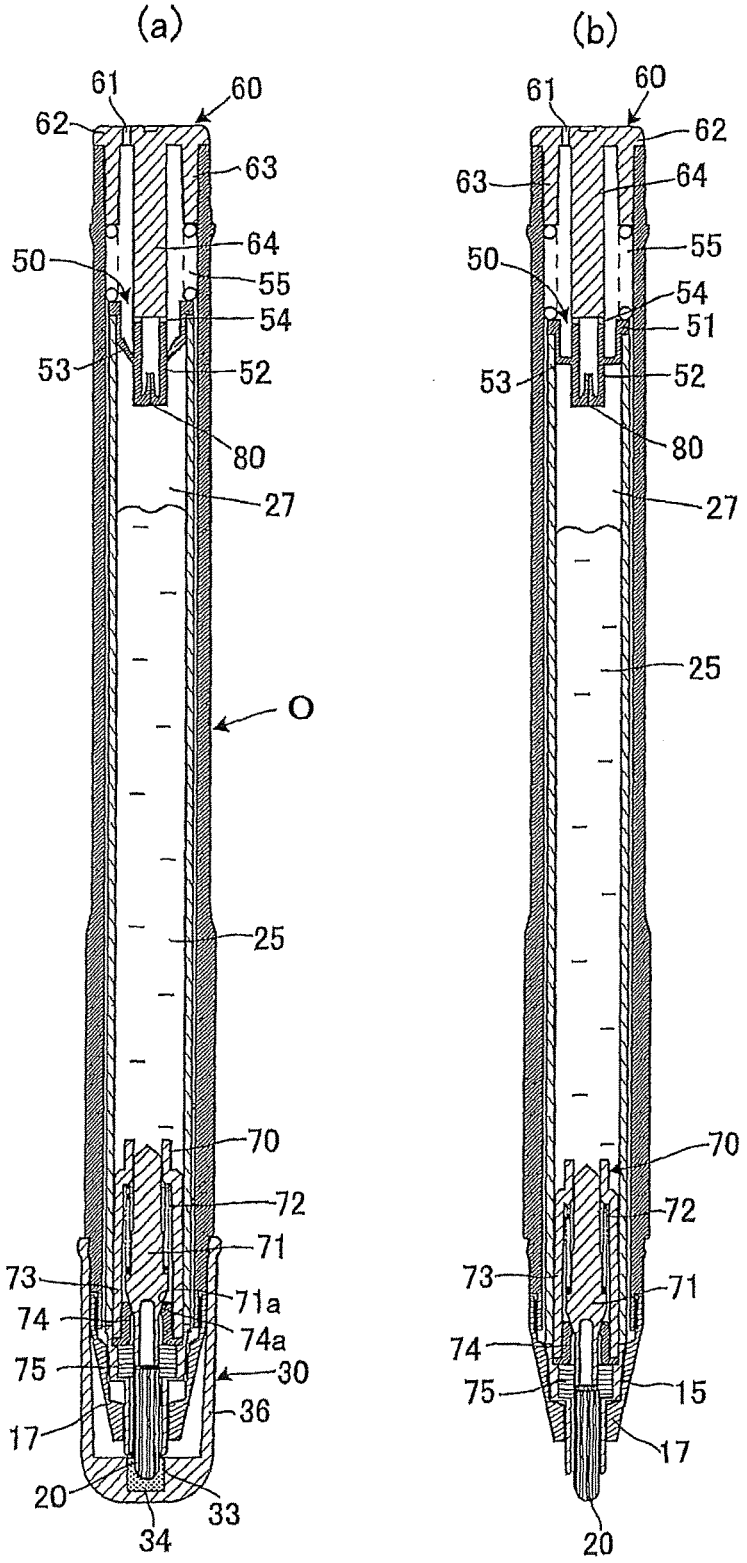
FIG. 22 is a writing instrument showing another example of a performing form in the third embodiment of the present invention, wherein (a) is a vertical cross section showing a state in which a cap member is mounted; and (b) is a vertical cross section showing a state in which the cap member is detached.

FIG. 22 is a writing instrument showing the fourth performing form of the third embodiment in the present invention.

The writing instrument O according to the above fourth performing form is different, as shown in FIGS. 22(*a*) and (*b*), from the writing instrument C of the third performing form described above in terms of constituting a capillary porous member 41 provided with a capillary force which is an inhibiting mechanism for inhibiting a direct flow of an ink by a check valve 80 which acts in the same manner as the above capillary porous member 41 in the writing instrument L of the first performing form described above.

The above check valve 80 is provided integrally with the flexible pressure reducing member 50 described above and can release an internal pressure in a case where the cap is fitted and where the refill goes back, and it can reduce the internal pressure when the cap member 60 is detached.

According to the writing instrument O of the present performing form, the effects of the present invention can be exerted as is the case with the writing instruments L to N of the third embodiment described above.

Figure 23:
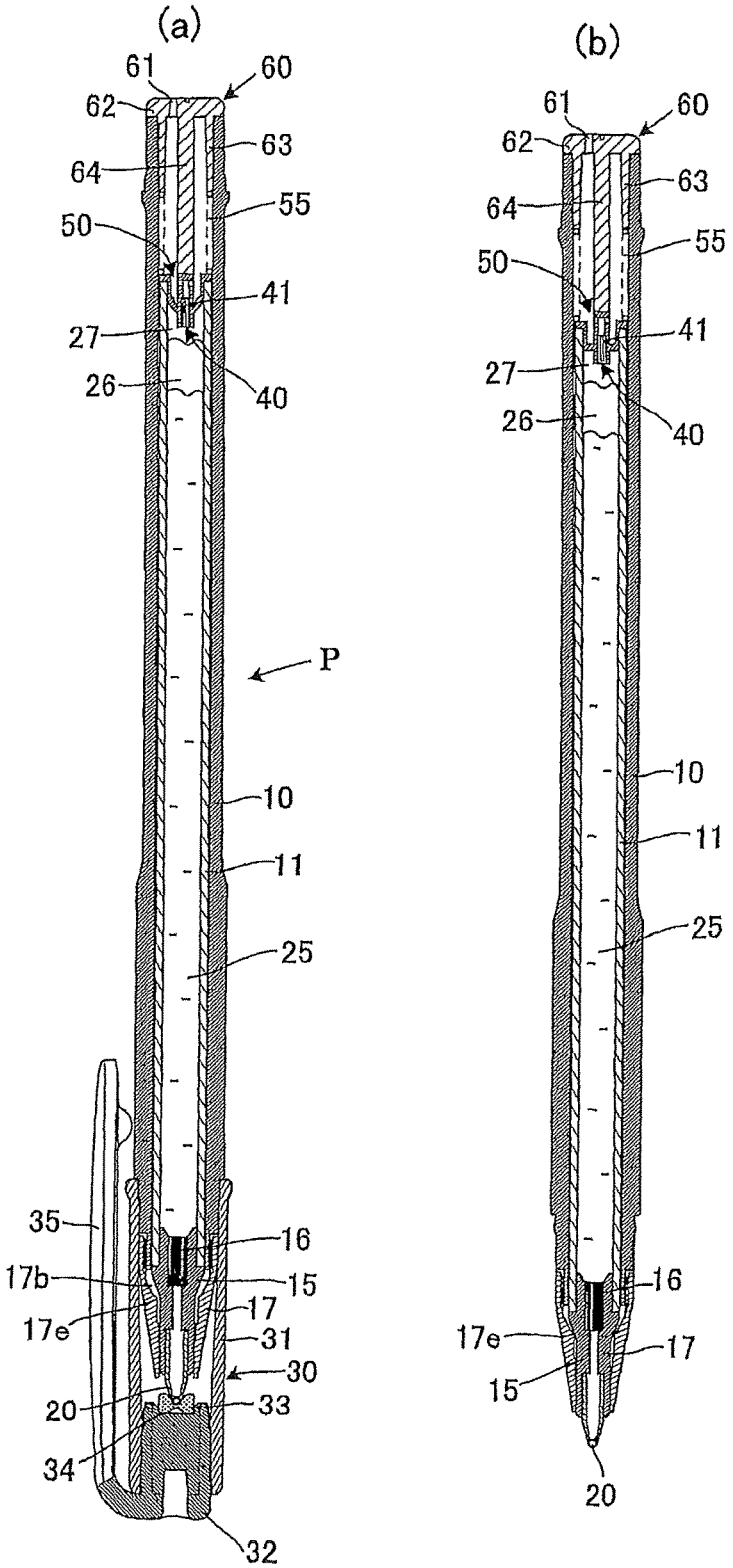
FIG. 23 is a writing instrument showing another example of a performing form in the third embodiment of the present invention, wherein (a) is a vertical cross section showing a state in which a cap member is mounted; and (b) is a vertical cross section showing a state in which the cap member is detached.

FIG. 23 is a writing instrument applied to a ballpoint pen showing the fifth performing form of the third embodiment in the present invention.

The writing instrument P according to the above fifth performing form is different, as shown in FIGS. 23(*a*) and (*b*), from the writing instrument L of the performing form described above in terms of exchanging the plastic feed 20 in which ink grooves are formed in a holder direction on various plastic materials in the writing instrument L of the first performing form described above for a pen feed which is a writing part composed of a ballpoint pen tip having a writing ball, and exchanging the step part formed in the front holder 17 which is a moving end point when the refill 11 moves forward for an inclined step part 17*e*.

According to the writing instrument P applied to the ballpoint pen of the present performing form, the effects of the present invention can be exerted as is the case with the writing instruments L to O of the performing forms in the third embodiment described above.

The writing instruments showing the sixth performing forms of the third embodiment in the present invention are shown in FIG. 24 to FIG. 27.

The writing instrument Q according to the above sixth performing form is different, as shown in FIG. 24 to FIG. 27, from the writing instrument L of the performing form described above in terms of exchanging the plastic feed 20 in which ink grooves are formed in a holder direction on various plastic materials in the writing instrument L of the first performing form described above for a pen feed which is a writing part composed of a fiber feed obtained by processing fiber bundles or subjecting the fiber bundles to resin processing, or a sintered feed (porous member) obtained by sintering various plastic powders, in the present performing form, a pen feed which is a fiber feed obtained by subjecting the fiber bundles to resin processing, omitting the feed 16, and providing a holding part 12 comprising a soft resin material such as a thermoplastic elastomer and the like on a peripheral surface of the writing instrument main body 10, and it is different as well in terms of changing a little the structures of the flexible pressure reducing member 50 and the tail plug 60 as described later.

Figure 26:
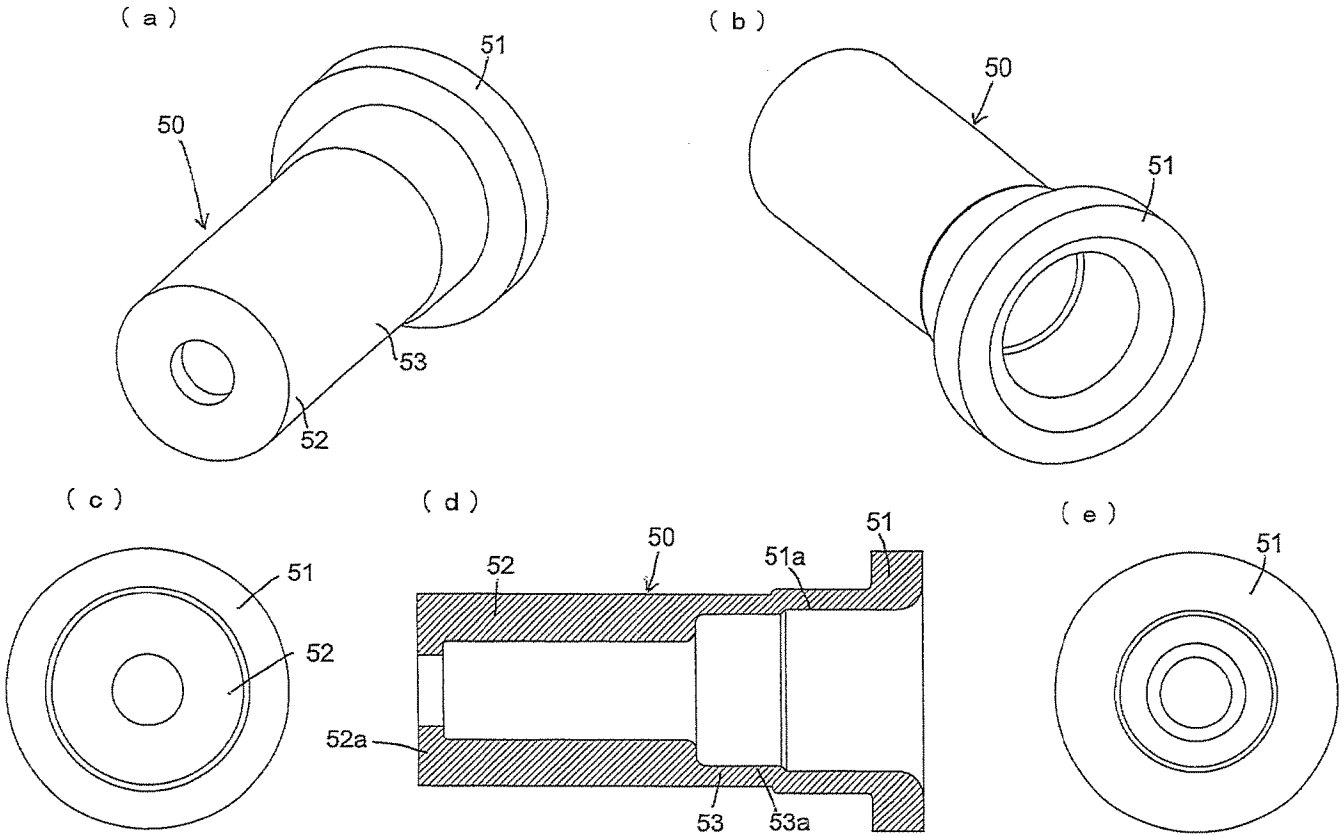
FIG. 26(*a*) to (*e*) show a pressure reducing member of the writing instrument shown in FIG. 24, wherein (a) is a perspective drawing observed from a rear side; (b) is a perspective drawing observed from a front side; (c) is a left side view; (d) is a vertical cross section; and (e) is a right side view.

The flexible pressure reducing member 50 of the above performing form is constituted in a cylindrical form, as shown in FIG. 26(*a*) to (*e*), by molding integrally a main body part 51, a cylindrical receiving member 52 having a receiving step part 52*a* receiving a capillary porous member 41 at a bottom, and an extensible connecting part 53 connecting the main body part 51 and the receiving member 52. The above pressure reducing member 50 is composed of a rubber base material (butyl rubber, IIR) in the present performing form, and the connecting part 53 is extensible.

Figure 27:
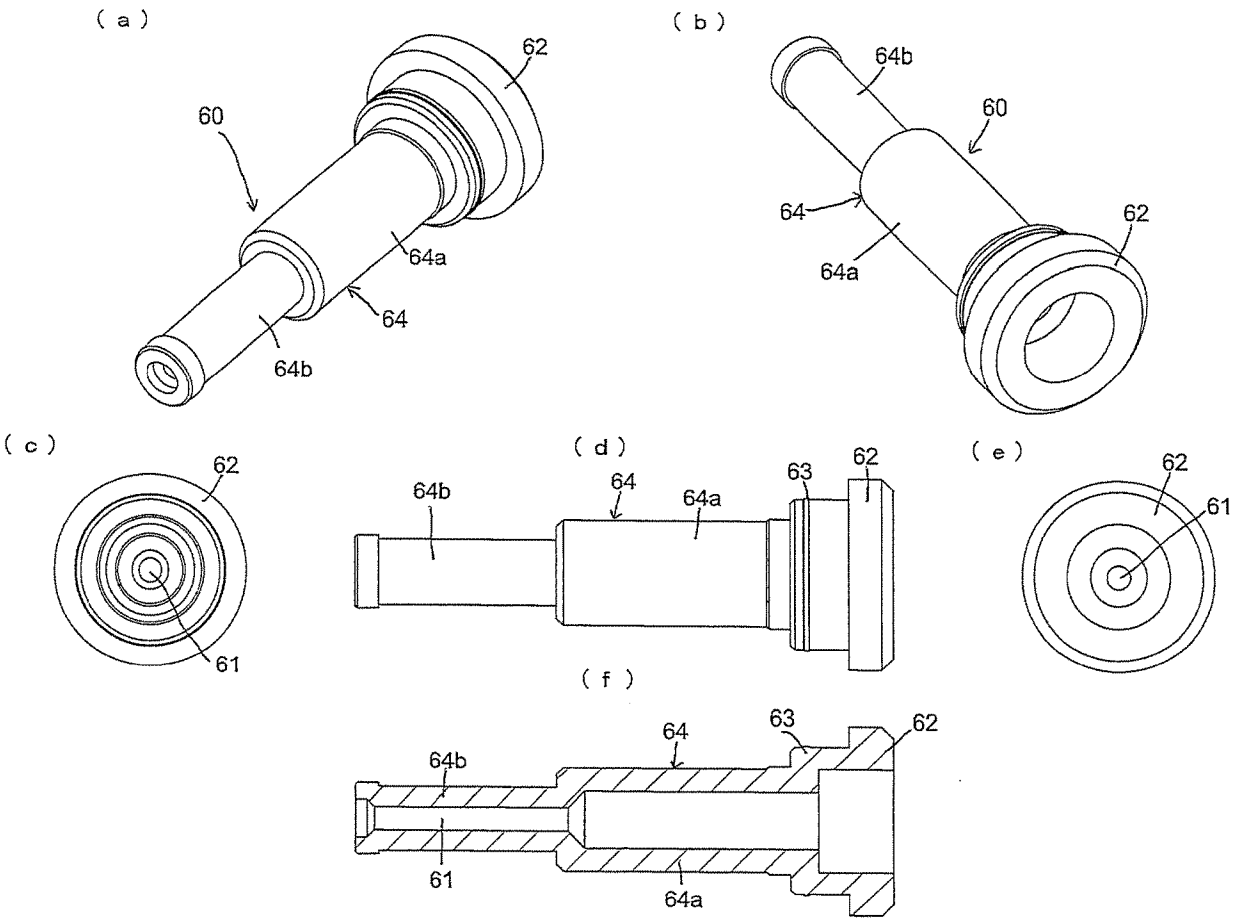
FIG. 27(*a*) to (*f*) show a tail plug of the writing instrument shown in FIG. 24, wherein (a) is a perspective drawing observed from a rear side; (b) is a perspective drawing observed from a front side; (c) is a left side view; (d) is a front view; (e) is a right side view; and (f) is a vertical cross section.

The tail plug 60 is provided, as shown in FIG. 27(*a*) to (*f*), with a cover part 62, a cylindrical fixing part 63 fixed to an aperture part 10*b* of the writing instrument main body 10 by interlocking, and a rod-like member 64 comprising an enlarged diameter part 64*a* and a reduced diameter part 64*b* which extends to an ink tank side, and a communication hole 61 communicating with the air outside the writing instrument main body is formed in an inside of the cover part 62, the cylindrical fixing part 63 and the rod-like member 64. The tail plug 60 is provided with a structure in which the rod-like member 64 of the tail plug 60 is inserted into space parts 51*a* and 53*a* in the insides of the pressure reducing member 50 and the connecting part 53, and the rod-like member 64 is provided with a structure in which a tip part of the reduced diameter part 64*b* of the rod-like member 64 is brought into contact with a receiving part 52*a* surface of the cylindrical receiving member 52.

Figure 24:
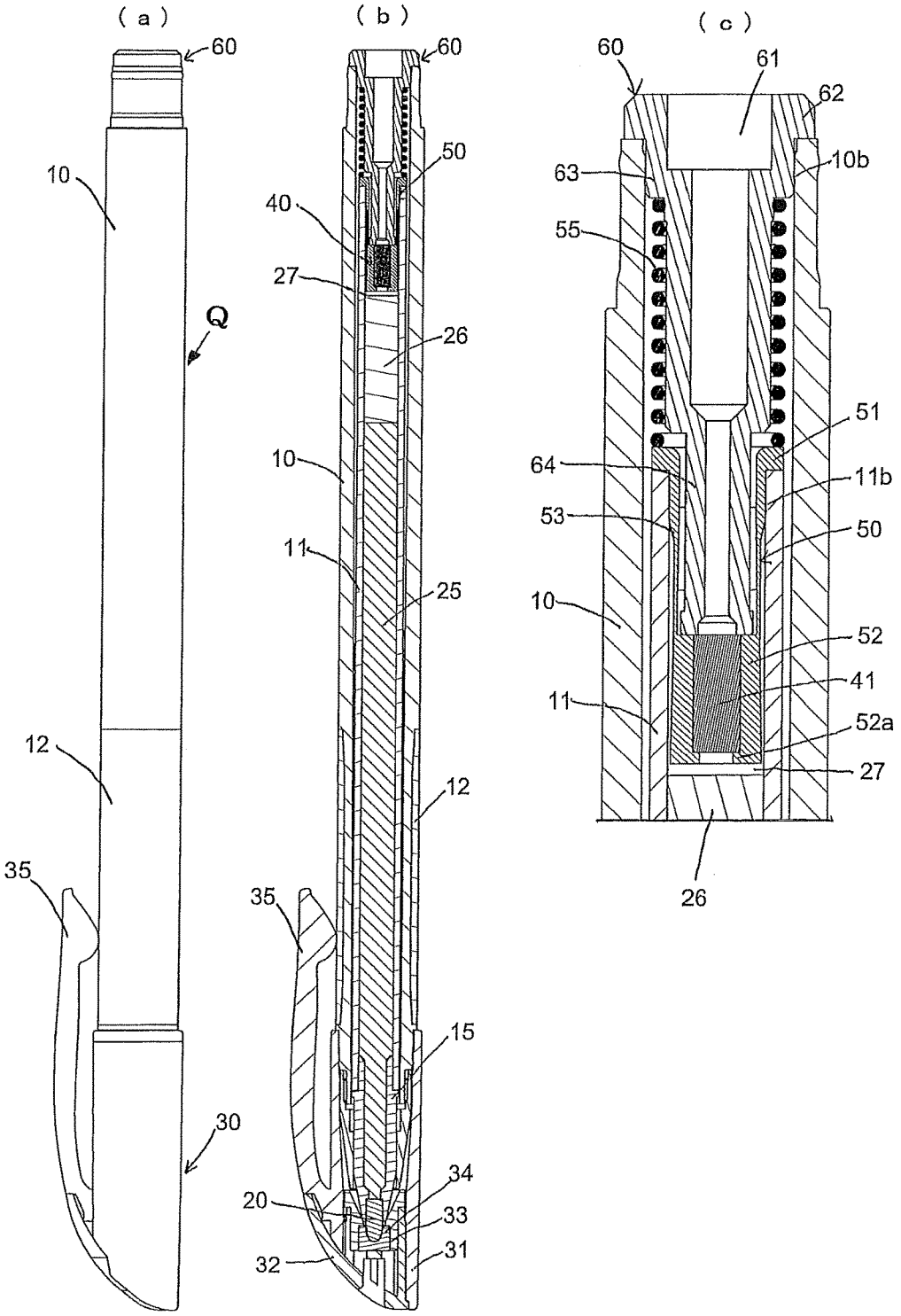
FIG. 24 is a writing instrument showing another example of a performing form in the third embodiment of the present invention, wherein (a) is a front view showing a state in which a cap member is mounted; (b) is a vertical cross section of (a); and (c) is an enlarged vertical cross section showing an essential part of (a).
Figure 25:
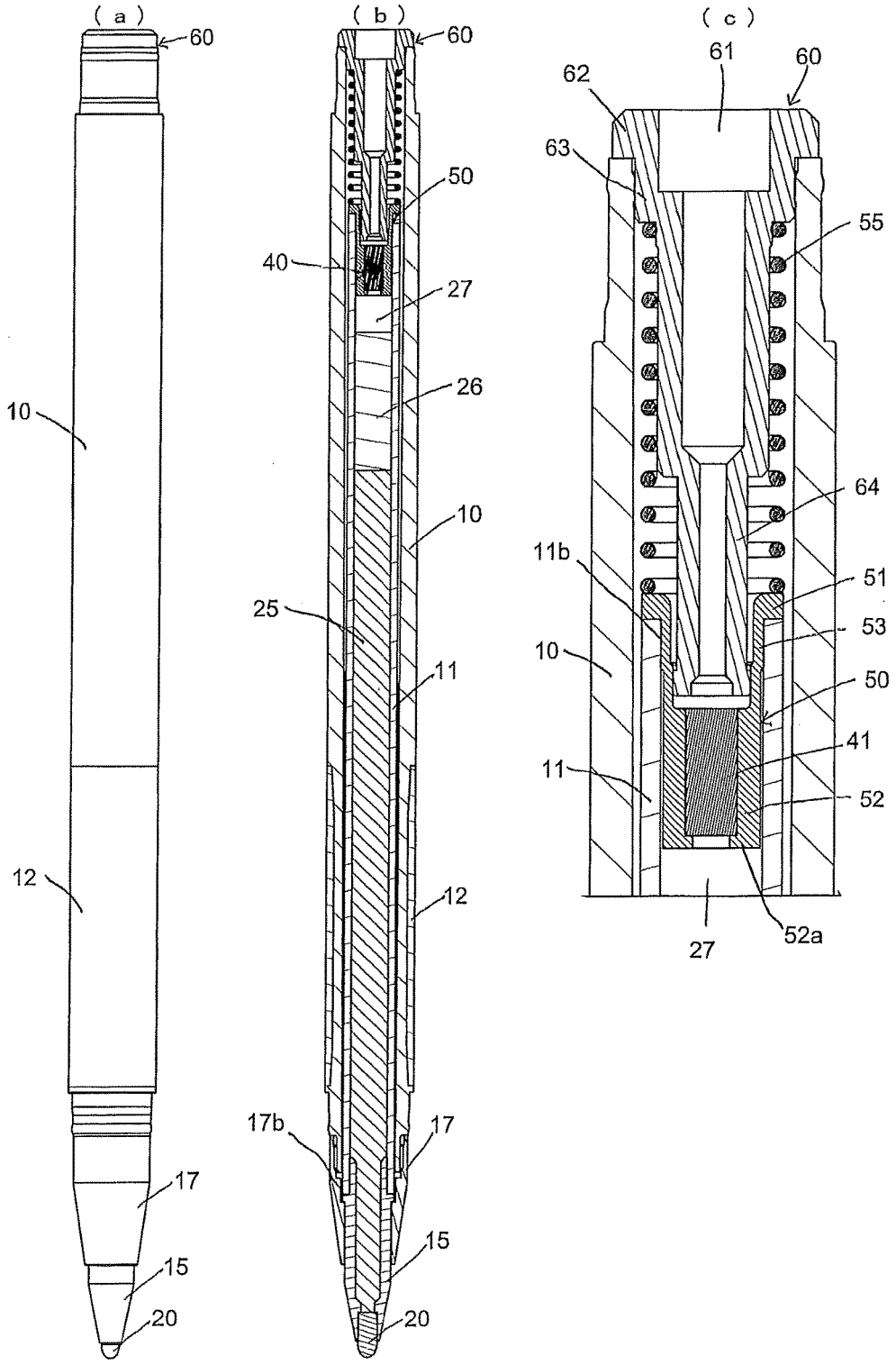
FIG. 25(*a*) to (*c*) show a state in which the cap member of the writing instrument shown in FIG. 24 is detached, wherein (a) is a front view; (b) is a vertical cross section; and (c) is an enlarged vertical cross section showing an essential part.

In the present performing form, extension and contraction of the connecting part 53 of the pressure reducing member 50 which is the pressure reducing mechanism makes it possible, as shown in FIG. 24 and FIG. 25, to control pressure reduction of the space part 27, and the actions thereof are carried out in the same manner as in the writing instruments L to P of the respective performing forms described above. In detaching the cap member 30, the whole refill 11 goes forward while it is sealed in a state in which a rear end part of the refill 11 is fixed, whereby the space part 27 of the refill 11 which is the ink tank is expanded in a volume, and the refill 11 is decreased in a volume in fitting the cap member 30, but it is structured so that an increased portion of the pressure is discharged through the capillary porous member 41 which is a head valve provided at a rear end part of the refill 11. Accordingly, an inside of the refill 11 can be reduced in a pressure in detaching the cap member 30, and the ink can be prevented from leaking from the pen tip 20 in use. In addition thereto, in usually writing, a flow pressure applied to the pen tip is controlled to a fixed level by the action of the capillary porous member 41 to prevent an ink direct flow phenomenon•reverse flow phenomenon.

Shown in FIG. 28 to FIG. 32 is a writing instrument applied to a ballpoint pen of a knock system showing the seventh performing form of the third embodiment in the present invention.

Figure 30:
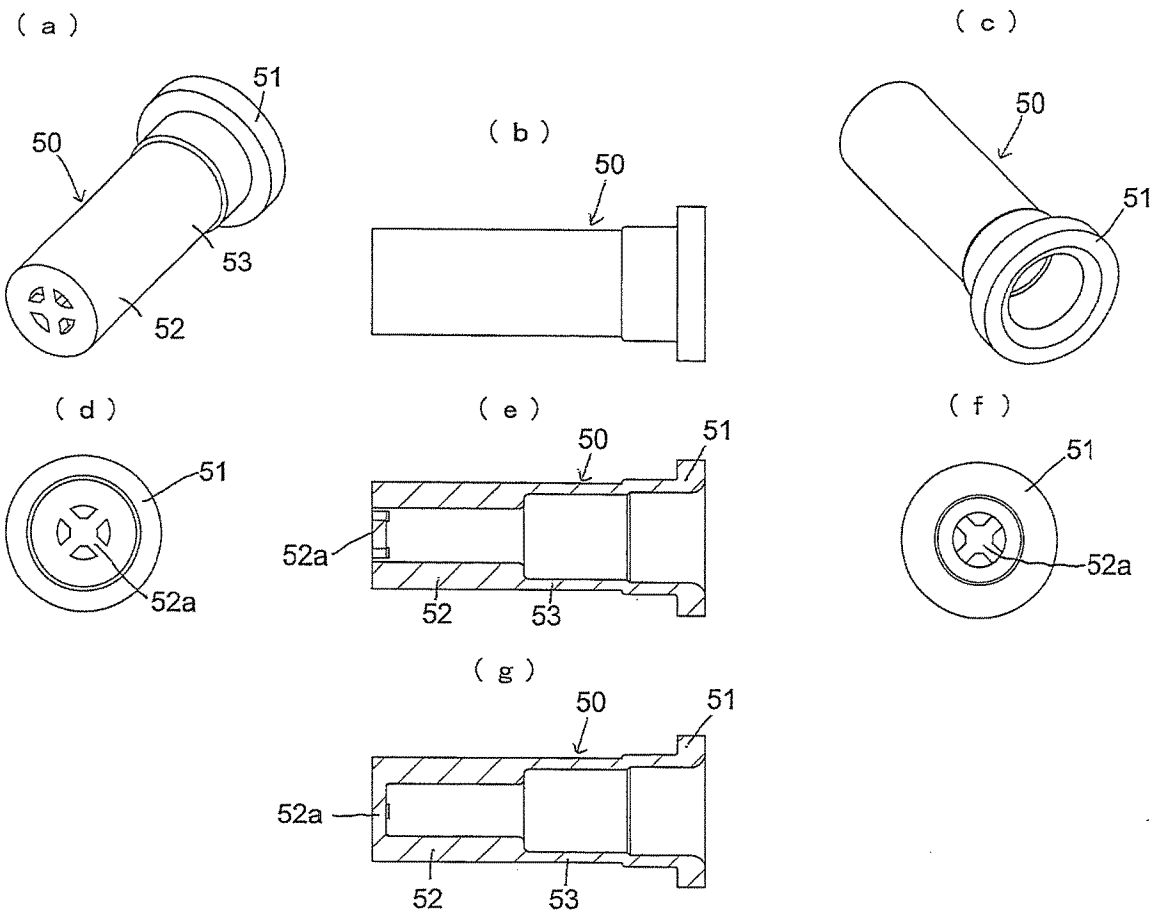
FIG. 30(*a*) to (*g*) show a pressure reducing member of the writing instrument of a knock system shown in FIG. 28, wherein (a) is a perspective drawing observed from a rear side; (b) is a front view; (c) is a perspective drawing observed from a front side; (d) is a left side view; (e) is a vertical cross section; (f) is a right side view; and (g) is a lateral vertical cross section.

The writing instrument R according to the above seventh performing form is a writing instrument of a ballpoint pen type of a knock system having no cap member, and it is the same as the writing instrument of the above sixth performing form, except that it is equipped with the respective members such as a knock mechanism 70, a pressing member 56 and the like in order to provide the writing instrument with the knock system and that the structure of the tail plug 60 is changed a little. The pressure reducing member 50 which is the pressure reducing mechanism of the present embodiment can control pressure reduction of the space part 27 by extension and contraction of the connecting part 53, as shown in FIG. 30, as is the case with the sixth performing form described above.

Figure 32:
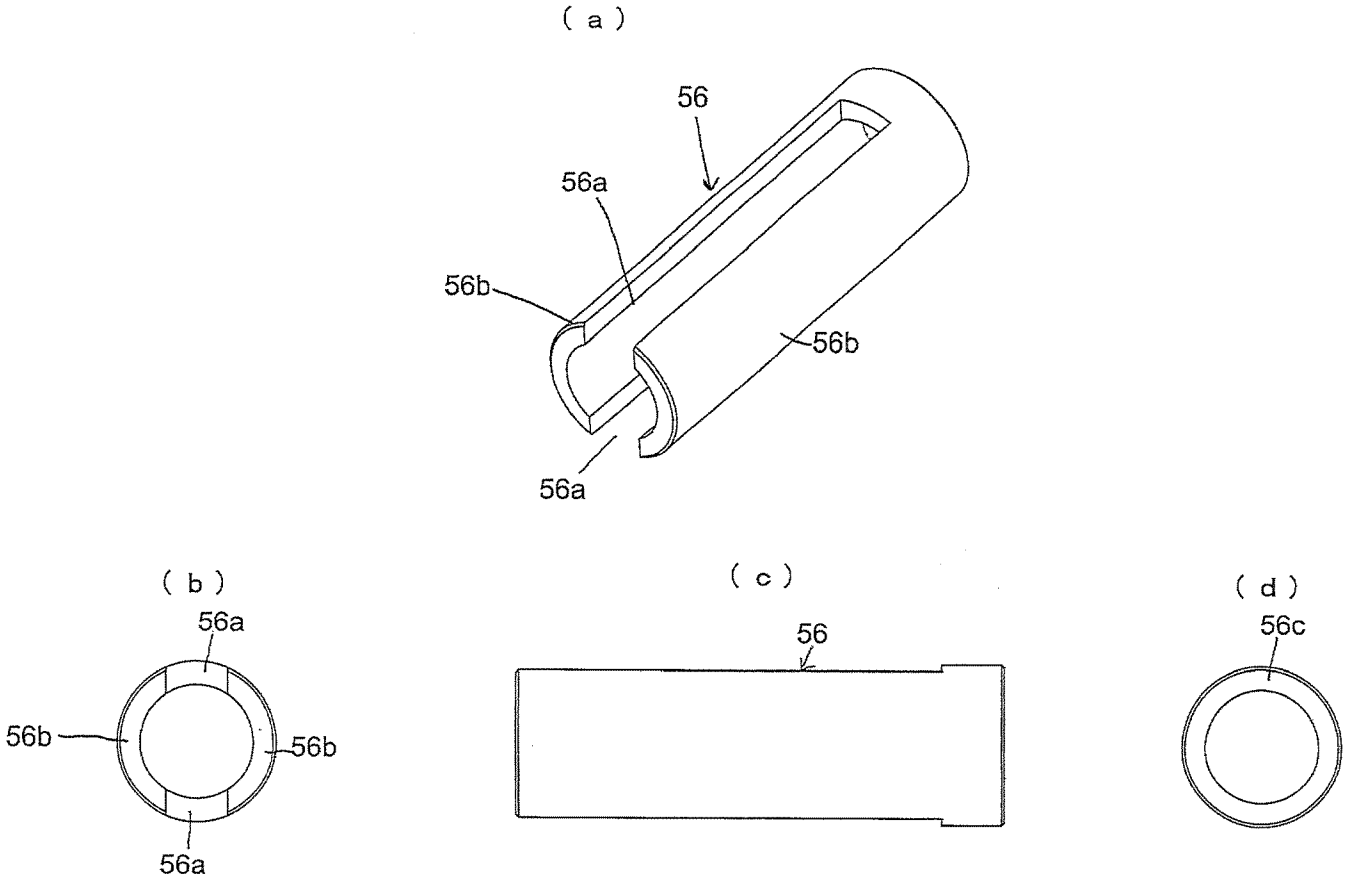
FIG. 32(*a*) to (*d*) show a pressing member of the writing instrument of a knock system shown in FIG. 28, wherein (a) is a perspective drawing; (b) is a left side view; (c) is a front view; and (d) is a right side view.

The pressing member 56 is formed, as shown in FIG. 32(*a*) to (*d*), in an almost cylindrical form, wherein notch parts 56*a*, 56*a* are formed in a length direction, and the pressing member is composed of divided pressing members 56*b*, 56*b* which are divided into two. A contact part 56*c* which is brought into contact with a front end of the knock mechanism is provided at a rear side of the above pressing member 56, and a tip of the divided pressing members 56*b*, 56*b* is constituted so that they press a rear end surface of the pressure reducing member 50.

Figure 31:
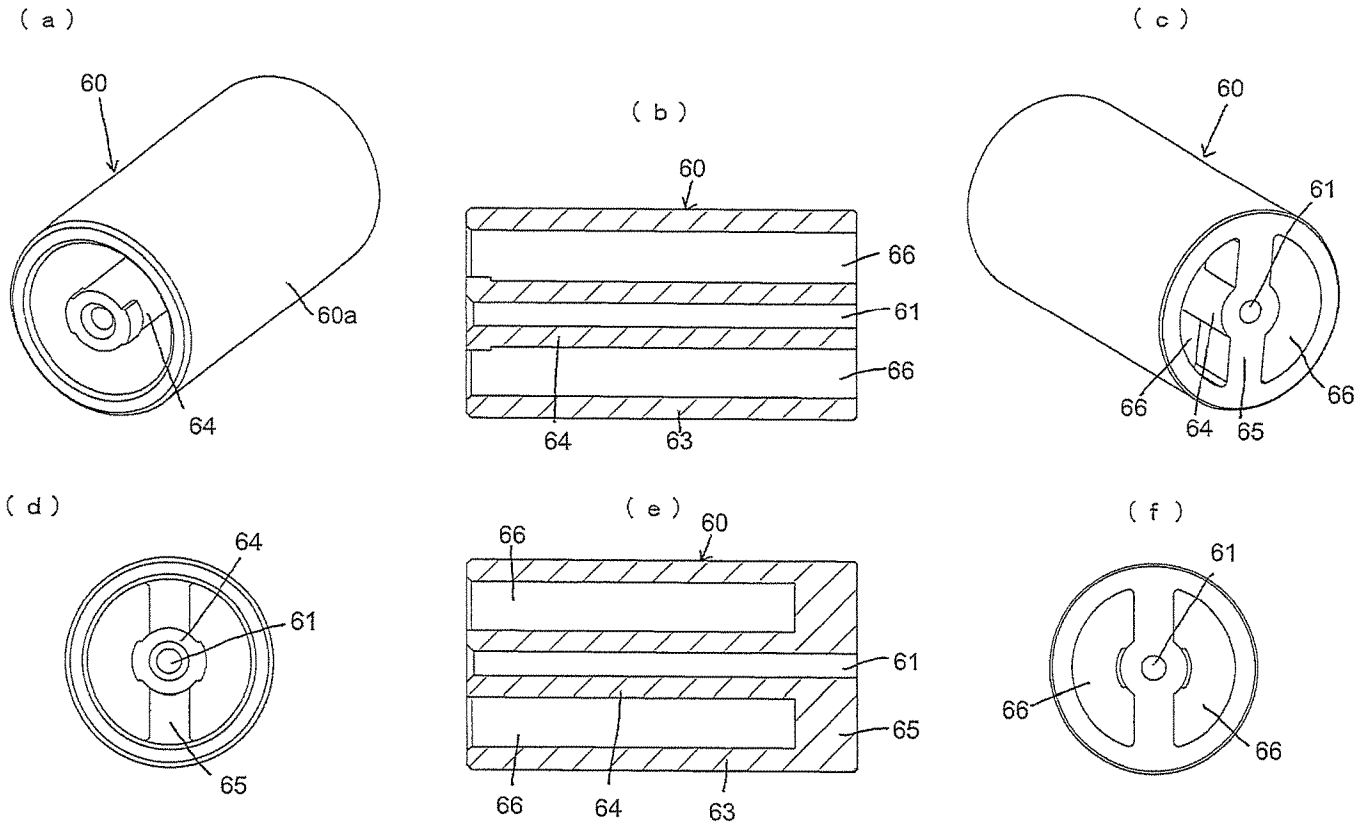
FIG. 31(*a*) to (*f*) show a tail plug of the writing instrument of a knock system shown in FIG. 28, wherein (a) is a perspective drawing observed from a rear side; (b) is a lateral vertical cross section; (c) is a perspective drawing observed from a front side; (d) is a left side view; (e) is a vertical cross section; and (f) is a right side view.

The tail plug 60 is formed, as shown in FIG. 31(*a*) to (*f*), in a cylindrical form, and a rod-like member 64 having a connecting hole 61 is further connected therewith in a central part of an inside of the above cylindrical member 60*a* by a connecting member 65 formed in an aperture part at a pressing member side. An inside of the tail plug 60 is divided into two by the above connecting member 65 to form inserting holes 66, 66 into which the divided pressing members 56*b*, 56*b* of the pressing member 56 described above are inserted.

Figure 28:
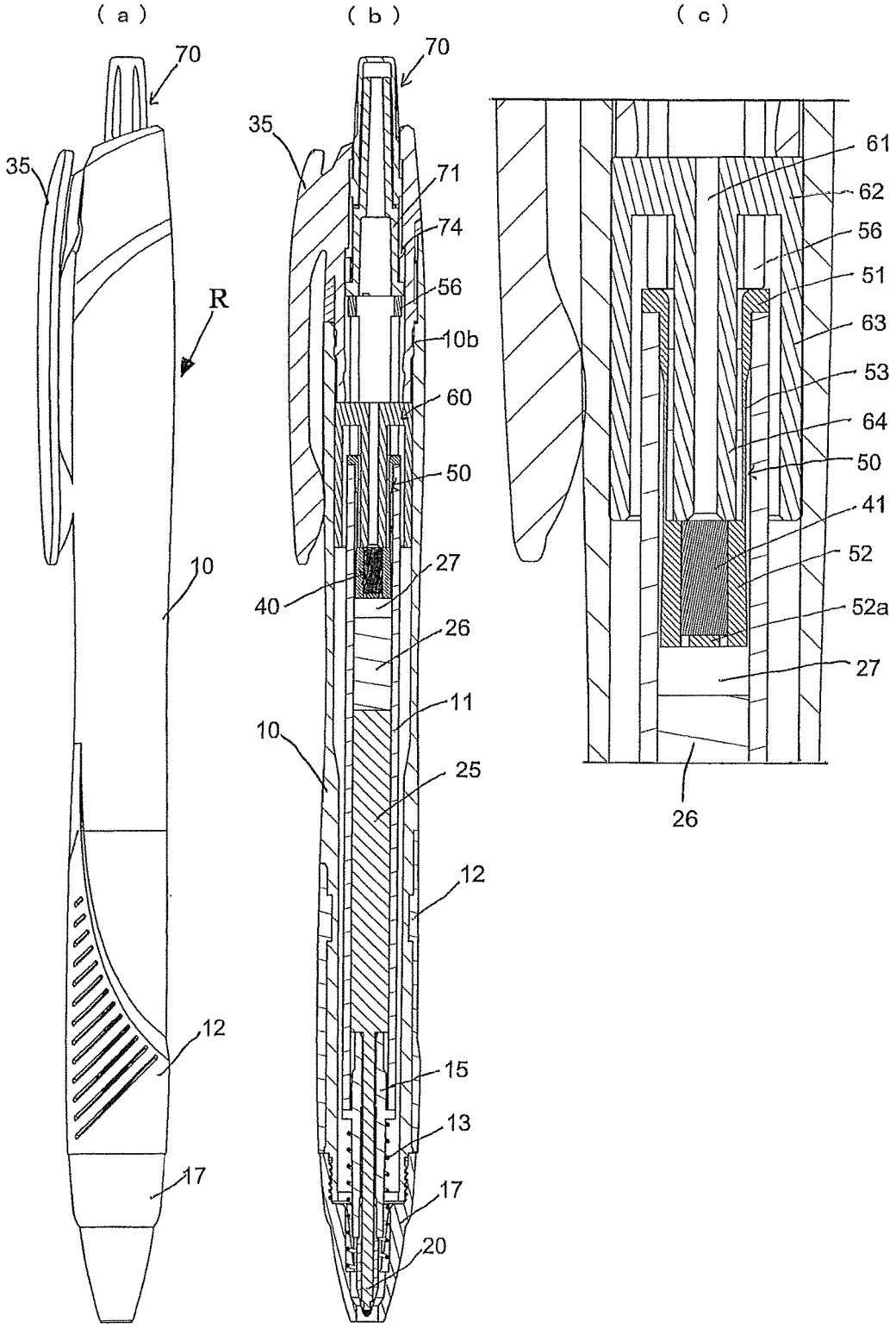
FIG. 28 is a writing instrument of a knock system showing another example of a performing form in the third embodiment of the present invention, wherein (a) is a front view showing a non-writing state; (b) is a vertical cross section of (a); and (c) is an enlarged vertical cross section showing an essential part of (a).
Figure 29:
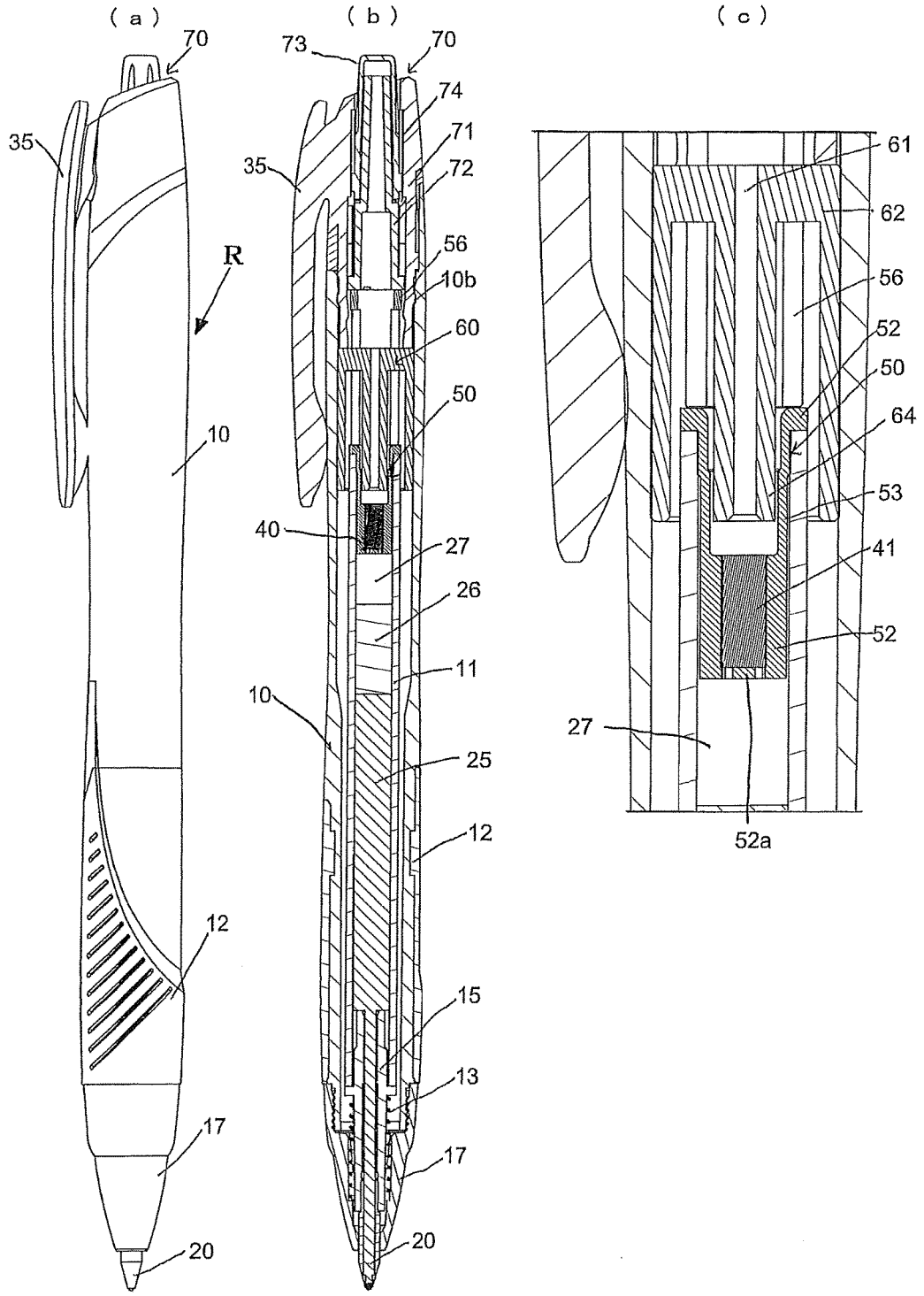
FIG. 29(*a*) to (*c*) show a writing state of the writing instrument of a knock system shown in FIG. 28, wherein (a) is a front view; (b) is a vertical cross section; and (c) is an enlarged vertical cross section showing an essential part.

The knock mechanism 70 is, as shown in FIG. 28 and FIG. 29, a publicly known mechanism having a rotor 72 mounted so that it can move to a forward and backward direction in an inside of an inner cylinder 71 disposed at a rear end aperture part 10*b* of a writing instrument main body 10 having a clip part 35, and a knock member 73 which is an operation part projected from a rear end into an inside of the inner cylinder 71 and movable to a forward and backward direction. The knock mechanism 70 is pressed backward together with a refill 11 by a spring member 13 held between a joint member 15 and a front holder 17. Knocking operation is carried out by pressing the knock member 73 forward.

When knock operation is carried out, the rotor 72 is pressed forward by movement of the knock member 73 to interlock the rotor 72 with a front end surface of a cum part 74, and a writing state is maintained. When the knock operation is carried out once again, the rotor 72 is pressed forward by movement of the knock member 73 to release the rotor 72 from interlocking with a front end surface of the cum part 74 in the inner cylinder. This causes the knock mechanism 70 to move backward by a pressing force of the spring member 13, and the writing instrument falls into a non-writing state.

In the present performing form, the pressure reduction of the space part 27 can be controlled by extension and contraction of the connecting part 53 in the pressure reducing member 50 which is the pressure reducing mechanism, and the tail plug 60 stays in a state in which it extends the pressure reducing member 50 via the capillary member 41 in a non-writing state. The pressure reducing member 50 including the capillary member 41 fixed to the refill 11 advances by carrying out the knock operation in order to project the pen tip in writing, wherein separation of the tail plug 60 fixed to the holder from the capillary member 41 causes the connecting part 53 of the pressure reducing member 50 to contract and the space part 27 to expand in a volume, whereby the space part 27 falls into a pressure reducing state. Also, the refill 11 including the capillary member 41 and the pressure reducing member 50 goes back by carrying out the knock operation once again in order to withdraw the pen tip in non-writing. Accordingly, the refill 11 is brought into contact with the tail plug 60 fixed to the holder to cause the pressure reducing member 50 to extend, and the space part 27 is contracted in a volume to thereby fall into a pressurizing state. Since it is structured so that an increased portion of the pressure is discharged through the capillary porous member 41, an inside of the refill 11 can be reduced in a pressure by knock operation in writing, and the ink can be prevented from leaking from the ballpoint pen member 20 which is the pen tip in use. In addition thereto, in usually writing, a flow pressure applied to the pen tip is controlled to a fixed level by the action of the capillary porous member 41 to prevent an ink direct flow phenomenon•reverse flow phenomenon.

The writing instruments showing the performing forms of the fourth embodiment in the present invention are shown in FIG. 33 to FIG. 44.

The writing instruments of the fourth embodiment relate to writing instruments suited to ballpoint pens, marking pens and the like in which an inside of an ink tank can be reduced in a pressure in detaching a cap to prevent an ink from leaking from a pen tip in use even if an inside of the ink tank receiving the ink is increased in a pressure in storing the writing instrument.

The constitution of the writing instrument of the above fourth embodiment includes the following constitutions of (1) to (3).

(1) A writing instrument provided with an ink tank in which an ink is filled in a writing instrument main body, wherein a pen tip and a cap member sealing the above pen tip are mounted at a front part of the writing instrument main body, and the cap member is provided with a pressure reducing mechanism for reducing a pressure in an inside of the ink tank in detaching the above cap member.

(2) The writing instrument as described in the above item (1), wherein the ink tank is provided with an inhibiting mechanism for inhibiting a direct flow of the ink.

(3) The writing instrument as described in the above item (2), wherein an inhibiting mechanism for inhibiting a direct flow of an ink in which a capillary porous member provided with a capillary force by impregnating with a liquid is arranged is provided in a space part between a rear part of a follower and a rear end part in an inside of the ink tank in a state in which the follower is filled in a rear part of the ink.

According to the writing instruments of the fourth embodiment, provided is a writing instrument suited to ballpoint pens, marking pens and the like in which an inside of an ink tank can be reduced in a pressure in detaching a cap to prevent an ink from leaking from a pen tip in use even if an inside of a writing instrument main body is increased in a pressure in storing the writing instrument. According to a writing instrument in which the ink tank is further provided with an inhibiting mechanism for inhibiting a direct flow of the ink in the above writing instrument, provided is a writing instrument in which a flow pressure of an ink applied to a pen tip is further controlled to a fixed level to make it possible to prevent an ink direct flow phenomenon•reverse flow phenomenon.

The performing forms of the fourth embodiment in the present invention shall be explained below in detail with reference to the drawings (FIG. 33 to FIG. 44).

Figure 33:
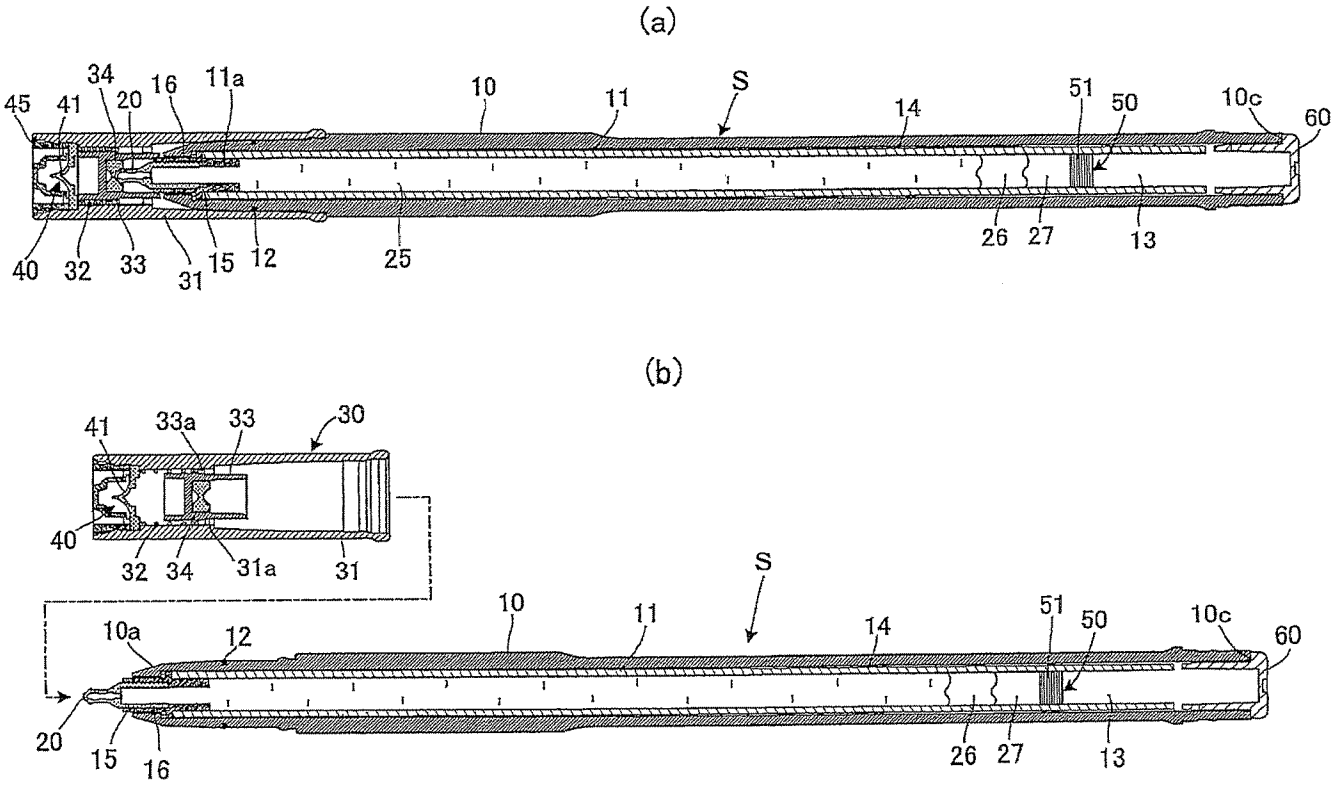
FIGS. 33(*a*) and (*b*) show a writing instrument showing one example of a performing form in the fourth embodiment of the present invention, and they are the respective vertical cross sections showing a state in which a cap member is mounted and a state in which the cap member is detached.
Figure 34:
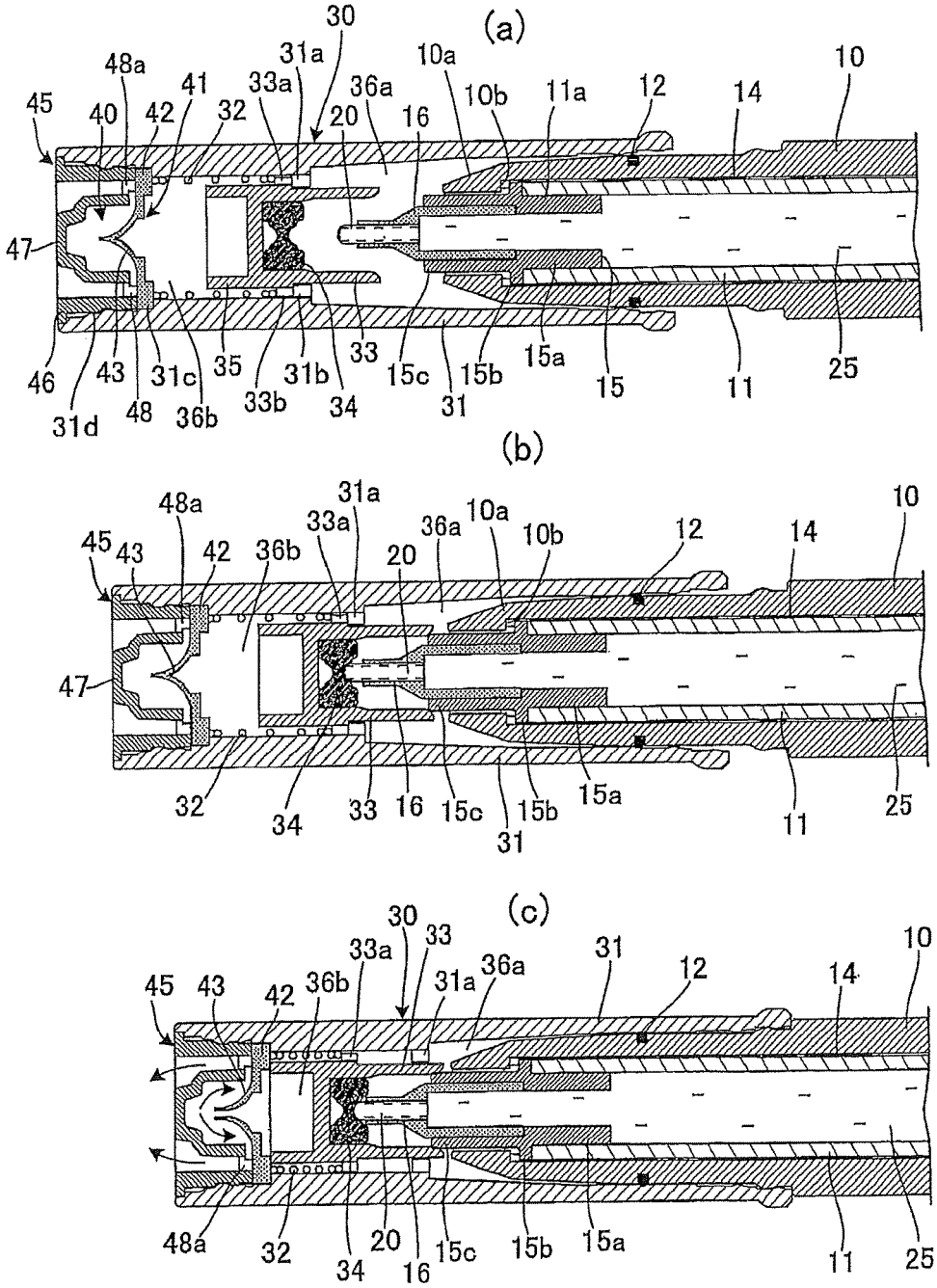
FIG. 34(*a*) to (*c*) are explanatory drawings for explaining a pressure reducing mechanism installed in the cap member in the writing instrument shown in FIG. 33, and they are partially enlarged vertical cross sections for explaining in order a process in which the cap member is mounted in the writing instrument main body.
Figure 35:
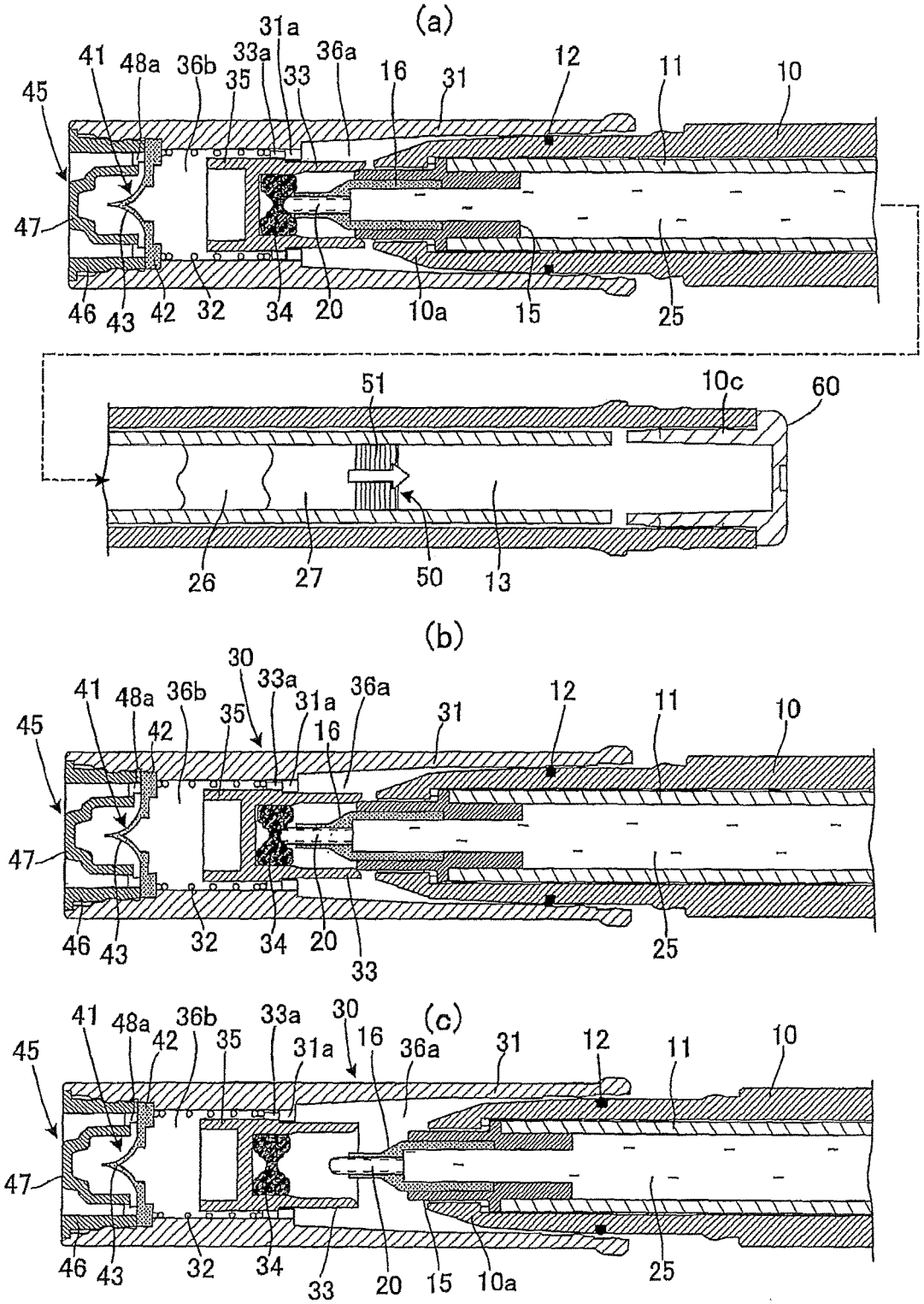
FIG. 35(*a*) to (*c*) are explanatory drawings for explaining a pressure reducing mechanism installed in the cap member in the writing instrument shown in FIG. 33, and they are partially enlarged vertical cross sections for explaining in order a process in which the cap member is detached from the writing instrument main body.

FIG. 33 to FIG. 35 are the respective drawings of the writing instrument showing one example (first performing form) of the performing forms in the fourth embodiment of the present invention.

The writing instrument S of the present performing form is, as shown in FIGS. 33(*a*) and (*b*), loaded with a pen tip 20 and a cap member 30 for sealing the above pen tip 20 at a front part of a writing instrument main body 10 which is a holder part and contains an ink 25 filled in an ink tank 11 comprising a refill provided in an inside of the writing instrument main body 10. The cap member 30 is provided with a pressure reducing mechanism 40 for reducing a pressure in an inside of the ink tank 11 in detaching the cap member 30, and an inhibiting mechanism 50 for inhibiting a direct flow of the ink is provided at a rear part of the ink tank 11.

The writing instrument main body 10 constitutes a holder part and can be composed by using a resin, metal and the like. In the present performing form, the writing instrument main body 10 is molded by using an acrylonitrile styrene (AS) resin.

The refill 11 receiving the ink 25 is received in the above writing instrument main body 10.

The refill 11 is preferably one which is not adversely affected with the passage of time by raw materials contained in the ink received therein. It can be formed by using materials including, for example, resins such as polypropylene (PP), polyethylene naphthalate (PEN), polyethylene terephthalate (PET), polyethylene (PE) and the like, and metals such as aluminum and the like. In the present performing form, the refill 11 which is the ink tank is molded in a cylindrical form by using polypropylene (PP).

The pen tip 20 is composed of a pen feed as a writing part composed of a plastic feed in which ink grooves are formed in a holder direction on various plastic materials.

The above pen feed 20 has a structure in which it is fixed, as shown in FIG. 33 and FIG. 34, by a cylindrical joint member 15 mounted in a tip aperture part 11*a* of the refill 11. The joint member 15 is composed of a cylindrical fixing part 15*a* fixed to the tip aperture part 11*a* of the refill 11 by interlocking and the like, a flange part 15*b*, and a fixing part 15*c* fixing a cylindrical holding part of the pen feed 20 by interlocking, and it is structured so that the ink 25 filled in the refill 11 which is the ink tank is supplied to the pen feed 20 which is the writing part described above.

The refill 11 in which the pen feed 20 is mounted to a tip by the joint member 15 is received in an inside of the writing instrument main body 10 by fitting the fixing part 15*c* and the flange part 15*b* of the joint member 15 to a tapered front holder part 10*a* formed at a tip of the writing instrument main body 10 and a step part 10*b* formed in an inside of the writing instrument main body 10, and the pen feed 20 has a form in which it is projected from the front holder part 10*a* of the writing instrument main body 10. Also, an O ring 12 is mounted on a peripheral surface of the writing instrument main body 10 on which the cap member 30 is fitted in order to hold the cap member 30 in an air tight state.

The ink 25 received in the refill 11 which is the ink tank shall not specifically be restricted and includes a water based ink, an oil based ink, a gel ink and the like. A pigment (including a resin pigment), a colorant such as a dye and the like, a main solvent, a resin, a thickener, and optional components added to inks for writing instruments can be used as the components of the ink according to the uses thereof (a water based ink, an oil based ink, a gel ink and the like) and the kind of the writing instrument (a marking pen, a ballpoint pen and the like).

Capable of being contained as the optional components are, for example, a rust preventive, an anti-mold agent, a surfactant, a lubricant, a wetting agent and the like which can be compatible with the ink without exerting adverse effects to the ink. In an ink for a ballpoint pen, fatty acids and the like can suitably be used as the lubricant. Also, non-volatile solvents and the like which are compatible with the main solvent can also be added as an additive for inhibiting dryness as long as adverse effects are not exerted in terms of the characteristics of the products.

In the present performing form, the ink 25 is composed of an ink for water based felt tip pens.

A follower (following member) 26 following the ink as it is consumed in writing is provided, as shown in FIG. 33, at a rear part of the ink 25 filled in the refill 11, and a space part 27 which is an air chamber is provided at a rear side of the follower.

The follower (following member) 26 has preferably a low permeability and a low dispersibility against the solvent used, and non-volatile and hardly volatile fluids, to be specific, polybutene, liquid paraffins, mineral oils, process oils and the like can be used as a base material thereof.

When the above substances have a low viscosity, a thickener and a gelling agent are preferably used. They include, to be specific, metal soaps, bentonites, fatty acid amides, hydrogenated castor oils, metal fine particles containing titanium oxide, silica, alumina and the like, celluloses, elastomers, and the like. In the present performing form, the follower (following member) 26 is composed of a mineral oil and a thickener.

The cap member 30 of the present performing form seals the pen feed 20 and is provided with the pressure reducing mechanism 40 for reducing a pressure in an inside of the ink tank 11 in detaching the cap member 30.

The above cap member 30 is provided with a cylindrical outer cap part 31 which is a mounting part detachably installed on a peripheral surface at a front holder side of the writing instrument main body (holder part) 10, and an inner cap part 33 having a bottomed form which freely slides to a holder direction in the above outer cap part 31 and which is pressed to a pen feed 20 side by an elastic member 32 comprising a spring member. The above inner cap part 33 is provided in an inside with a sealing member 34 composed of rubber such as nitrile rubber (NBR), butyl rubber (IIR) and the like, a thermoplastic elastomer, a soft resin and the like for sealing a whole projection part of the pen tip 20. The inner cap part 33 is provided on a peripheral surface with a circular holding part 33*b* having a vent hole 33*a* which is brought into contact with one end of the elastic member 32 and which holds it, and it is provided with a cylindrical part 35 extended to a direction opposite to a pen tip side. Also, the above inner cap part 33 has a structure in which it is held by a circular holding part 31*b* having a vent hole 31*a* provided on an inner circumferential surface of the outer cap part 31.

The pressure reducing mechanism 40 installed in the above cap member 30 is provided with the flexible pressure reducing member 41 in the outer cap part 31. The above pressure reducing member 41 is provided integrally with a circular main body part 42 and a thin releasing piece 43 which is closed in a usual state and opened when the pressure is higher than a set pressure.

The above pressure reducing member 41 can be composed of a flexible (elastic) material, for example, nitrile rubber (NBR), ethylene propylene diene rubber (EPDM), butyl rubber (IIR), silicone rubber, a thermoplastic elastomer (TPE), a film and the like. In the present performing form, it is composed of butyl rubber (IIR).

Also, an outer peripheral side of the main body part 42 in the above pressure reducing member 41 is mounted to a mounting surface part 31*c* provided on an inner peripheral side of the outer cap part 31, and the pressure reducing member is fixed to an inside of the outer cap part 31 by a cover member 45 having a vent hole which is fixed to an aperture part 31*d* of the outer cap part 31 by interlocking and the like.

The elastic member 32 pressing the inner cap part 33 described above to a pen feed 20 side is held at both sides by the circular holding part 31*b* of the inner cap part 33 and the circular main body part 42 of the above pressure reducing member 41, and it is interposed between the inner cap part 33 and the outer cap part 31 and between the outer cap part 31 and the inner cap part 33.

The cover member 45 described above is provided with a cylindrical fixing part 46 and a bottomed cover member 47, and the cylindrical fixing part 46 and the cover member 47 are integrally composed through a connecting part 48 having a vent hole 48*a* connecting to an outside air (atmosphere) side.

A whole tip of the pen feed 20 held by the joint member 15 is sealed by the sealing member 34 of the inner cap part 33 by installing the above cap member 45 to a tip side of the writing instrument main body 10 to prevent a direct flow from the pen tip 20 when an inside of the ink tank 11 is changed in a pressure. The sealing member 34 of the present performing form is composed of butyl rubber (IIR). In the present performing form, the sealing state described above is that a tip side of the inner cap 33 is interlocked, as shown in FIG. 34(*c*), with the fixing part 15*c* of the joint member 15 while the inner cap 33 goes backward against a pressing force of the elastic member 32 to turn an inside of the inner cap 33 to a closed space and that a whole tip of the pen feed 20 is sealed by the sealing member 34.

The inhibiting mechanism 50 for inhibiting a direct flow of the ink 25 in the ink tank 11 is provided with an inhibiting member 51 for inhibiting a direct flow of an ink. The above inhibiting member 51 can be composed of a fiber feed obtained by processing parallel fiber bundles comprising at least one combination of natural fibers, animal fibers, polyacetal base resins, polyethylene base resins, acryl base resins, polyester base resins, polyamide base resins, polyurethane base resins, polyolefin base resins, polyvinyl base resins, polycarbonate base resins, polyether base resins, polyphenylene base resins and the like, and fiber bundles such as felt and the like, or a fiber feed obtained by subjecting the above fiber bundles to resin processing, or a porous member (sintered member) obtained by sintering various plastic powders. In the present performing form, it is composed of a fiber bundle feed comprising acryl fibers. When the ink is discharged, air is introduced by the above inhibiting member 51, and therefore writing becomes possible. When writing is stopped, it becomes possible to maintain a pressure reducing state in an inside of the ink tank, and directly flow of the ink is prevented.

Also, a tail plug 60 sealing the writing instrument main body 10 is mounted to an aperture part 10*c* at a rear end side of the writing instrument main body 10. The writing instrument main body 10 receiving the ink tank 11 falls into a state in which it is tightly sealed by installing the tail plug 60 and the cap member 30 described above, and a first space part 36*a* and a second space part 36*b* of the cap member 30 falls into a state in which they are communicated with the ink tank 11. That is, the ink tank 11 stays in a state in which it is communicated from the space part 27 of the ink tank 11 to the second space part 36*b* of the cap member 30 via the inhibiting member 51, a space part 13 at a rear side of the ink tank 11, a gap 14 between the writing instrument main body 10 and the ink tank 11, a gap 16 between the writing instrument main body 10 and the joint member 15, the first space part 36*a* of the cap member 30, and the vent hole 31*a* of the outer cap part 31 in the cap member 30. The above second space part 36*b* of the cap member 30 is communicated with an outside air (atmosphere) via the pressure reducing member 41 and the vent hole 48*a* of the cover member 45 of the cap member.

In the writing instrument S of the first performing form in the fourth embodiment constituted in the manner described above, the first space part 36*a* and the second space part 36*b* of the cap member 30 are contracted, as shown in FIG. 34(*a*) to (*c*), in a volume in installing the cap member 30 while sealing by the cap member 30. To be specific, when starting installing initially the outer cap part 31 of the cap member 30, as shown in FIG. 34(*a*), to a tip side of the writing instrument main body 10 in installing the cap member 30, the cap member 30 surrounds a tip side of the writing instrument main body 10, and then a tip side of the inner cap 33 of the cap member 30 is interlocked, as shown in FIG. 34(*b*) to (*c*), with the fixing part 15*c* of the joint member 15 while the outer cap part 31 slides and seals by the O ring 12 to seal tightly an inside of the inner cap 33, whereby a whole tip of the pen feed 20 is sealed by the sealing member 34. At the same time as installing the cap member 30, the first space part 36*a* and the second space part 36*b* of the cap member 30 are contracted in a volume, and the cap member 30 is provided with a structure in which an increased portion of the pressure is released (when the pressure is higher than a set pressure, it is discharged) by a releasing piece 43 of the pressure reducing member 41 in the pressure reducing mechanism 40 provided in the cap member 30. On the other hand, in releasing (detaching) the cap member 30, the first space part 36*a* and the second space part 36*b* are expanded, as shown in FIG. 35(*a*) to (*c*), in a volume by detaching the cap member 30 while maintaining sealing of the cap member 30. To be specific, when starting detaching initially the outer cap part 31 of the cap member 30, as shown in FIGS. 35(*a*) and (*b*), from a tip side of the writing instrument main body 10 in detaching the cap member 30, the first space part 36*a* and the second space part 36*b* are expanded in a volume, but the above spaces can indirectly be reduced in a pressure since the first space part 36*a* and the second space part 36*b* are communicated with the space 27 of the ink tank 11. Also, even when an inside of the ink tank 11 in the writing instrument main body 10 is increased in a pressure in storing the writing instrument, the pressure is released by the pressure reducing member 40, and an increased portion of the pressure remaining slightly in the ink tank 11 can be forcibly reduced in detaching the cap member 30 by the pressure reducing mechanism 40 provided in the cap member 30. Accordingly, the writing instrument in which the ink is prevented from leaking from the pen tip 20 in use is obtained.

Also, in usually writing and finishing writing, a flow pressure applied to the pen tip is controlled to a fixed level to prevent an ink direct flow phenomenon•reverse flow phenomenon by the cycle of the inhibiting member 51 in the inhibiting mechanism for inhibiting a direct flow of the ink which is provided at a rear end part of the refill 11. That is, since the inhibiting member 51 is provided at a rear end part of the refill 11, the space part 27 is turned to a pressure reducing state by discharging the ink in writing, and when pressure reduction is over a set force of the inhibiting member 51, air comes in from the inhibiting member 51 and makes it possible to write in a usual manner. On the other hand, when writing is finished, the inhibiting member 51 is restored to an initial state and makes it possible to cause the ink to support an own weight.

Further, in the writing instrument S of the first performing form of the present fourth embodiment, a whole projection part of the pen feed 20 is sealed by the sealing member 34 in fitting the cap member 30, and therefore a direct flow phenomenon of the ink from the pen tip 20 is prevented even when an internal pressure of the ink tank is varied by heating and the like.

Next, FIG. 36 to FIG. 44 show another examples (a second performing form to an eighth performing form) of the writing instruments of the fourth embodiment in the present invention. It should be noted that in FIG. 36 to FIG. 44, the same structures as those of the first performing form (FIG. 33 to FIG. 35) of the fourth embodiment described above shall be shown by the same marks to omit the explanations thereof.

Figure 36:
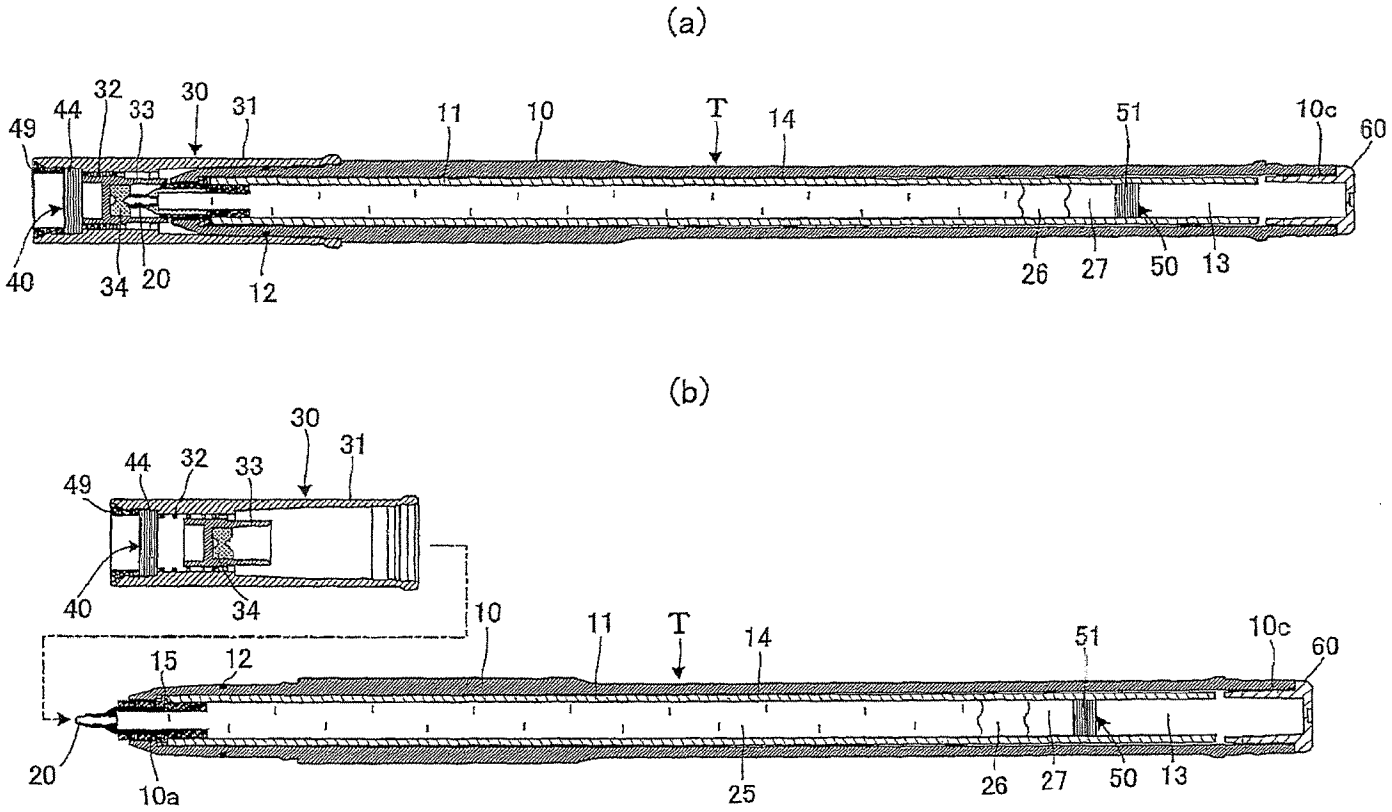
FIGS. 36(*a*) and (*b*) show a writing instrument showing another example of a performing form in the fourth embodiment of the present invention, and they are vertical cross sections showing a state in which a cap member is mounted and a state in which the cap member is detached.
Figure 37:
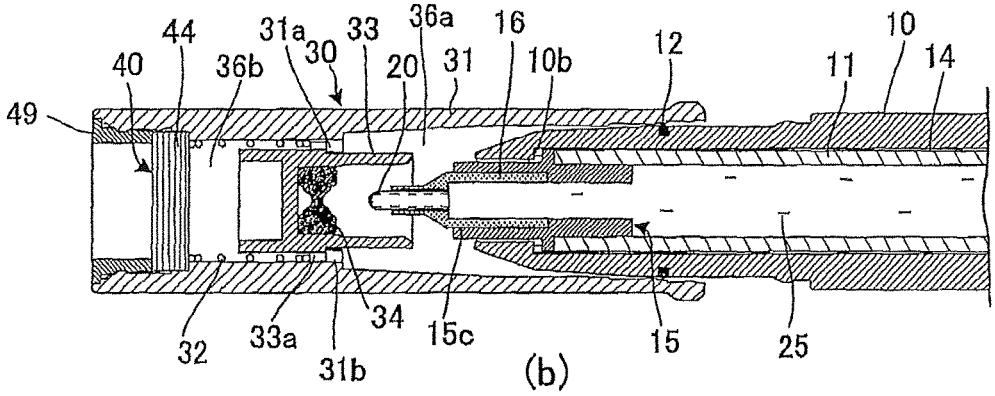
FIG. 37(*a*) to (*c*) are explanatory drawings for explaining a pressure reducing mechanism installed in the cap member in the writing instrument shown in FIG. 36, and they are partially enlarged vertical cross sections for explaining in order a process in which the cap member is mounted in the writing instrument main body.
Figure 37:
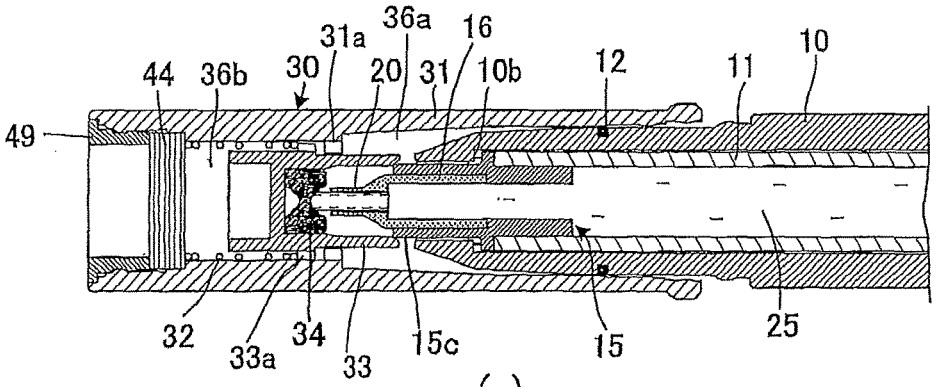
Figure 37:
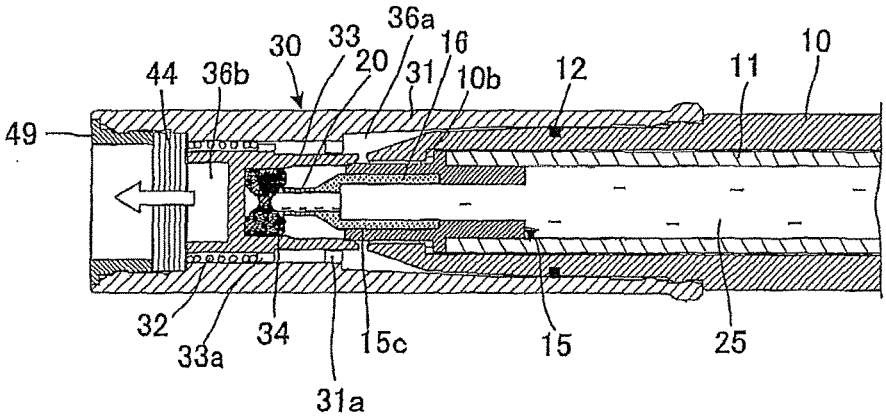
Figure 38:
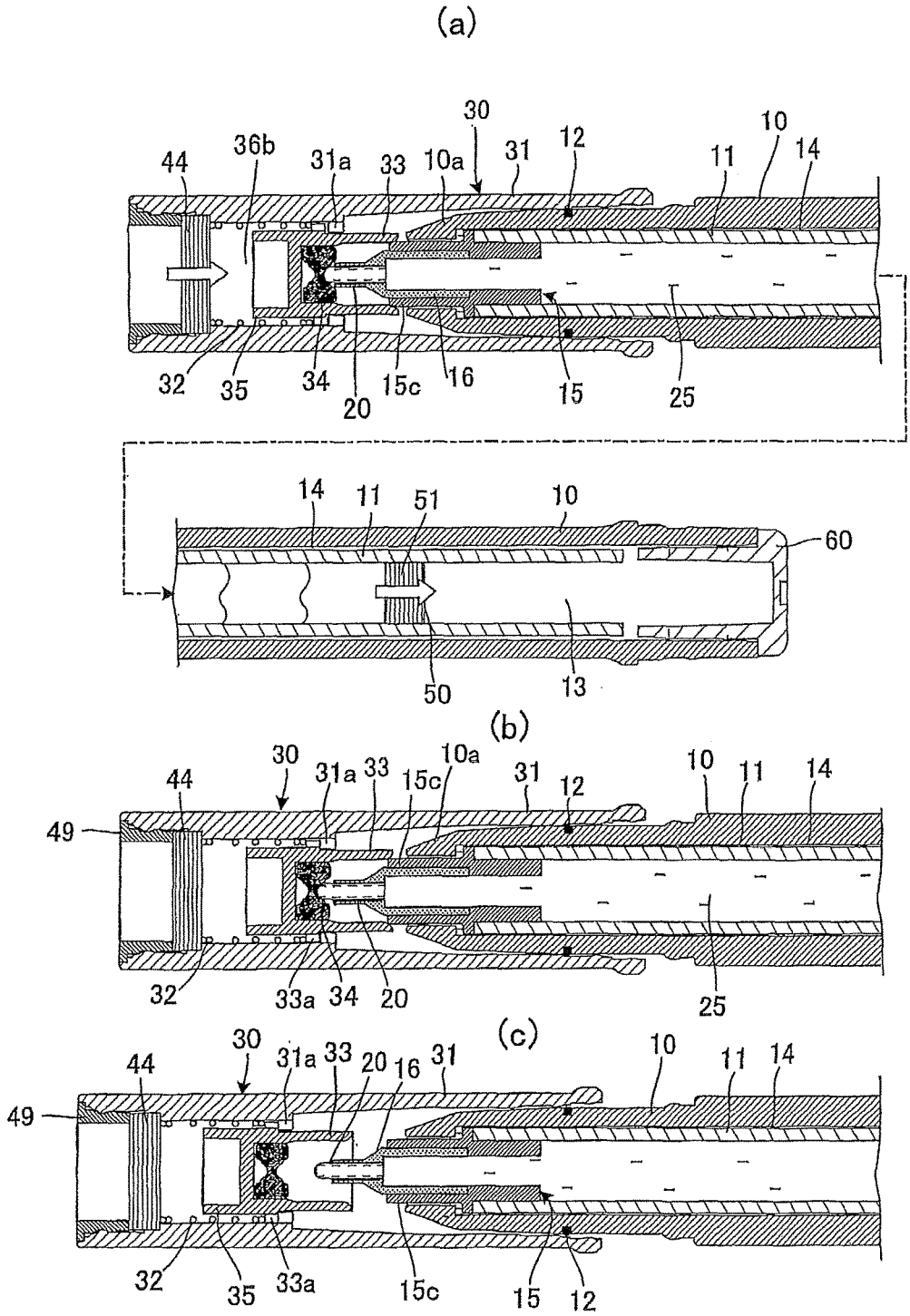
FIG. 38(*a*) to (*c*) are explanatory drawings for explaining the pressure reducing mechanism installed in the cap member in the writing instrument shown in FIG. 36, and they are partially enlarged vertical cross sections for explaining in order a process in which the cap member is detached from the writing instrument main body.

FIG. 36 to FIG. 38 relate to a writing instrument showing the second performing form of the fourth embodiment in the present invention, and they are the respective drawings following FIG. 33 to FIG. 35 of the first performing form described above.

In a writing instrument T according to the above second performing form, a pressure reducing member 44 is obtained by composing the pressure reducing member 41 of the pressure reducing mechanism 40 provided in the cap member 30 by using the same material as that of the inhibiting member 51 of the inhibiting mechanism 50 in the writing instrument S of the first performing form described above. In the present performing form, the writing instrument T is different from the writing instrument S of the first performing form described above in terms of composing a pen feed of a fiber bundle feed comprising acryl fibers and mounting the above pressure reducing member 44 to an aperture part of the cap member 30 by a cylindrical mounting member 49.

In the writing instrument T of the present second performing form, a first space part 36*a* and a second space part 36*b* of the cap member 30 are contracted, as shown in FIG. 37(*a*) to (*c*), in a volume in installing the cap member 30 while sealing by the cap member 30 as is the case with the writing instrument S of the first performing form described above, and the cap member 30 is provided with a structure in which an increased portion of the pressure is released (when the pressure is higher than a set pressure, it is discharged) by a pressure reducing member 44 in a pressure reducing mechanism 40 provided in the cap member 30. On the other hand, in releasing (detaching) the cap member 30, the first space part 36*a* and the second space part 36*b* are expanded, as shown in FIG. 38(*a*) to (*c*), in a volume by detaching the cap member 30 while maintaining sealing of the cap member 30, but the above spaces can indirectly be reduced in a pressure since the first space part 36*a* and the second space part 36*b* are communicated with the space 27 of the ink tank 11. Also, even when an inside of the ink tank 11 in a writing instrument main body 10 is increased in a pressure in storing the writing instrument, the pressure is released by the pressure reducing member 40, and an increased portion of the pressure remaining slightly in the ink tank 11 can be forcibly reduced in detaching the cap member by the pressure reducing member 44 provided in the cap member 30. Accordingly, the writing instrument in which the ink is prevented from leaking from the pen tip 20 in use is obtained. Also, a flow pressure of the ink applied to the pen tip can be controlled to a fixed level to prevent an ink direct flow phenomenon•reverse flow phenomenon also in the above writing instrument T as is the case with the writing instrument S of the first performing form of the fourth embodiment described above.

Figure 39:
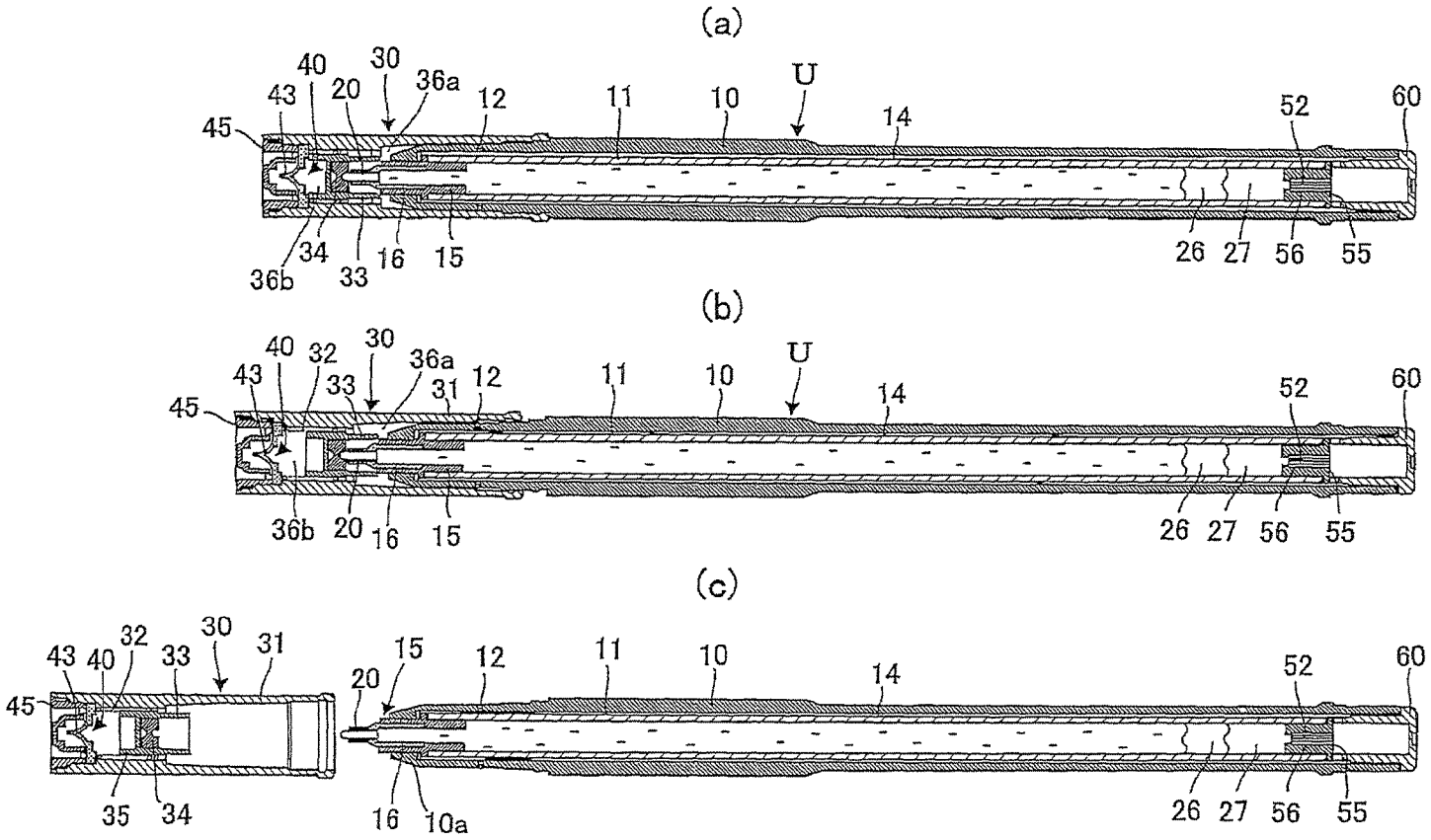
FIG. 39(*a*) to (*c*) show a writing instrument showing another example of a performing form in the fourth embodiment of the present invention, and they are the respective vertical cross sections showing a state in which a cap member is mounted, a state in the middle of detaching the cap member and a state in which the cap member is detached.

FIG. 39(*a*) to (*c*) relate to a writing instrument showing the third performing form of the fourth embodiment in the present invention.

The writing instrument U according to the third performing form is different from the writing instrument S of the first performing form described above in terms of constituting the inhibiting member 51 of the inhibiting mechanism 50 provided at a rear side of the ink tank in the writing instrument S of the first performing form of the fourth embodiment described above from a porous member 52 provided with a capillary force.

The porous member 52 provided with a capillary force includes, for example, those prepared by impregnating porous members selected from fiber feeds obtained by processing fiber bundles, sintered members, felts and the like or subjecting the above fiber bundles to resin processing, or porous members (sintered members) obtained by sintering various plastic powders and the like with liquids such as mineral oils, process oils, silicone oils, ionic oils, and the like. In the present performing form, it is composed of combinations of fiber bundle feeds and process oils.

The above porous member 52 provided with a capillary force is held by a through hole 56 of a mounting member 55 mounted at an aperture part of an ink tank 11, and it functions in the same manner as the inhibiting member 51 of the writing instrument T of the second performing form described above.

According to the writing instrument U of the performing form of the present fourth embodiment, it acts in the same manner as the writing instruments S, T of the respective performing forms described above; an inside of the ink tank can be reduced in a pressure in releasing the cap to make it possible to prevent the ink from leaking from the pen tip in use even if an inside of the writing instrument main body is increased in a pressure in storing the writing instrument; and in addition thereto, a flow pressure applied to the pen tip can be controlled to a fixed level to prevent an ink direct flow phenomenon•reverse flow phenomenon.

Figure 40:
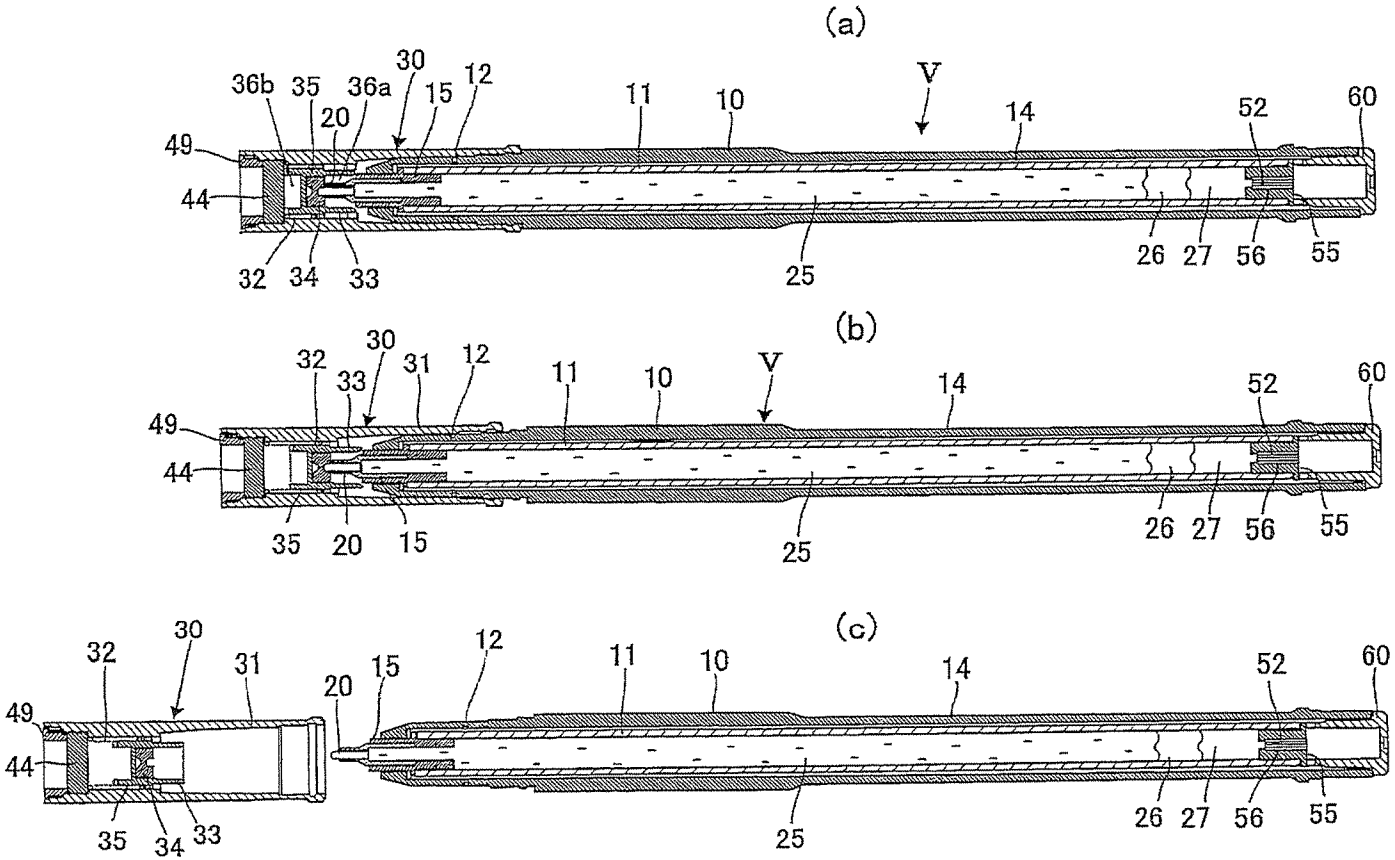
FIG. 40(*a*) to (*c*) show a writing instrument showing another example of a performing form in the fourth embodiment of the present invention, and they are the respective vertical cross sections showing a state in which a cap member is mounted, a state in the middle of detaching the cap member and a state in which the cap member is detached.

FIG. 40(*a*) to (*c*) relate to a writing instrument showing the fourth performing form of the fourth embodiment in the present invention.

In the writing instrument V according to the above fourth performing form, a pressure reducing member 44 is obtained by composing a pressure reducing member 41 of a pressure reducing mechanism 40 provided in a cap member 30 by using the same material as that of the inhibiting member 51 of the inhibiting mechanism 50 in the writing instrument T of the second performing form described above. In the present performing form, the writing instrument V is different from the writing instrument S of the first performing form described above in terms of composing a pen feed of a fiber bundle feed comprising acryl fibers, and it functions in the same manner as the writing instruments S, T and U of the respective performing forms described above.

Figure 41:
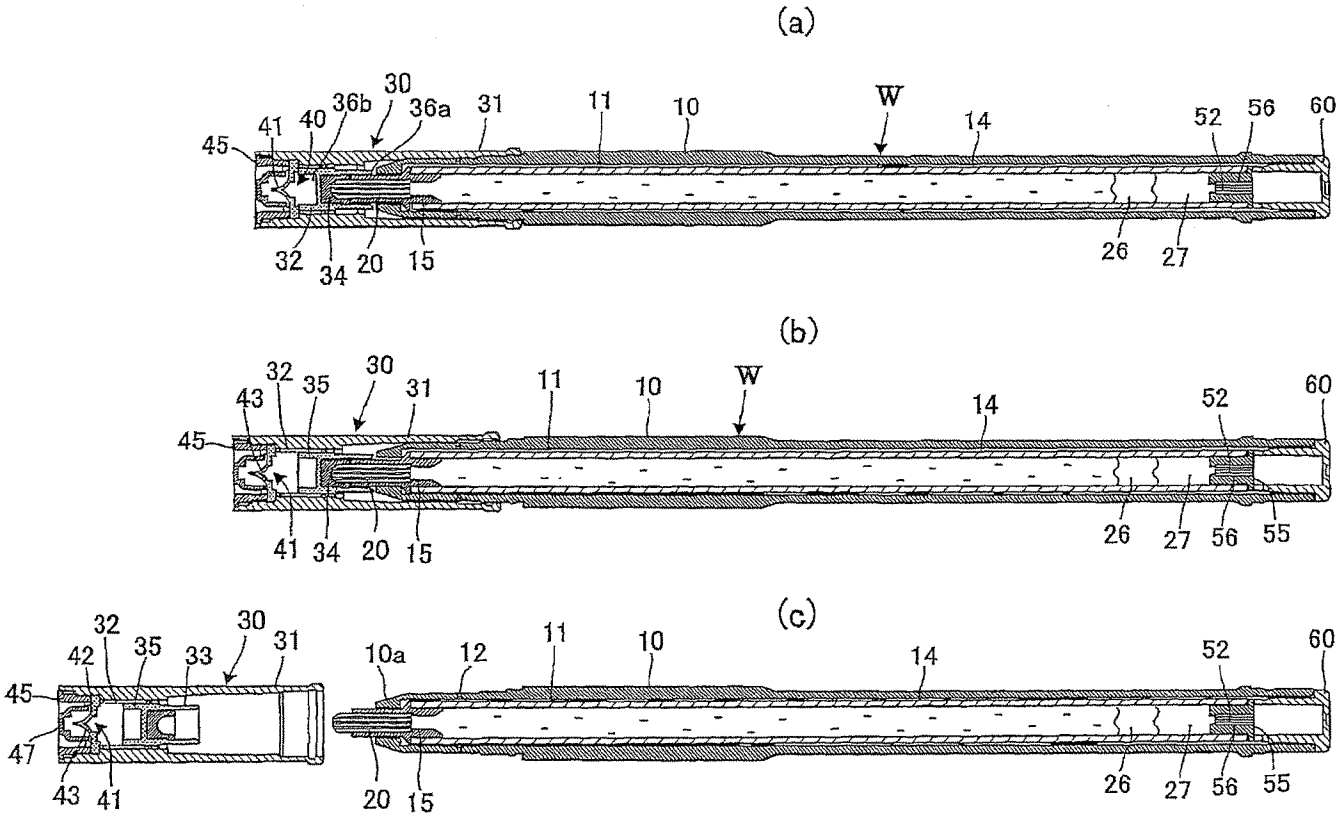
FIG. 41(*a*) to (*c*) show a writing instrument showing another example of a performing form in the fourth embodiment of the present invention, and they are the respective vertical cross sections showing a state in which a cap member is mounted, a state in the middle of detaching the cap member and a state in which the cap member is detached.

FIG. 41(*a*) to (*c*) relate to a writing instrument showing the fifth performing form of the fourth embodiment in the present invention.

The writing instrument W according to the above fifth performing form is different from the writing instrument U of the third performing form described above in terms of exchanging the plastic feed 20 in which ink grooves are formed in a holder direction on various plastic materials in the writing instrument U of the third performing form described above for a pen feed which is a writing part composed of a fiber feed obtained by processing fiber bundles or subjecting the fiber bundles to resin processing, or a sintered feed (porous member) obtained by sintering various plastic powders, in the present performing form, a pen feed composed of polyethylene terephthalate (PET) fibers, and it functions in the same manner as the writing instruments S, T, U and V of the respective performing forms described above.

Figure 42:
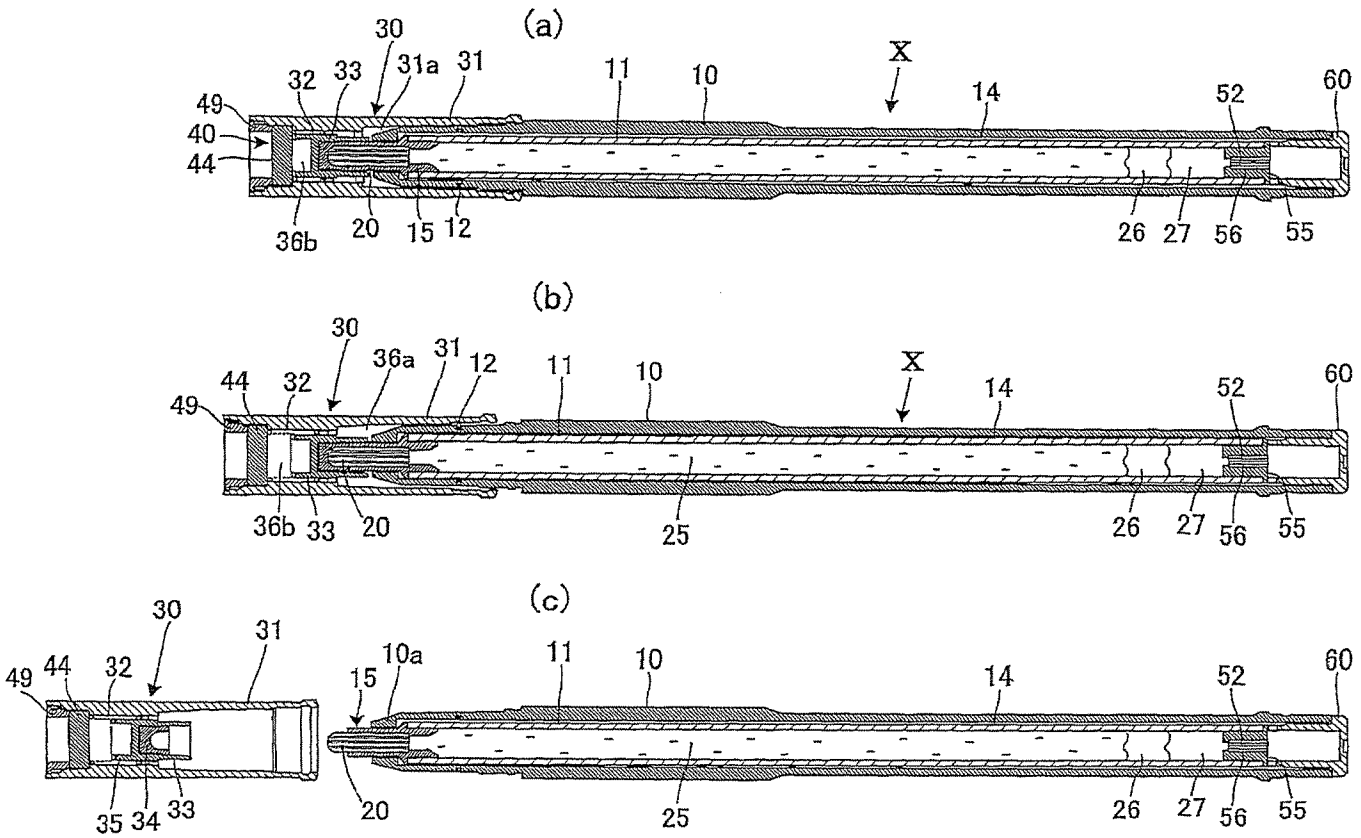
FIG. 42(*a*) to (*c*) show a writing instrument showing another example of a performing form in the fourth embodiment of the present invention, and they are the respective vertical cross sections showing a state in which a cap member is mounted, a state in the middle of detaching the cap member and a state in which the cap member is detached.

FIG. 42(*a*) to (*c*) relate to a writing instrument showing the sixth performing form of the fourth embodiment in the present invention.

In the writing instrument X according to the above sixth performing form, a pressure reducing member 44 is obtained by composing a pressure reducing member 41 of a pressure reducing mechanism 40 provided in a cap member 30 by using the same material as that of the inhibiting member 51 of the inhibiting mechanism 50 in the writing instrument W of the fifth performing form described above. In the present performing form, the writing instrument X is different from the writing instrument W of the fifth performing form described above in terms of composing a pen feed of a fiber bundle feed comprising acryl fibers, and it functions in the same manner as the writing instruments S, T, U, V and W of the respective performing forms described above.

Figure 43:
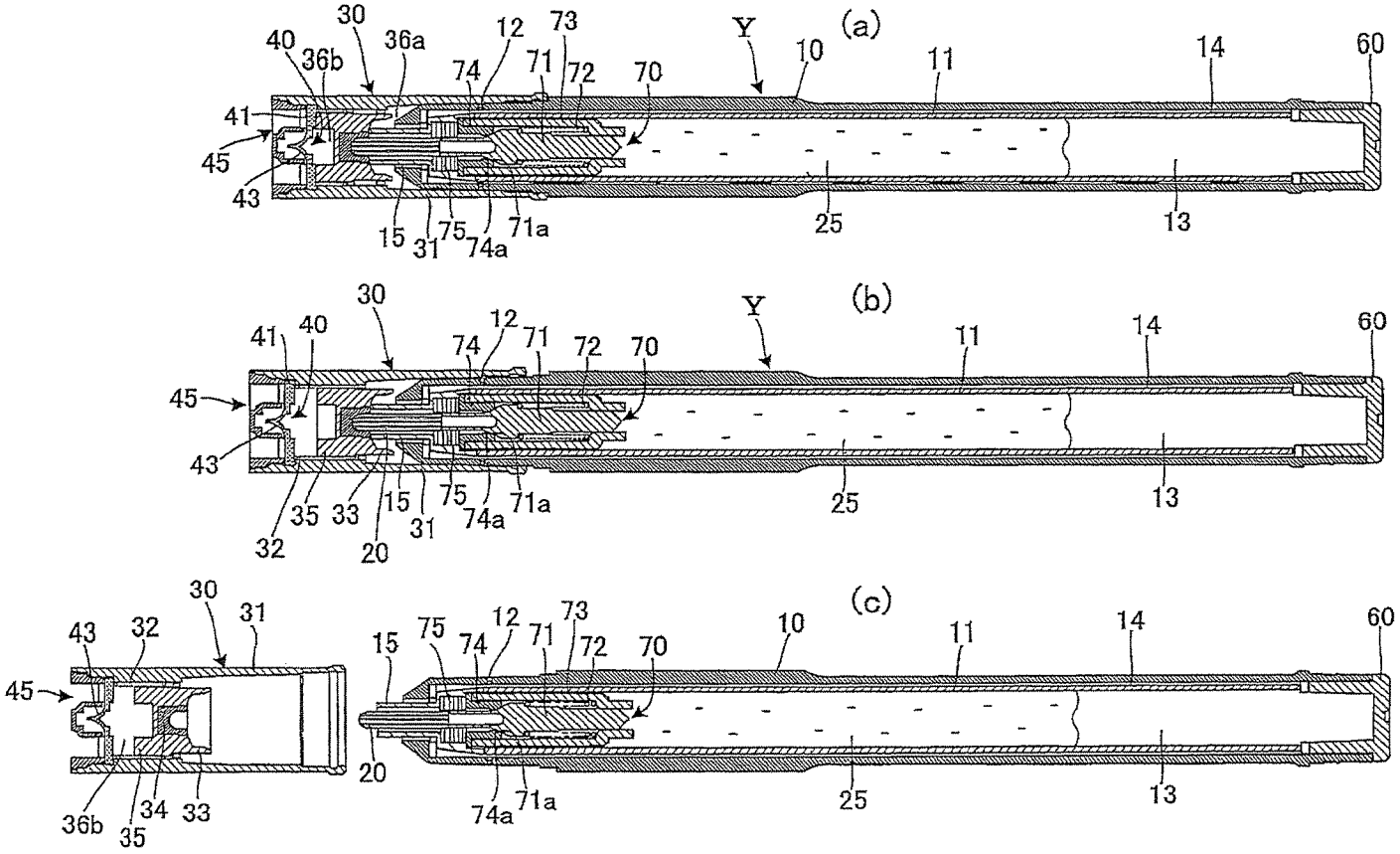
FIG. 43(*a*) to (*c*) show a writing instrument showing another example of a performing form in the fourth embodiment of the present invention, and they are the respective vertical cross sections showing a state in which a cap member is mounted, a state in the middle of detaching the cap member and a state in which the cap member is detached.
Figure 44:
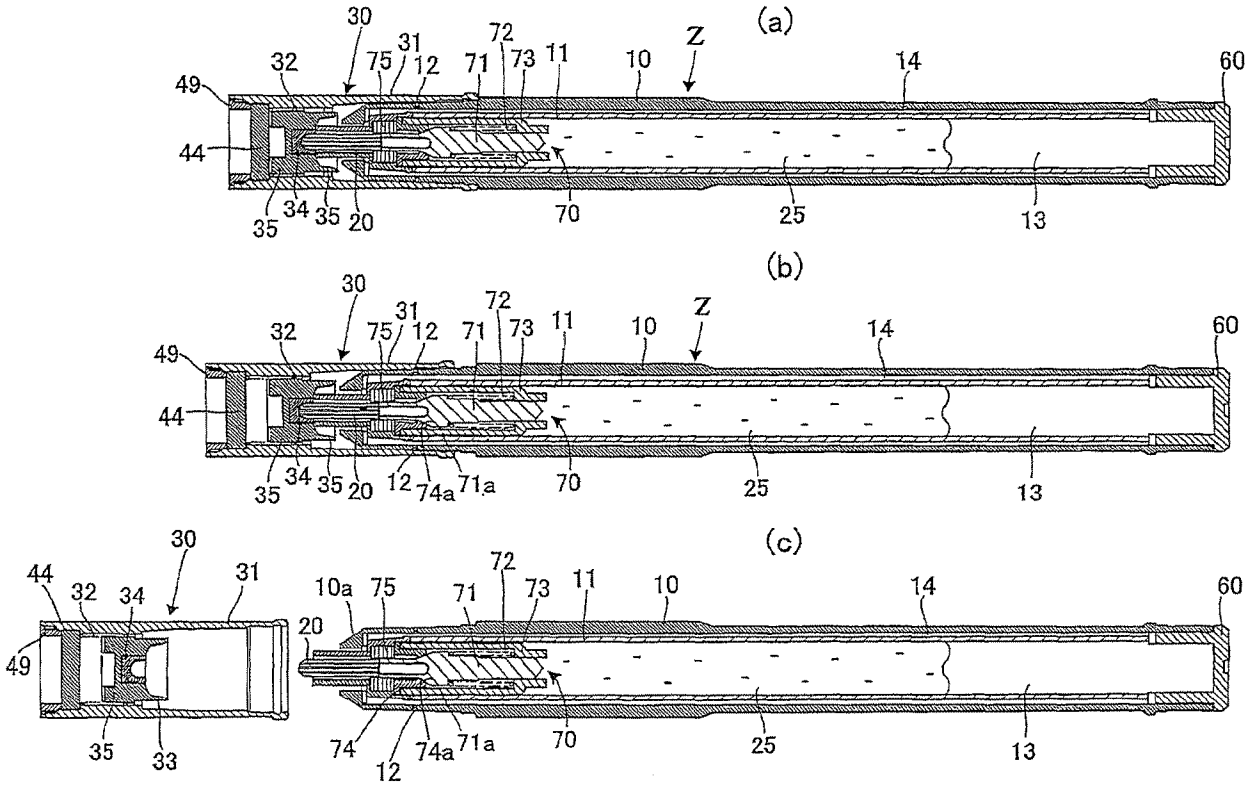
FIG. 44(*a*) to (*c*) show a writing instrument showing another example of a performing form in the fourth embodiment of the present invention, and they are the respective vertical cross sections showing a state in which a cap member is mounted, a state in the middle of detaching the cap member and a state in which the cap member is detached.

FIG. 43(*a*) to (*c*) and FIG. 44(*a*) to (*c*) relate to a writing instrument showing the seventh performing form and the eighth performing form of the fourth embodiment in the present invention.

The writing instrument Y according to the above seventh performing form is different from the writing instrument W of the performing form described above in terms of supplying the ink 25 by a valve member 70 in a mechanism of supplying the ink 25 from the refill to the pen feed 20 comprising a fiber feed and the like and omitting the follower (following member) 26 which follows as the ink is consumed in writing.

Also, in the writing instrument Z according to the eighth performing form, a pressure reducing member 44 is obtained by composing a pressure reducing member 41 of a pressure reducing mechanism 40 provided in a cap member 30 by using the same material as that of the inhibiting member 51 of the inhibiting mechanism 50 in the writing instrument Y of the seventh performing form described above, and in the present performing form, the writing instrument Z is different from the writing instrument W of the seventh performing form described above in terms of composing a pen feed of butyl rubber (IIR).

The valve member 70 in the respective performing forms described above is provided with a valve rod 71 which is brought into contact with a rear end part of the pen feed 20 and which can go back in conjunction with going back of the above pen feed, a spring member 72 pressing the above valve rod 71 to a direction of the pen feed 20, a main body part 73 receiving these valve rod 71 and spring member 72, and a valve seat member 74 closing and opening a passage of an ink from a refill 11 to the pen feed 20. The valve rod 71 goes back by pressing the pen feed 20 to cause a valve member 71*a* formed in the valve rod 71 to separate from a valve seat 74*a* of the valve seat member 74, and the ink 25 in the refill 11 is supplied to the pen feed 20. Also, a mark 75 is a temporary storing part composed of a porous member such as a sponge and the like which is provided at a rear end side of the pen feed 20.

According to the writing instruments Y and Z of the present seventh and eighth performing forms, they function in the same manner as the writing instruments S, T, U, V, W and X of the respective performing forms described above.

EXAMPLES

Next, the present invention shall be explained in further details with reference to examples, but the present invention shall not be restricted to the examples shown below.

Example 1

Marking Pen, Based on FIG. 1 and FIG. 2

Constitutions of Writing Instrument Main Body 10 and Front Holder 15:

Constitutions of writing instrument main body (ink tank) and front holder: made of PP Writing instrument main body (ink tank): wall thickness (thickness): 0.7 mm, length: 100 mm, diameter: 5.5 mm Constitution of Pen Tip 20:

Writing part pen feed: sintered feed made of PP, porosity: 60%, length: 8 mm, diameter: 3 mm Constitution of Member 35:

Member (tail plug): made of PP, through hole: 3 mm. slit hole: 3.3 mm, length: 5 mm Constitution of Capillary Porous Member 40:

Capillary porous member: made of acryl fiber bundle feed, porosity: 60%, length: 5 mm, diameter: 3 mm Liquid: manufactured by Matsumura Oil Co., Ltd.: barrel process oil P-26

Constitution of Cap Member 50:

Main body: made of polypropylene, sealing member: made of butyl rubber

Compositions of Ink 25 and Follower 30:

A fluorescent pink ink having the following composition was used as the ink.

| | |
|---|---|
| Coloring material: VC toner pink (manufactured by Mikuni Color Ltd.) | 30 parts by mass |
| Wetting agent: glycerin | 25 parts by mass |
| Preservative: Bioace (manufactured by K-I Chemical Industry Co., Ltd.) | 0.7 part by mass |
| Ion-exchanged water | 44.3 parts by mass |

Components having the following composition were heated for one hour under stirring to obtain a follower.

| | |
|---|---|
| Mineral oil (PW-90: manufactured by Idemitsu Kosan Co., Ltd.) | 95 parts by mass |
| Thickener (TPO5: manufactured by Nihon Plus Co., Ltd.) | 5 parts by mass |

When the writing instrument of a marking pen type thus constituted in Example 1 was used to write, it was found that obtained was a marking pen which could write as usual and did not cause a direct flow of an ink even after finishing writing and which could control a flow pressure of the ink applied to a pen tip to a fixed level to prevent an ink direct flow phenomenon•reverse flow phenomenon.

Example 2

Ballpoint Pen, Based on FIG. 7

Constitutions of Writing Instrument Members Different from Those in Example 1:

Constitutions (writing instrument main body, front holder, members, capillary porous member, cap member and follower) other than the following feed, pen tip and ink are the same as the constitutions shown in Example 1 described above.

Feed: PET fiber bundle, porosity: 60%, ϕ5×5 mm

Pen tip (ballpoint pen tip): tip made of stainless steel (cemented carbide ball, ball diameter 0.5 mm)

An ink (whole amount: 100 parts by mass) for a ballpoint pen having the following composition was used as the ink.

| | |
|---|---|
| Coloring material: carbon black | 8.0 parts by mass |
| Dispersant: styrene maleic acid resin ammonium salt | 3.0 parts by mass |
| Lubricant: potash soap | 0.5 part by mass |
| Liquid medium: propylene glycol | 20.0 parts by mass |
| Preservative: 1,2-benzisothiazolone salt | 0.3 part by mass |
| pH controller: aminomethylpropanol | 0.3 part by mass |
| Antirust agent: benzotriazole | 0.2 part by mass |
| Viscosity controller: cross-linking type acrylic acid polymer | 0.4 part by mass |
| Ion-exchanged water | balance |

When the writing instrument of a ballpoint pen type thus constituted in Example 2 was used to write, it was found that obtained was a ballpoint pen which could write as usual and did not cause a direct flow of the ink even after finishing writing and which could control a flow pressure of the ink applied to the pen tip to a fixed level to prevent an ink direct flow phenomenon•reverse flow phenomenon.

Example 3

Based on FIG. 8 to FIG. 11

Respective Constitutions of Writing Instrument Main Body, Refill, Front Holder and Joint Member:

Writing instrument main body 10: made of AS, wall thickness (thickness): 1.5 mm, length: 120 mm, diameter: ϕ10 mm Refill (ink tank) 11: made of PP, wall thickness (thickness): 0.8 mm, length: 100 mm, diameter: ϕ5.6 mm Front holder: made of SUS, joint member: made of PP Constitution of Pen Tip:

Writing part pen feed 20: made of POM, length: 10 mm, diameter: ϕ1.0 mm

Constitution of Capillary Porous Member 41:

Capillary porous member: fiber feed made of acryl, porosity: 60%, length: 5 mm, diameter: ϕ2.0 mm Liquid: manufactured by Matsumura Oil Co., Ltd.: barrel process oil P-26

Constitution of Tail Plug

Made of PP, communicating hole: diameter: ϕ0.8 mm

Constitution of Cap Member:

Main body: made of PP, sealing member: made of IIR

Pressure Reducing Mechanism:

Elastic member: coil-like spring made of SUS, elastic (spring) load: 10N, cap member drawing force: 25N, buckling load of pen feed 20: 7N Compositions of Ink 25 and Follower 26:

The fluorescent pink ink and the follower each used in Example 1 described above were used as the ink and the follower.

When the writing instrument of the second embodiment thus constituted in Example 3 was used to write, it was found that obtained was a writing instrument which could write as usual and did not cause a direct flow of an ink even after finishing writing and which could control a flow pressure of the ink applied to a pen tip to a fixed level to prevent an ink direct flow phenomenon•reverse flow phenomenon.

Also, when the cap member was detached, the space part of the refill which was the ink tank was expanded in a volume, but it was structured so that an increased portion of the pressure was discharged through the capillary porous member impregnated with the liquid. Further, it was confirmed that an inside of the ink tank could be reduced in a pressure in detaching the cap member to prevent the ink from leaking from the pen tip in use.

Example 4

Ballpoint Pen, Based on FIG. 15

Constitutions of Writing Instrument Members Different from Those in Example 3:

Constitutions (writing instrument main body, refill, front holder, joint member, capillary porous member, cap member, follower and pressure reducing mechanism) other than the following feed, pen tip and ink are the same as the constitutions shown in Example 3 described above.

Feed: PET fiber bundle, porosity: 60%, ϕ5.0×5 mm

Pen tip (ballpoint pen tip): tip made of stainless steel (cemented carbide ball, ball diameter 0.5 mm)

The ink (whole amount: 100 parts by mass) for a ballpoint pen having the composition used in Example 2 described above was used as the ink.

When the writing instrument of a ballpoint pen type thus constituted in Example 4 was used to write, it was found that obtained was a ballpoint pen which could write as usual and did not cause a direct flow of an ink even after finishing writing and which could control a flow pressure of the ink applied to a pen tip to a fixed level to prevent an ink direct flow phenomenon•reverse flow phenomenon. Also, it was confirmed that as was the case with Example 3, an inside of the ink tank could be reduced in a pressure in detaching the cap member to prevent the ink from leaking from the pen tip in use.

Example 5

Based on FIG. 16 to FIG. 19

Respective Constitutions of Writing Instrument Main Body, Refill and Front Holder:

Writing instrument main body 10: made of AS, wall thickness (thickness): 1.5 mm, length: 120 mm, diameter: ϕ10 mm Refill (ink tank) 11: made of PP, wall thickness (thickness): 0.8 mm, length: 100 mm, diameter: ϕ5.6 mm Front holder: made of SUS Constitution of Pen Tip:

Writing part pen feed: made of POM, length: 10 mm, diameter: Φ1.0 mm

Constitution of Capillary Porous Member 41:

Capillary porous member: fiber feed made of acryl, porosity: 60%, length: 5 mm, diameter: ϕ2.0 mm Liquid: manufactured by Matsumura Oil Co., Ltd.: barrel process oil P-26

Constitution of Tail Plug

Made of PP, communicating hole: diameter: ϕ0.8 mm

Constitution of Cap Member:

Main body: made of PP, sealing member: made of IIR

Pressure Reducing Member and the Like:

Elastic member: coil-like spring made of SUS, elastic (spring) load: 10N, cap member drawing force: 25N, buckling load of pen feed 20: 7N Constitution of flexible pressure reducing member: made of NBR Compositions of Ink 25 and Follower 26:

The fluorescent pink ink having the composition used in Example 1 described above was used as the ink. Barrel process oil P-26 manufactured by Matsumura Oil Co., Ltd. was used as the follower.

When the writing instrument of the third embodiment thus constituted in Example 5 was used to write, it was found that obtained was a writing instrument which could write as usual and did not cause a direct flow of an ink even after finishing writing and which could control a flow pressure of the ink applied to a pen tip to a fixed level to prevent an ink direct flow phenomenon•reverse flow phenomenon.

Also, when the cap member was detached, the space part of the refill which was the ink tank was expanded in a volume, but it was confirmed that since the writing instrument was structured so that an increased portion of the pressure was discharged through the capillary porous member impregnated with the liquid, an inside of the ink tank could be reduced in a pressure in detaching the cap member to prevent the ink from leaking from the pen tip in use.

Also, in the cases of the respective writing instruments M to O and Q shown in FIG. 20 to FIG. 23 and FIG. 9 to FIG. 14, the respective writing instruments M to O and Q (4 writing instruments) were prepared based on the constitutional parts and the ink used in Example 5 and evaluated to find that obtained were the respective writing instruments M to O and Q which could write as usual in writing and did not cause a direct flow of an ink even after finishing writing and which could control a flow pressure of the ink applied to a pen tip to a fixed level to prevent an ink direct flow phenomenon•reverse flow phenomenon. Also, when the cap member was detached, the space part of the refill which was the ink tank was expanded in a volume, but it was confirmed that since the writing instrument was structured so that an increased portion of the pressure was discharged through the capillary porous member impregnated with the liquid, an inside of the ink tank could be reduced in a pressure in detaching the cap member to prevent the ink from leaking from the pen tip in use.

Example 6

Ballpoint Pen, Based on FIG. 23

Constitutions of Writing Instrument Members Different from Those in Example 5:

Constitutions (writing instrument main body, front holder, members, capillary porous member and cap member) other than the following pen tip and ink are the same as the constitutions shown in Example 5 described above.

Pen tip (ballpoint pen tip): tip made of stainless steel (cemented carbide ball, ball diameter 0.5 mm)

The ink for a ballpoint pen and the follower each having the compositions used in Example 2 described above were used as the ink and the follower.

When the writing instrument of a ballpoint pen type thus constituted in Example 6 was used to write, it was found that obtained was a ballpoint pen which could write as usual and did not cause a direct flow of an ink even after finishing writing and which could control a flow pressure of the ink applied to a pen tip to a fixed level to prevent an ink direct flow phenomenon•reverse flow phenomenon. Also, it was confirmed that as was the case with Example 1, an inside of the ink tank could be reduced in a pressure in detaching the cap member to prevent the ink from leaking from the pen tip in use.

Example 7

Ballpoint Pen of a Knock System, Based on FIG. 28 to FIG. 32

The ink used in Example 2 and a pressing member made of polyacetal were used for a knock system, an outer holder and an ink reservoir (refill tube, internal diameter: 4 mm) of a ballpoint pen member (SXN-150-05) manufactured by Mitsubishi Pencil Co., Ltd., and the other component parts based on Example 5 were used to prepare a ballpoint pen of a knock system based on FIG. 28 to FIG. 32.

When the writing instrument of a ballpoint pen type of a knock system thus constituted in Example 7 was used to write, it was found that obtained was a ballpoint pen of a knock system which could write as usual and did not cause a direct flow of an ink even after finishing writing and which could control a flow pressure of the ink applied to a pen tip to a fixed level to prevent an ink direct flow phenomenon•reverse flow phenomenon. Also, it was confirmed that an inside of the ink tank could be reduced in a pressure in carrying out knocking operation to prevent the ink from leaking from the pen tip in use.

Example 8

Based on FIG. 33 to FIG. 35

Respective Constitutions of Writing Instrument Main Body, Refill and Joint Member:

Writing instrument main body: made of AS, wall thickness (thickness): 1.0 mm, length: 120 mm, diameter: ϕ10 mm Refill (ink tank): made of PP, wall thickness (thickness): 0.8 mm, length: 100 mm, diameter: ϕ5.6 mm Writing part pen feed: fiber bundle feed made of PET, porosity: 60%, length: 5 mm, diameter: ϕ2.0 mm Constitution of Tail Plug:

Member (tail plug): made of PP

Constitution of Pressure Reducing Member 41:

Pressure reducing member: made of IIR, outer diameter: ϕ6.0 mm

Constitution of Inhibiting Member 51:

Inhibiting member: made of acryl, porosity: 70%, length: 5 mm, diameter: ϕ2.0 mm Constitution of Tail Plug:

Made of PP: diameter: ϕ10 mm

Constitution of Cap Member:

Main body: made of PP, sealing member: made of IIR

Compositions of ink 25 and follower 26:

The fluorescent pink ink and the follower each used in Example 1 described above were used as the ink and the follower.

When the writing instrument thus constituted in Example 8 was used to write, it was found that obtained was a writing instrument which could write as usual in writing and did not cause a direct flow of an ink even after finishing writing and which could control a flow pressure of the ink applied to a pen tip to a fixed level to prevent an ink direct flow phenomenon•reverse flow phenomenon.

Also, when the cap member was detached, the space part of the refill which was the ink tank was expanded in a volume, but it was confirmed that since the writing instrument was structured so that an increased portion of the pressure was discharged through the capillary porous member impregnated with the liquid, an inside of the ink tank could be reduced in a pressure in detaching the cap member to prevent the ink from leaking from the pen tip in use.

Example 9

Ballpoint Pen, Based on FIG. 33 to FIG. 35

Constitutions of Writing Instrument Members Different from Those in Example 8:

Constitutions other than the following pen tip and ink are the same as the constitutions shown in Example 8 described above.

Pen tip (ballpoint pen tip): tip made of stainless steel (cemented carbide ball, ball diameter 0.5 mm)

The ink for a ballpoint pen having the composition used in Example 2 described above was used as the ink.

When the writing instrument of a ballpoint pen type thus constituted in Example 9 was used to write, it was found that obtained was a marking pen which could write as usual and did not cause a direct flow of an ink even after finishing writing and which could control a flow pressure of the ink applied to a pen tip to a fixed level to prevent an ink direct flow phenomenon•reverse flow phenomenon. Also, it was confirmed that as was the case with Example 8 described above, an inside of the ink tank could be reduced in a pressure in detaching the cap member to prevent the ink from leaking from the pen tip in use.

INDUSTRIAL APPLICABILITY

The writing instruments of the present invention can suitably be used for a ballpoint pen and a marking pen such as an underline pen, an oil-based marker, a water-based marker and the like.

LIST OF REFERENCE NUMERALS AND LETTERS

A Writing instrument

10 Writing instrument main body (ink tank)

15 Front holder

20 Pen tip

30 Follower (following member)

40 Capillary porous member

50 Cap member

What is claimed is:

1. A writing instrument comprising a pen tip disposed at a front part of an ink tank, an ink received in the ink tank, a follower filled at a rear part of the ink, and a capillary porous member provided with a capillary force by impregnating the porous member with a liquid, which is arranged at a space part between a rear part of the follower and a rear end part of the ink tank in a state in which the follower is filled, wherein a capillary force provided at a pen tip side is larger than a total of an own weight of the ink and the capillary force at a rear part of the writing instrument, and the pen tip is sealed when a cap is put on the writing instrument.

2. A writing instrument comprising a pen tip disposed at a front part of an ink tank, an ink received in the ink tank, a follower filled at a rear part of the ink, and a capillary porous member provided with a capillary force by impregnating the porous member with a liquid, which is arranged at a space part between a rear part of the follower and a rear end part of the ink tank in a state in which the follower is filled, wherein the capillary porous member is brought into contact with a member having a slit part; a capillary force provided at a pen tip side is larger than a total of an own weight of the ink and the capillary force at a rear part of the writing instrument; and the pen tip is sealed when a cap is put on the writing instrument.

* * * * *